US005724433A

United States Patent [19]

Engebretson et al.

[11] Patent Number: 5,724,433

[45] Date of Patent: Mar. 3, 1998

[54] ADAPTIVE GAIN AND FILTERING CIRCUIT FOR A SOUND REPRODUCTION SYSTEM

[75] Inventors: A. Maynard Engebretson, Ladue, Mo.; Michael P. O'Connell, Somerville, Mass.

[73] Assignee: K/S HIMPP, Vaerloese, Denmark

[21] Appl. No.: 477,621

[22] Filed: Jun. 7, 1995

Related U.S. Application Data

[62] Division of Ser. No. 44,246, Apr. 7, 1993.

[51] Int. Cl.[6] ..... H04R 75/00

[52] U.S. Cl. ..... 381/106; 381/108

[58] Field of Search ..... 381/68.4, 68, 68.2, 381/106, 94; 333/14

[56] References Cited

U.S. PATENT DOCUMENTS

| | | | |
|---|---|---|---|
| 3,803,357 | 4/1974 | Sacks | 179/1 P |
| 3,818,149 | 6/1974 | Stearns et al. | 179/107 FD |
| 4,118,604 | 10/1978 | Yanick | 179/107 FD |
| 4,135,590 | 1/1979 | Gaulder | 179/1 P |
| 4,185,168 | 1/1980 | Graupe et al. | 179/1 P |
| 4,187,413 | 2/1980 | Moser | 179/107 FD |
| 4,227,046 | 10/1980 | Nakajima et al. | 179/1 SD |
| 4,384,276 | 5/1983 | Kelley et al. | 340/347 DA |
| 4,405,831 | 9/1983 | Michelson | 179/1 P |
| 4,425,481 | 1/1984 | Mansgold et al. | 179/107 FD |
| 4,433,435 | 2/1984 | David | 381/94 |
| 4,451,820 | 5/1984 | Kapral | 340/347 DA |
| 4,508,940 | 4/1985 | Steeger . | |
| 4,513,279 | 4/1985 | Kapral | 340/347 DA |
| 4,630,302 | 12/1986 | Kryter . | |
| 4,680,798 | 7/1987 | Neumann | 381/68.4 |
| 4,731,850 | 3/1988 | Levitt et al. | 381/68.2 |
| 4,792,977 | 12/1988 | Anderson et al. | 381/68.4 |
| 4,829,593 | 5/1989 | Hara | 375/345 |
| 4,891,605 | 1/1990 | Tirkel | 381/94 |
| 4,988,900 | 1/1991 | Fensch | 307/494 |
| 5,010,575 | 4/1991 | Marutake et al. | 381/68 |
| 5,083,312 | 1/1992 | Newton | 381/68.4 |

FOREIGN PATENT DOCUMENTS

| | | | |
|---|---|---|---|
| WO 8908353 | 2/1988 | WIPO | H04B 1/64 |
| WO 91/05437 | 5/1990 | WIPO . | |

OTHER PUBLICATIONS

Braida et al., "Review of Recent Research on Multiband Amplitude Compression for the Hearing Impaired", 1982 pp. 133–140.

Yanick, Jr., "Improvement in Speech Discrimination with Compression vs. Linear Amplification", *Journal of Auditory Research*, No. 13, 1973, pp. 333–338.

Villchur, "Signal Processing to Improve Speech Intelligibility in Perceptive Deafness", *The Journal of The Acoustical Society of America*, vol. 53, No. 6, 1973, pp. 1646–1657.

Braida et al., "Hearing Aids–A Review of Past Research on Linear Amplification, Amplitude Compression, and Frequency Lowering", *Asha Monographs*, No. 19, Apr. 1979, pp. vii–115.

(List continued on next page.)

*Primary Examiner*—Sinh Tran

*Attorney, Agent, or Firm*—Senniger, Powers, Leavitt & Roedel

[57] ABSTRACT

Adaptive compressive gain and level dependent spectral shaping circuitry for a hearing aid include a microphone to produce an input signal and a plurality of channels connected to a common circuit output. Each channel has a preset frequency response. Each channel includes a filter with a preset frequency response to receive the input signal and to produce a filtered signal, a channel amplifier to amplify the filtered signal to produce a channel output signal, a threshold register to establish a channel threshold level, and a gain circuit. The gain circuit increases the gain of the channel amplifier when the channel output signal falls below the channel threshold level and decreases the gain of the channel amplifier when the channel output signal rises above the channel threshold level. A transducer produces sound in response to the signal passed by the common circuit output.

27 Claims, 6 Drawing Sheets

OTHER PUBLICATIONS

Lim et al., "Enhancement and Bandwidth Compression of Noisy Speech", *Proceedings of the IEEE*, vol. 67, No. 12, Dec. 1979, pp. 1586–1604.

Lippmann et al., "Study of Multichannel Amplitude Compression and Linear Amplification for Persons with Sensorineural Hearing Loss", *The Journal of The Acoustical Society of, America*, vol. 69, No. 2, Feb. 1981, pp. 524–534.

Walker et al., "Compression in Hearing Aids: An Analysis, A Review and Some Recommendations", National Acoustic Laboratories, Report No. 90, Jun. 1982, pp. 1–41.

Dillon et al., "Compression–Input or Output Control?", *Hearing Instruments*, vol. 34, No. 9, 1983, pp. 20, 22 & 42.

Laurence et al., "A Comparison of Behind–the–Ear High–Fidelity Linear Hearing Aids and Two–Channel Compression Aids, in the Laboratory and in Everyday Life", *British Journal of Audiology*, No. 17, 1983, pp. 31–48.

Nabelek, "Performance of Hearing–Impaired Listeners under Various Types of Amplitude Compression", *The Journal of The Acoustical Society of America*, vol. 74, No. 3, Sep. 1983, pp. 776–791.

Leijon et al., "Preferred Hearing Aid Gain and Bass–Cut in Relation to Prescriptive Fitting", Scand Audiol, No. 13, 1984 pp. 157–161.

Walker et al., "The Effects of Multichannel Compression/Expansion Amplification on the Intelligibility of Nonsense Syllables in Noise", *The Journal of The Acoustical Society of America*, vol. 76, No. 3, Sep. 1984, pp. 746–757.

Moore et al., "Improvements in Speech Intelligibility in Quiet and in Noise Produced by Two–Channel Compression Hearing Aids", *British Journal of Audiology*, No. 19, 1985, pp. 175–187.

Moore et al., "A Comparison of Two–Channel and Single–Channel Compression Hearing Aids", *Audiology*, No. 25, 1986, pp. 210–226.

De Gennaro et al., "Multichannel Syllabic Compression for Severely Impaired Listeners", *Journal of Rehabilitation Research and Development*, vol. 23, No. 1, 1986, pp. 17–24.

Revoile et al., "Some Rehabilitative Considerations for Future Speech–Processing Hearing Aids", *Journal of Rehabilitation Research and Development*, vol. 23, No. 1, 1986, pp. 89–94.

Graupe et al., "A Single–Microphone–Based Self–Adaptive Filter of Noise from Speech and its Performance Evaluation", *Journal of Rehabilitation Research and Development*, vol. 24, No. 4, Fall 1987, pp. 119–126.

Villchur, "Multichannel Compression Processing for Profound Deafness", *Journal of Rehabilitation Research and Development* vol. 24, No. 4, Fall 1987, pp. 135–148.

Bustamante et al., "Multiband Compression Limiting for Hearing–Impaired Listeners", *Journal of Rehabilitation Research and Development*, vol. 24, No. 4, Fall 1987, pp. 149–160.

Yund et al., "Speech Discrimination with an 8–Channel Compression Hearing Aid and Conventional Aids in Background of Speech–Band Noise", *Journal of Rehabilitation Research and Development*, vol. 24, No. 4, Fall 1987, pp. 161–180.

Moore, "Design and Evaluation of a Two–Channel Compression Hearing Aid", *Journal of Rehabilitation Research and Development*, vol. 24, No. 4, Fall 1987, pp. 181–192.

Plomp, "The Negative Effect of Amplitude Compression in Multichannel Hearing Aids in the Light of the Modulation–Transfer Function", *The Journal of the Acoustical Society of America*, vol. 83, No. 6, Jun. 1988, pp. 2322–2327.

Waldhauer et al., "Full Dynamic Range Multiband Compression in a Hearing Aid", *The Hearing Journal*, Sep. 1988, pp. 29–32.

Van Tasell et al., "Effects of an Adaptive Filter Hearing Aid on Speech Recognition in Noise by Hearing–Impaired Subjects", *Ear and Hearing*, vol. 9, No. 1, 1988, pp. 15–21.

Moore et al., "Practical and Theoretical Considerations in Designing and Implementing Automatic Gain Control (AGC) in Hearing Aids", *Quaderni di Audiologia*, No. 4, 1988, pp. 522–527.

Leijon, "1.3.5 Loudness–Density Equalization", *Optimization of Hearing–Aid Gain and Frequency Response for Cochlear Hearing Losses*, Technical Report No. 189, Chalmers University of Technology, 1989, pp. 17–20.

Leijon, "4.7 Loudness–Density Equalization", *Optimization of Hearing–Aid Gain and Frequency Response for Cochlear Hearing Losses*, Technical Report No. 189, Chalmers University of Technology, 1989, pp. 127–128.

Johnson et al., "Digitally Programmable Full Dynamic Range Compression Technology", *Hearing Instruments*, vol. 40, No. 10 1989, pp. 26–27 & 30.

Killion, "A High Fidelity Hearing Aid", *Hearing Instruments*, vol. 41, No. 8, 1990, pp. 38–39.

Van Dijkhuizen, *Studies on the Effectiveness of Multichannel Automatic Gain–Control in Hearing Aids*, Vrije Universiteit te Amsterdam, 1991, pp. 1–86, in addition to ERRATA sheets, pp. 1 & 2.

Rankovic et al., "Potential Benefits of Adaptive Frequency–Gain Characteristics for Speech Reception in Noise", *The Journal of The Acoustical Society of America*, vol. 91, No. 1, Jan. 1992, pp. 354–362.

Moore et al., "Effect on the Speech Reception Threshold in Noise of the Recovery Time of the Compressor in the High–Frequency Channel of a Two–Channel Aid", *Scand Audiol*, No. 38 1993, pp. 1–10.

INPUT
12
OUTPUT
112
110
78
80
14
F1
LIMITER
F1
74
76
GI
72
70
66
16
28
32
X = GAIN CR
COMPARATOR
22
18
34
G2
20
THRESHOLD LEVEL
64
68
COMPRESSION RATIO
GAIN REGISTER
CLOCK
62
24
48
50
46
ADDER
44
54
38
MPX
60
40
Δp
Δm
42
36
F2
F2
F3
F3
F4
F4

ADAPTIVE GAIN AND FILTERING CIRCUIT FOR A SOUND REPRODUCTION SYSTEM

This is a division of application Ser. No. 08/044,246, filed Apr. 7, 1993.

GOVERNMENT SUPPORT

This invention was made with U.S. Government support under Veterans Administration Contracts VA KV 674-P-857 and VA KV 674-P-1736 and National Aeronautics and Space Administration (NASA) Research Grant No. NAG10-0040. The U.S. Government has certain rights in this invention.

NOTICE

Copyright ©1988 Central Institute for the Deaf. A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

The present invention relates to adaptive compressive gain and level dependent spectral shaping circuitry for a sound reproduction system and, more particularly, to such circuitry for a hearing aid.

The ability to perceive speech and other sounds over a wide dynamic range is important for employment and daily activities. When a hearing impairment limits a person's dynamic range of perceptible sound, incoming sound falling outside of the person's dynamic range should be modified to fall within the limited dynamic range to be heard. Soft sounds fall outside the limited dynamic range of many hearing impairments and must be amplified above the person's hearing threshold with a hearing aid to be heard. Loud sounds fall within the limited dynamic range of many hearing impairments and do not require a hearing aid or amplification to be heard. If the gain of the hearing aid is set high enough to enable perception of soft sounds; however, intermediate and loud sounds will be uncomfortably loud. Because speech recognition does not increase over that obtained at more comfortable levels, the hearing-impaired person will prefer a lower gain for the hearing aid. However, a lower gain reduces the likelihood that soft sounds will be amplified above the hearing threshold. Modifying the operation of a hearing aid to reproduce the incoming sound at a reduced dynamic range is referred to herein as compression.

It has also been found that the hearing-impaired prefer a hearing aid which varies the frequency response in addition to the gain as sound level increases. The hearing-impaired may prefer a first frequency response and a high gain for low sound levels, a second frequency response and an intermediate gain for intermediate sound levels, and a third frequency response and a low gain for high sound levels. This operation of a hearing aid to vary the frequency response and the gain as a function of the level of the incoming sound is referred to herein as "level dependent spectral shaping."

In addition to amplifying and filtering incoming sound effectively, a practical ear-level hearing aid design must accommodate the power, size and microphone placement limitations dictated by current commercial hearing aid designs. While powerful digital signal processing techniques are available, they can require considerable space and power so that most are not suitable for use in an ear-level hearing aid. Accordingly, there is a need for a hearing aid that varies its gain and frequency response as a function of the level of incoming sound, i.e., that provides an adaptive compressive gain feature and a level dependent spectral shaping feature each of which operates using a modest number of computations, and thus allows for the customization of variable gain and variable filter parameters according to a user's preferences.

SUMMARY OF THE INVENTION

Among the several objects of the present invention may be noted the provision of a circuit in which the gain is varied in response to the level of an incoming signal; the provision of a circuit in which the frequency response is varied in response to the level of an incoming signal; the provision of a circuit which adaptively compresses an incoming signal occurring over a wide dynamic range into a limited dynamic range according to a user's preference; the provision of a circuit in which the gain and the frequency response are varied in response to the level of an incoming signal; and the provision of a circuit which is small in size and which has minimal power requirements for use in a hearing aid.

Generally, in one form the invention provides an adaptive compressing and filtering circuit having a plurality of channels connected to a common output. Each channel includes a filter with preset parameters to receive an input signal and to produce a filtered signal, a channel amplifier which responds to the filtered signal to produce a channel output signal, a threshold circuit to establish a channel threshold level for the channel output signal, and a gain circuit. The gain circuit responds to the channel output signal and the channel threshold level to increase the gain setting of the channel amplifier up to a predetermined limit when the channel output signal falls below the channel threshold level and to decrease the gain setting of the channel amplifier when the channel output signal rises above the channel threshold level. The channel output signals are combined to produce an adaptively compressed and filtered output signal. The circuit is particularly useful when incorporated in a hearing aid. The circuit would include a microphone to produce the input signal and a transducer to produce sound as a function of the adaptively compressed and filtered output signal. The circuit could also include a second amplifier in each channel which responds to the filtered signal to produce a second channel output signal. The hearing aid may additionally include a circuit for programing the gain setting of the second channel amplifier as a function of the gain setting of the first channel amplifier.

Another form of the invention is an adaptive gain amplifier circuit having an amplifier to receive an input signal in the audible frequency range and to produce an output signal. The circuit includes a threshold circuit to establish a threshold level for the output signal. The circuit further includes a gain circuit which responds to the output signal and the threshold level to increase the gain of the amplifier up to a predetermined limit in increments having a magnitude dp when the output signal falls below the threshold level and to decrease the gain of the amplifier in decrements having a magnitude dm when the output signal rises above the threshold level. The output signal is compressed as a function of the ratio of dm over dp to produce an adaptively compressed output signal. The circuit is particularly useful in a hearing aid. The circuit may include a microphone to produce the input signal and a transducer to produce sound as a function of the adaptively compressed output signal.

Still another form of the invention is a programmable compressive gain amplifier circuit having a first amplifier to receive an input signal in the audible frequency range and to produce an amplified signal. The circuit includes a threshold circuit to establish a threshold level for the amplified signal. The circuit further includes a gain circuit which responds to the amplified signal and the threshold level to increase the gain setting of the first amplifier up to a predetermined limit when the amplified signal falls below the threshold level and to decrease the gain setting of the first amplifier when the amplified signal rises above the threshold level. The amplified signal is thereby compressed. The circuit also has a second amplifier to receive the input signal and to produce an output signal. The circuit also has a gain circuit to program the gain setting of the second amplifier as a function of the gain setting of the first amplifier. The output signal is programmably compressed. The circuit is useful in a hearing aid. The circuit may include a microphone to produce the input signal and a transducer to produce sound as a function of the programmably compressed output signal.

Still another form of the invention is an adaptive filtering circuit having a plurality of channels connected to a common output, each channel including a filter with preset parameters to receive an input signal in the audible frequency range to produce a filtered signal and an amplifier which responds to the filtered signal to produce a channel output signal. The circuit includes a second filter with preset parameters which responds to the input signal to produce a characteristic signal. The circuit further includes a detector which responds to the characteristic signal to produce a control signal. The time constant of the detector is programmable. The circuit also has a log circuit which responds to the detector to produce a log value representative of the control signal. The circuit also has a memory to store a preselected table of log values and gain values. The memory responds to the log circuit to select a gain value for each of the amplifiers in the channels as a function of the produced log value. Each of the amplifiers in the channels responds to the memory to separately vary the gain of the respective amplifier as a function of the respective selected gain value. The channel output signals are combined to produce an adaptively filtered output signal. The circuit is useful in a hearing aid. The circuit may include a microphone to produce the input signal and a transducer to produce sound as a function of the adaptively filtered output signal.

Yet still another form of the invention is an adaptive filtering circuit having a filter with variable parameters to receive an input signal in the audible frequency range and to produce an adaptively filtered signal. The circuit includes an amplifier to receive the adaptively filtered signal and to produce an adaptively filtered output signal. The circuit additionally has a detector to detect a characteristic of the input signal and a controller which responds to the detector to vary the parameters of the variable filter and to vary the gain of the amplifier as functions of the detected characteristic.

Other objects and features will be in part apparent and in part pointed out hereinafter.

DETAILED DESCRIPTION OF PREFERRED EMBODIMENTS

Figure 1:
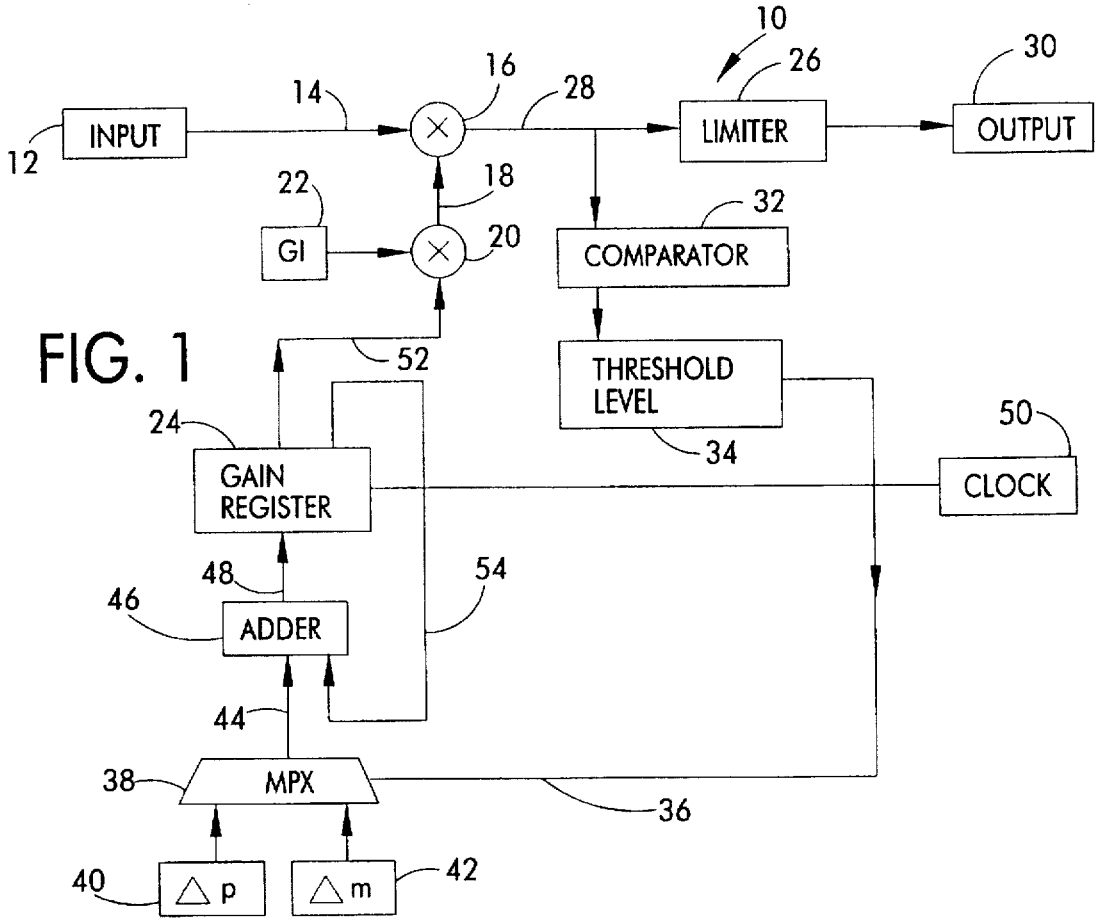
FIG. 1 is a block diagram of an adaptive compressive gain circuit of the present invention.

An adaptive filtering circuit of the present invention as it would be embodied in a hearing aid is generally indicated at reference number 10 in FIG. 1. Circuit 10 has an input 12 which represents any conventional source of an input signal such as a microphone, signal processor, or the like. Input 12 also includes an analog to digital converter (not shown) for analog input signals if circuit 10 is implemented with digital components. Likewise, input 12 includes a digital to analog converter (not shown) for digital input signals if circuit 10 is implemented with analog components.

Input 12 is connected by a line 14 to an amplifier 16. The gain of amplifier 16 is controlled via a line 18 by an amplifier 20. Amplifier 20 amplifies the value stored in a gain register 24 according to a predetermined gain setting stored in a gain register 22 to produce an output signal for controlling the gain of amplifier 16. The output signal of amplifier 16 is connected by a line 28 to a limiter 26. Limiter 26 peak clips the output signal from amplifier 16 to provide an adaptively clipped and compressed output signal at output 30 in accordance with the invention, as more fully described below. The output 30, as with all of the output terminals identified in the remaining Figs. below, may be connected to further signal processors or to drive the transducer (not shown) of a hearing aid.

With respect to the remaining components in circuit 10, a comparator 32 monitors the output signal from amplifier 16 via line 28. Comparator 32 compares the level of said output with a threshold level stored in a register 34 and outputs a comparison signal via a line 36 to a multiplexer 38. When the level of the output signal of amplifier 16 exceeds the threshold level stored in register 34, comparator 32 outputs a high signal via line 36. When the level of the output of amplifier 16 falls below the threshold level stored in register 34, comparator 32 outputs a low signal via line 36. Multiplexer 38 is also connected to a register 40 which stores a magnitude dp and to a register 42 which stores a magnitude dm. When multiplexer 38 receives a high signal via line 36, multiplexer 38 outputs a negative value corresponding to dm via a line 44. When multiplexer 38 receives a low signal via line 36, multiplexer 38 outputs a positive value corresponding to dp via line 44. An adder 46 is connected via line 44 to multiplexer 38 and is connected via a line 54 to gain register 24. Adder 46 adds the value output by multiplexer 38 to the value stored in gain register 24 and outputs the sum via a line 48 to update gain register 24. The circuit components for updating gain register 24 are enabled in response to a predetermined portion of a timing sequence produced by a clock 50. Gain register 24 is connected by a line 52 to amplifier 20. The values stored in registers 22 and 24 thereby control the gain of amplifier 20. The output signal from amplifier 20 is connected to amplifier 16 for increasing the gain of amplifier 16 up to a predetermined limit when the output level from amplifier 16 falls below the threshold level stored in register 34 and for decreasing the gain of amplifier 16 when the output level from amplifier 16 rises above the threshold level stored in register 34.

In one preferred embodiment, gain register 24 is a 12 bit register. The six most significant bits are connected by line 52 to control the gain of amplifier 16. The six least significant bits are updated by adder 46 via line 48 during the enabling portion of the timing sequence from clock 50. The new values stored in the six least significant bits are passed back to adder 46 via line 54. Adder 46 updates the values by dm or dp under the control of multiplexer 38. When the six least significant bits overflow the first six bits of gain register 24, a carry bit is applied to the seventh bit of gain register 24, thereby incrementing the gain setting of amplifier 20 by one bit. Likewise, when the six least significant bits underflow the first six bits of gain register 24, the gain setting of amplifier 20 is decremented one bit. Because the magnitudes dp and dm are stored in log units, the gain of amplifier 16 is increased and decreased by a constant percentage. A one bit change in the six most significant bits of gain register 24 corresponds to a gain change in amplifier 16 of approximately ¼ dB. Accordingly, the six most significant bits in gain register 24 provide a range of 32 decibels over which the conditions of adaptive limiting occur.

The sizes of magnitudes dp and dm are small relative to the value corresponding to the six least significant bits in gain register 24. Accordingly, there must be a net contribution of positive values corresponding to dp in order to raise the six least significant bits to their full count, thereby incrementing the next most significant bit in gain register 24. Likewise, there must be a net contribution of negative values corresponding to dm in order for the six least significant bits in gain register 24 to decrement the next most significant bit in gain register 24. The increments and decrements are applied as fractional values to gain register 24 which provides an averaging process and reduces the variance of the mean of the gain of amplifier 16. Further, since a statistical average of the percent clipping is the objective, it is not necessary to examine each sample. If the signal from input 12 is in digital form, clock 50 can operate at a frequency well below the sampling frequency of the input signal. This yields a smaller representative number of samples. For example, the sampling frequency of the input signal is divided by 512 in setting the frequency for clock 50 in FIG. 1.

In operation, circuit 10 adaptively adjusts the channel gain of amplifier 16 so that a constant percentage clipping by limiter 26 is achieved over a range of levels of the signal from input 12. Assuming the input signal follows a Laplacian distribution, it is modeled mathematically with the equation:

$$p(x)=1/(\mathrm{sqrt}(2)R)\ e^{-(\mathrm{sqrt}(2)\mathrm{abs}(x)/R)} \tag{1}$$

In equation (1), R represents the overall root means square signal level of speech. A variable $F_L$ is now defined as the fraction of speech samples that fall outside of the limits (L, −L). By integrating the Laplacian distribution over the intervals (−∞,−L) and (L,+∞), the following equation for $F_L$ is derived:

$$F_L=e^{-(\mathrm{sqrt}(2)L/R)} \tag{2}$$

As above, when a sample of the signal from input 12 is in the limit set by register 34, the gain setting in gain register 24 is reduced by dm. When a sample of the signal from input 12 is not in limit, the gain is increased by dp. Therefore, circuit 10 will adjust the gain of amplifier 16 until the following condition is met:

$$(1-F_L)dp=F_L\mathrm{dm} \tag{3}$$

After adaption, the following relationships are found:

$$dp=F_L(dp+\mathrm{dm}) \tag{4}$$

$$R/L=\mathrm{sqrt}(2)/\ln(1+\mathrm{dm}/\mathrm{dp}) \tag{5}$$

Within the above equations, the ratio R/L represents a compression factor established by the ratio dm/dp. The percentage of samples that are clipped at ±L is given by:

$$\%\ \mathrm{clipping}=F_L*100 \tag{6}$$

Table I gives typical values that have been found useful in a hearing aid. Column three is the "headroom" in decibels between the root mean square signal value of the input signal and limiting.

TABLE I

| dm/dp | R/L | R/L in dB | % clipping |
|---|---|---|---|
| 0 | ∞ | ∞ | 100 |
| 1/16 | 23.3 | 27.4 | 94 |
| 1/8 | 12.0 | 21.6 | 89 |
| ¼ | 6.3 | 16.0 | 80 |
| ½ | 3.5 | 10.9 | 67 |
| 1 | 2.04 | 6.2 | 50 |
| 2 | 1.29 | 2.2 | 33 |
| 4 | .88 | −1.1 | 20 |
| 8 | .64 | −3.8 | 11 |
| 16 | .50 | −6.0 | 6 |
| 32 | .40 | −7.9 | 3 |

In the above equations, the relationship, R=Gσ, applies where G represents the gain prior to limiting and σ represents the root mean square speech signal level of the input signal. When the signal level σ changes, circuit 10 will adapt to a new state such that R/L or Gσ/L returns to the compression factor determined by dp and dm. The initial rate of adaption is determined from the following equation:

$$\mathrm{dg}/dt=f_c(dp(1-e^{-(\mathrm{sqrt}(2)L/(G\sigma))})-\mathrm{dm}(e^{-(\mathrm{sqrt}(2)L/(G\sigma))}) \tag{7}$$

In equation (7), $f_c$ represents the clock rate of clock 50. The path followed by the gain (G) is determined by solving the following equations recursively:

$$dG=dp(1-e^{-(\mathrm{sqrt}(2)L/(G\sigma))})-\mathrm{dm}(e^{-(\mathrm{sqrt}(2)L/(G\sigma))}) \tag{8}$$

$$G=G+dG \tag{9}$$

Within equations (8) and (9), the attack and release times for circuit 10 are symmetric only for a compression factor (R/L) of 2.04. The attack time corresponds to the reduction of gain in response to an increase in signal σ. Release time corresponds to the increase in gain after the signal level σ is reduced. For a compression factor setting of 12, the release time is much shorter than the attack time. for a compression factor setting of 0.64 and 0.50, the attack time is much shorter than the release time. These latter values are preferable for a hearing aid.

As seen above, the rate of adaption depends on the magnitudes of dp and dm which are stored in registers 40 and 42. These 6-bit registers have a range from 1/128 dB to 63/128 (dB). Therefore, at a sampling rate of 16 kHz from clock 50, the maximum slope of the adaptive gain function ranges from 125 dB/sec to 8000 dB/sec. For a step change of 32 dB, this corresponds to a typical range of time constant from 256 milliseconds to four milliseconds respectively. If dm is set to zero, the adaptive compression feature is disabled.

Figure 2:
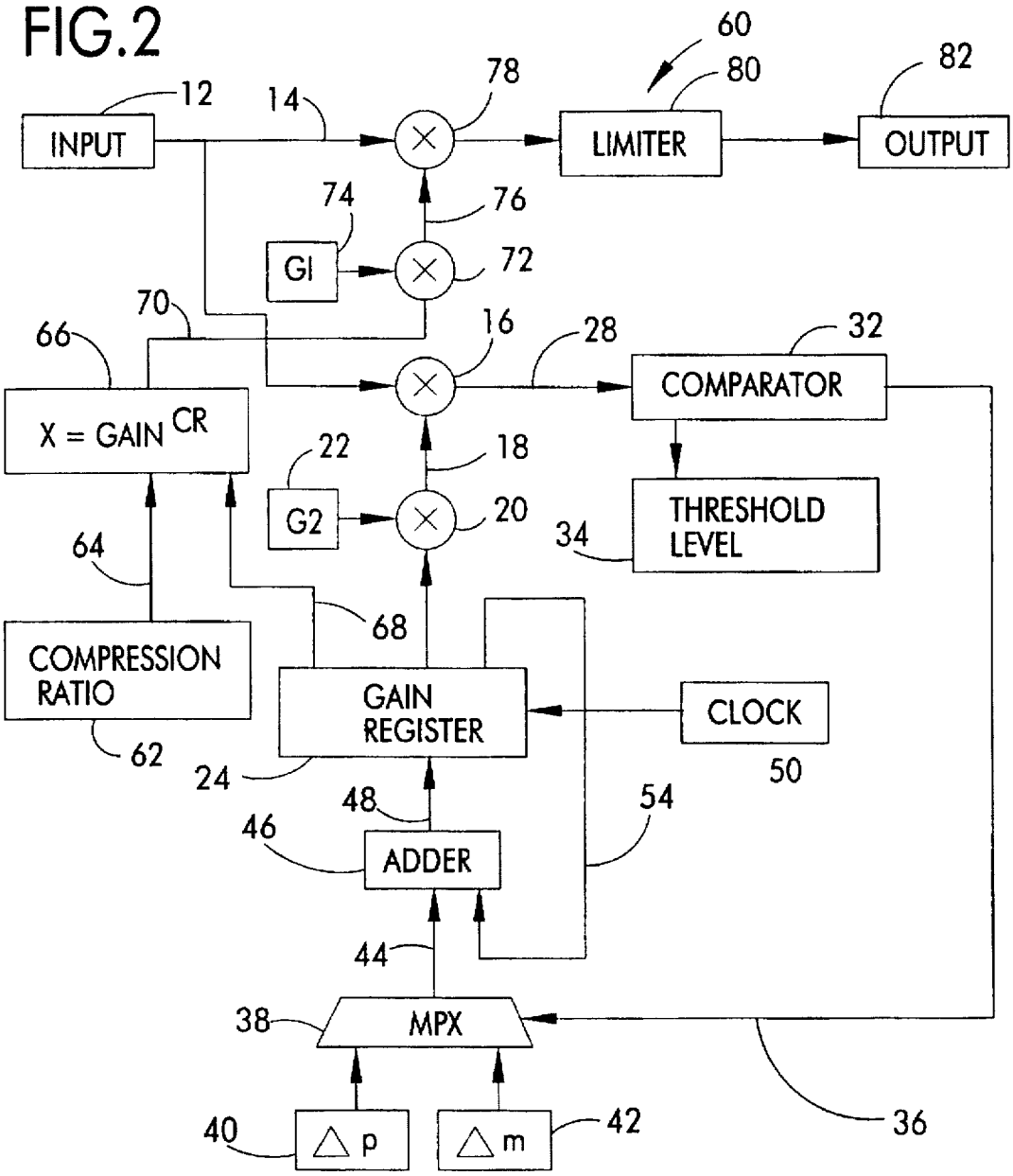
FIG. 2 is a block diagram of an adaptive compressive gain circuit of the present invention wherein the compression ratio is programmable.

FIG. 2 discloses a circuit 60 which has a number of common circuit elements with circuit 10 of FIG. 1. Such common elements have similar functions and have been marked with common reference numbers. In addition to circuit 10, however, circuit 60 of FIG. 2 provides for a programmable compression ratio. Circuit 60 has a gain control 66 which is connected to a register 62 by a line 64 and to gain register 24 by a line 68. Register 62 stores a compression factor. Gain control 66 takes the value stored in gain register 24 to the power of the compression ratio stored in register 62 and outputs said power gain value via a line 70 to an amplifier 72. Amplifier 72 combines the power gain value on line 70 with the gain value stored in a register 74 to produce an output gain on a line 76. An amplifier 78 receives the output gain via line 76 for controlling the gain of amplifier 78. Amplifier 78 amplifies the signal from input 12 accordingly. The output signal from amplifier 78 is peak clipped by a limiter 80 and supplied as an output signal for circuit 60 at an output 82 in accordance with the invention.

To summarize the operation of circuit 60, the input to limiter 80 is generated by amplifier 78 whose gain is programmably set as a power of the gain setting stored in gain register 24, while the input to comparator 32 continues to be generated as shown in circuit 10 of FIG. 1. Further, one of the many known functions other than the power function could be used for programmably setting the gain of amplifier 78.

Figure 3:
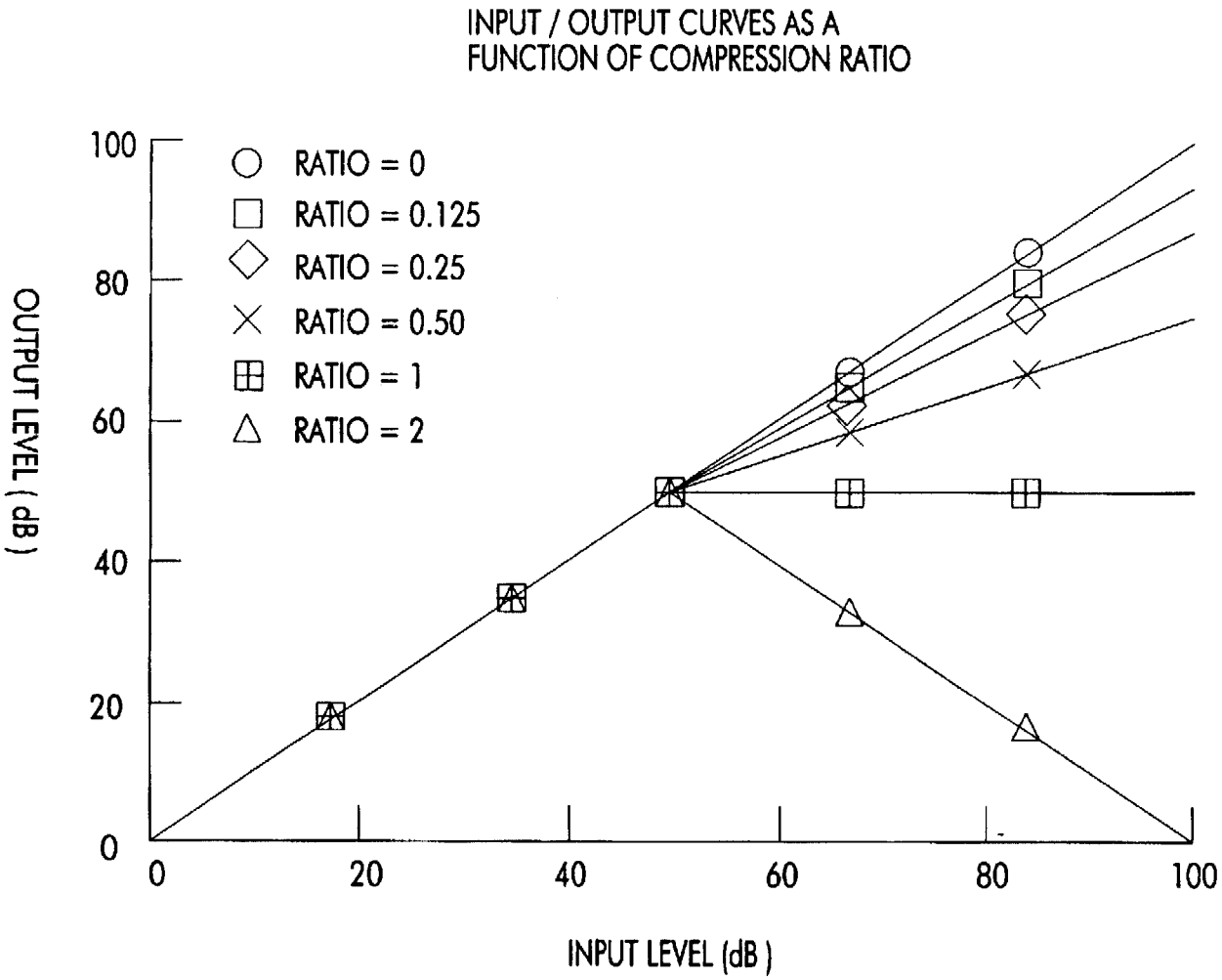
FIG. 3 is a graph showing the input/output curves for the circuit of FIG. 2 using compression ratios ranging from 0–2.

The improvement in circuit 60 of FIG. 2 over circuit 10 of FIG. 1 is seen in FIG. 3 which shows the input/output curves for compression ratios ranging from zero through two. The curve corresponding to a compression ratio of one is the single input/output curve provided by circuit 10 in FIG. 1. Circuit 60 of FIG. 2, however, is capable of producing all of the input/output curves shown in FIG. 3.

In practice, circuit 10 of FIG. 1 or circuit 60 of FIG. 2 may be used in several parallel channels, each channel filtered to provide a different frequency response. Narrow band or broad band filters may be used to provide maximum flexibility in fitting the hearing aid to the patient's hearing deficiency. Broad band filters are used if the patient prefers one hearing aid characteristic at low input signal levels and another characteristic at high input signal levels. Broad band filters can also provide different spectral shaping depending on background noise level. The channels are preferably constructed in accordance with the filter/limit/filter structure disclosed in U.S. Pat. No. 5,111,419 (hereinafter "the '419 patent") and incorporated herein by reference.

Figure 4:
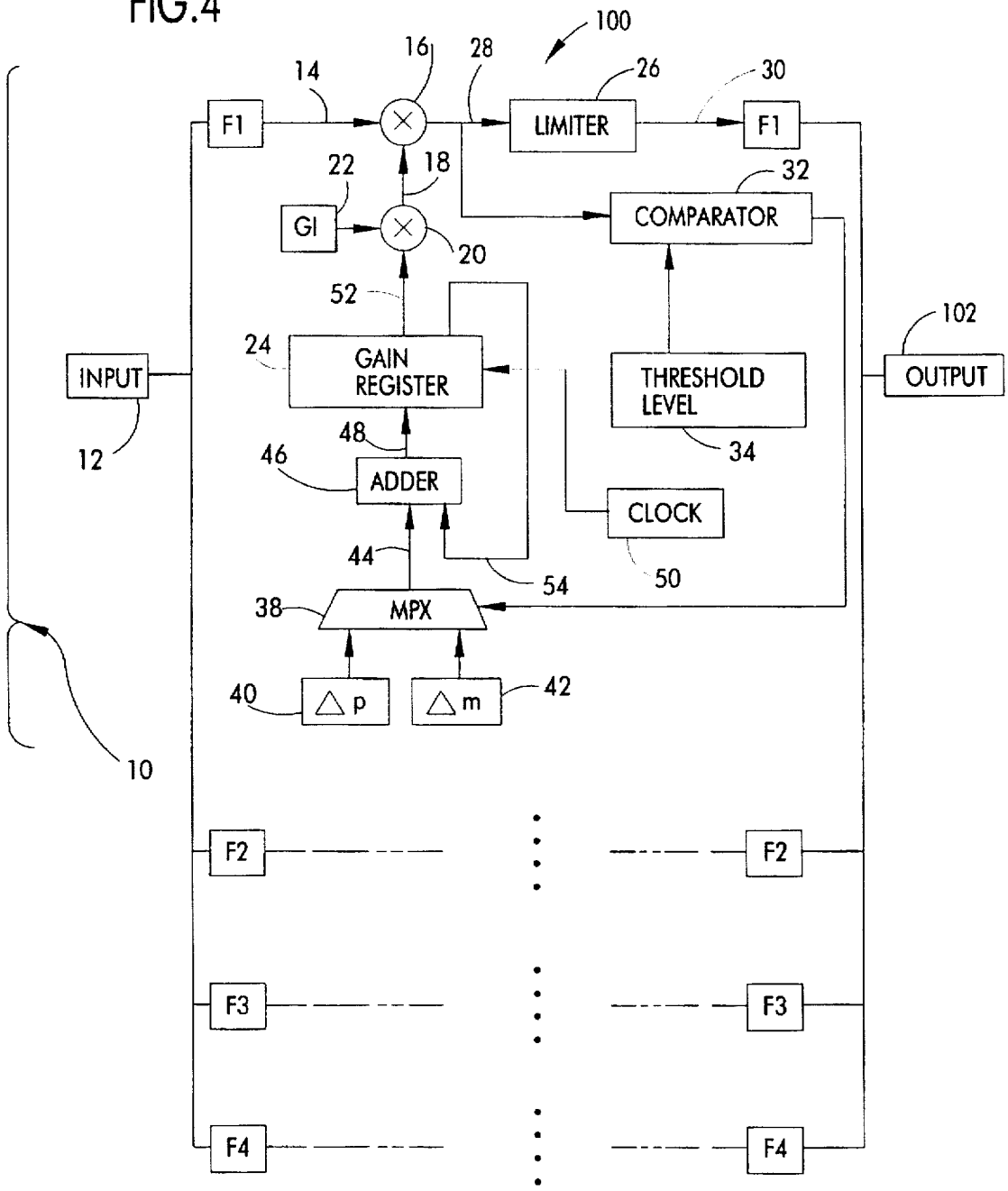
FIG. 4 shows a four channel level dependent spectral shaping circuit wherein the gain in each channel is adaptively compressed using the circuit of FIG. 1.

FIG. 4 shows a 4-channel filter/limit/filter structure for circuit 10 of FIG. 1. While many types of filters can be used for the channel filters of FIG. 4 and the other Figs., FIR filters are the most desirable. Each of the filters F1, F2, F3 and F4 in FIG. 4 are symmetric FIR filters which are equal in length within each channel. This greatly reduces phase distortion in the channel output signals, even at band edges. The use of symmetric filters further requires only about one half as many registers to store the filter co-efficients for a channel, thus allowing a simpler circuit implementation and lower power consumption. Each channel response can be programmed to be a band pass filter which is contiguous with adjacent channels. In this mode, filters F1 through F4 have preset filter parameters for selectively passing input 12 over a predetermined range of audible frequencies while substantially attenuating any of input 12 not occurring in the predetermined range. Likewise, channel filters F1 through F4 can be programmed to be wide band to produce overlapping channels. In this mode, filters F1 through F4 have preset filter parameters for selectively altering input 12 over substantially all of the audible frequency range. Various combinations of these two cases are also possible. Since the filter coefficients are arbitrarily specified, in-band shaping is applied to the band-pass filters to achieve smoothly varying frequency gain functions across all four channels. An output 102 of a circuit 100 in FIG. 4 provides an adaptively compressed and filtered output signal comprising the sum of the filtered signals at outputs 30 in each of the four channels identified by filters F1 through F4.

Figure 5:
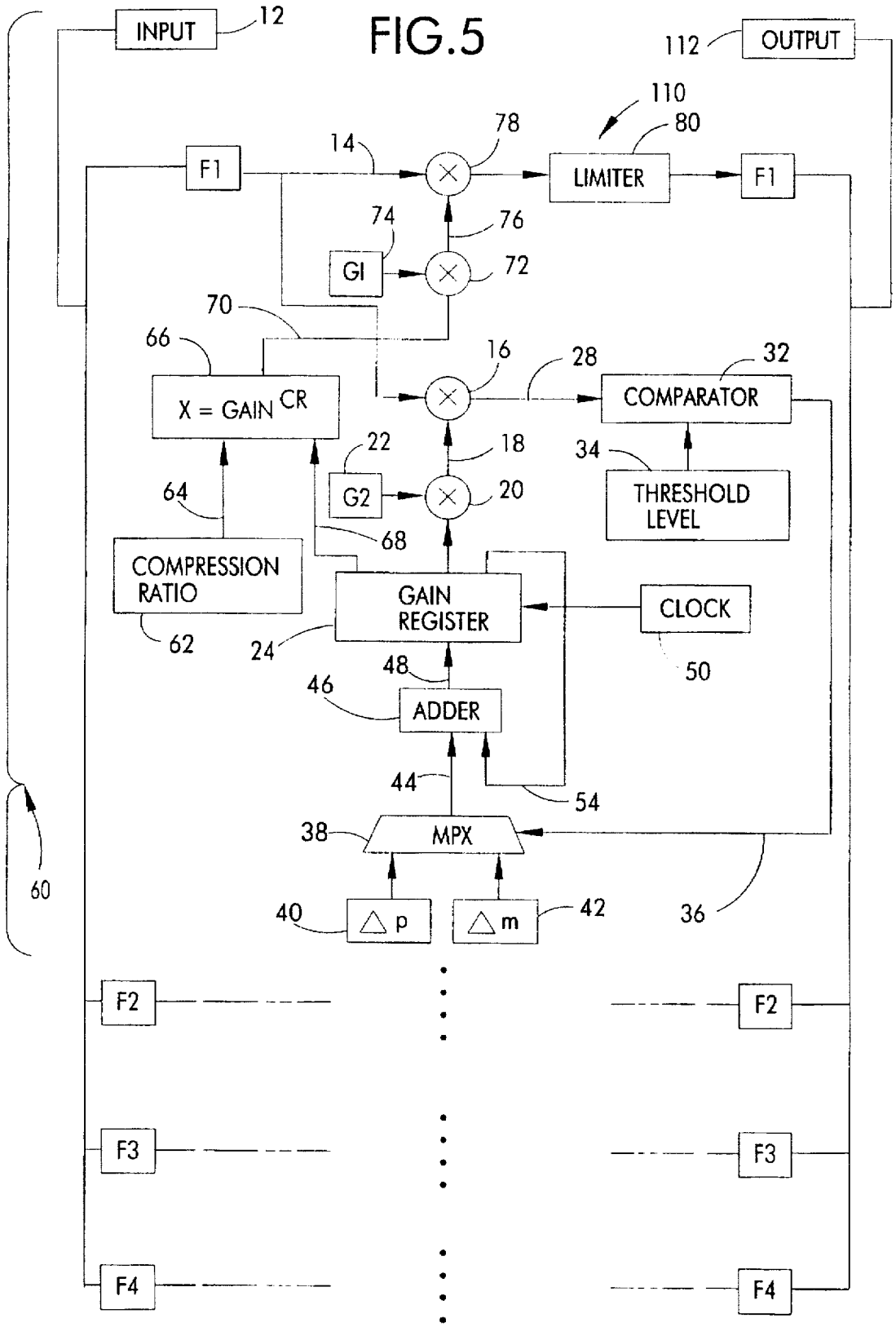
FIG. 5 shows a four channel level dependent spectral shaping circuit wherein the gain in each channel is adaptively compressed with a programmable compression ratio using the circuit of FIG. 2.

FIG. 5 shows a four channel filter/limit/filter circuit 110 wherein each channel incorporates circuit 60 of FIG. 2. An output 112 in FIG. 5 provides a programmably compressed and filtered output signal comprising the sum of the filtered signals at outputs 82 in each of the four channels identified by filters F1 through F4.

The purpose of the adaptive gain factor in each channel of the circuitry of FIGS. 4 and 5 is to maintain a specified constant level of envelope compression over a range of inputs. By using adaptive compressive gain, the input/output function for each channel is programmed to include a linear range for which the signal envelope is unchanged, a higher input range over which the signal envelope is compressed by a specified amount, and the highest input range over which envelope compression increases as the input level increases. This adaptive compressive gain feature adds an important degree of control over mapping a widely dynamic input signal into the reduced auditory range of the impaired ear.

The design of adaptive compressive gain circuitry for a hearing aid presents a number of considerations, such as the wide dynamic range, noise pattern and bandwidth found in naturally occurring sounds. Input sounds present at the microphone of a hearing aid vary from quiet sounds (around 30 dB SPL) to those of a quiet office area (around 50 dB SPL) to much more intense transient sounds that may reach 100 dB SPL or more. Sound levels for speech vary from a casual vocal effort of a talker at three feet distance (55 dB SPL) to that of a talker's own voice which is much closer to the microphone (80 dB SPL). Therefore, long term averages of speech levels present at the microphone vary by 25 dB or more depending on the talker, the distance to the talker, the orientation of the talker and other factors. Speech is also dynamic and varies over the short term. Phoneme intensities vary from those of vowels, which are the loudest sounds, to unvoiced fricatives, which are 12 dB or so less intense, to stops, which are another 18 dB or so less intense. This adds an additional 30 dB of dynamic range required for speaking. Including both long-term and short-term variation, the overall dynamic range required for speech is about 55 dB. If a talker whispers or is at a distance much greater than three feet, then the dynamic range will be even greater.

Electronic circuit noise and processing noise limit the quietest sounds that can be processed. A conventional hearing aid microphone has an equivalent input noise figure of 25 dB SPL, which is close to the estimated 20 dB noise figure of a normal ear. If this noise figure is used as a lower bound on the input dynamic range and 120 dB SPL is used as an upper bound, the input dynamic range of good hearing aid system is about 100 dB. Because the microphone will begin to saturate at 90 to 100 dB SPL, a lesser dynamic range of 75 dB is workable.

Signal bandwidth is another design consideration. Although it is possible to communicate over a system with a bandwidth of 3 kHz or less and it has been determined that 3 kHz carries most of the speech information, hearing aids with greater bandwidth result in better articulation scores. Skinner, M. W. and Miller, J. D., *Amplification Bandwidth and Intelligibility of Speech in Quiet and Noise for Listeners with Sensorineural Hearing Loss,* 22:253–79 *Audiology* (1983). Accordingly, the embodiment disclosed in FIG. 1 has a 6 kHz upper frequency cut-off.

The filter structure is another design consideration. The filters must achieve a high degree of versatility in programming bandwidth and spectral shaping to accommodate a wide range of hearing impairments. Further, it is desirable to use shorter filters to reduce circuit complexity and power consumption. It is also desirable to be able to increase filter gain for frequencies of reduced hearing sensitivity in order to improve signal audibility. However, studies have shown that a balance must be maintained between gain at low frequencies and gain at high frequencies. It is recommended that the gain difference across frequency should be no greater than 30 dB. Skinner, M. W., *Hearing Aid Evaluation*, Prentice Hall (1988). Further, psychometric functions often used to calculate a "prescriptive" filter characteristic are generally smooth, slowly changing functions of frequency that do not require a high degree of frequency resolution to fit.

Within the above considerations, it is preferable to use FIR filters with transition bands of 1000 Hz and out of band rejection of 40 dB. The required filter length is determined from the equation:

$$L=((-20\log_{10}(\sigma)-7.95)/(14.36TB/f_s))+1 \quad (10)$$

In equation (10), L represents the number of filter taps, $\sigma$ represents the maximum error in achieving a target filter characteristic, $-20\log_{10}(\sigma)$ represents the out of band rejection in decimals. TB represents the transition band, and $f_s$ is the sampling rate. See Kaiser, *Nonrecursive Filter Design Using the $I_0$-SINH Window Function, Pros.*, IEEE Int. Symposium on Circuits and Systems (1974). For an out of band rejection figure of 35 dB with a transition band of 1000 Hz and a sampling frequency of 16 kHz, the filter must be approximately 31 taps long. If a lower out of band rejection of 30 dB is acceptable, the filter length is reduced to 25 taps. This range of filter lengths is consistent with the modest filter structure and low power limitations of a hearing aid.

All of the circuits shown in FIGS. 1 through 9 use log encoded data. See the '419 patent. Log encoding is similar to u-law and A-law encoding used in Codecs and has the same advantages of extending the dynamic range, thereby making it possible to reduce the noise floor of the system as compared to linear encoding. Log encoding offers the additional advantage that arithmetic operations are performed directly on the log encoded data. The log encoded data are represented in the hearing aid as a sign and magnitude as follows:

$$x=sgn(y)\log(|y|)/\log(B) \quad (11)$$

In equation (11), B represents the log base, which is positive and close to but less than unity, x represents the log value and y represents the equivalent linear value. A reciprocal relation for y as a function of x follows:

$$y=sgn(x)B^{|x|} \quad (12)$$

If x is represented as sign and an 8-bit magnitude and the log base is 0.941, the range of y is ±1 to $\pm 1.8\times 10^{-7}$. This corresponds to a dynamic range of 134 dB. The general expression for dynamic range as a function of the log base B and the number of bits used to represent the log magnitude value N follows:

$$\text{dynamic range (dB)}=20\log_{10}(B^{(2^N-1)}) \quad (13)$$

An advantage of log encoding over u-law encoding is that arithmetic operations are performed directly on the encoded signal without conversion to another form. The basic FIR filter equation, $y(n)=\Sigma a_i x(n-i)$, is implemented recursively as a succession of add and table lookup operations in the log domain. Multiplication is accomplished by adding the magnitude of the operands and determining the sign of the result. The sign of the result is a simple exclusive-or operation on the sign bits of the operands. Addition (and subtraction) are accomplished in the log domain by operations of subtraction, table lookup, and addition. Therefore, the sequence of operations required to form the partial sum of products of the FIR filter in the log domain are addition, subtraction, table lookup, and addition.

Addition and subtraction in the log domain are implemented by using a table lookup approach with a sparsely populated set of tables $T_+$ and $T_-$ stored in a memory (not shown). Adding two values, x and y, is accomplished by taking the ratio of the smaller magnitude to the larger and adding the value from the log table $T_+$ to the smaller. Subtraction is similar and uses the log table $T_-$. Since x and y are in log units, the ratio, $|y/x|$ (or $|x/y|$), which is used to access the table value, is obtained by subtracting $|x|$ from $|y|$ (or vice-versa). The choice of which of the tables, $T_+$ or $T_-$, to use is determined by an exclusive-or operation on the sign bits of x and y. Whether the table value is added to x or to y is determined by subtracting $|x|$ from $|y|$ and testing the sign bit of the result.

Arithmetic roundoff errors in using log values for multiplication are not significant. With an 8-bit representation, the log magnitude values are restricted to the range 0 to 255. Zero corresponds to the largest possible signal value and 255 to the smallest possible signal value. Log values less than zero cannot occur. Therefore, overflow can only occur for the smallest signal values. Product log values greater than 255 are truncated to 255. This corresponds to a smallest signal value (255 LU's) that is 134 dB smaller than the maximum signal value. Therefore, if the system is scaled by setting the amplifier gains so that 0 LU corresponds to 130 dB SPL, the truncation errors of multiplication (255 LU) correspond to −134 dB relative to the maximum possible signal value (0 LU). In absolute terms, this provides a −4 dB SPL or −43 dB SPL spectrum level, which is well below the normal hearing threshold.

Roundoff errors of addition and subtraction are much more significant. For example, adding two numbers of equal magnitude together results in a table lookup error of 2.4%. Conversely, adding two values that differ by three orders of magnitude results in an error of 0.1%. The two tables, $T_+$ and $T_-$, are sparsely populated. For a log base of 0.941 and table values represented as an 8-bit magnitude, each table contains 57 nonzero values. If it is assumed that the errors are uniformly distributed (that each table value is used equally often on the average), then the overall average error associated with table roundoff is 1.01% for $T_+$ and 1.02% for $T_-$.

Table errors are reduced by using a log base closer to unity and a greater number of bits to represent log magnitude. However, the size of the table grows and quickly becomes impractical to implement. A compromise solution for reducing error is to increase the precision of the table entries without increasing the table size. The number of nonzero entries increases somewhat. Therefore, in implementing the table lookup in the digital processor, two additional bits of precision are added to the table values. This is equivalent to using a temporary log base which is the fourth root of 0.941 (0.985) for calculating the FIR filter summation. The change in log base increases the number of nonzero entries in each of the tables by 22, but reduces the average error by a factor of four. This increases the output SNR of a given filter by 12 dB. The $T_+$ and $T_-$ tables are still sparsely populated and implemented efficiently in VLSI form.

In calculating the FIR equation, the table lookup operation is applied recursively N−1 times, where N is the order of the filter. Therefore, the total error that results is greater than the average table roundoff error and a function of filter order. If it is assumed that the errors are uniformly distributed and that the input signal is white, the expression for signal to roundoff noise ratio follows:

$$\epsilon_y^2\sigma_y^2=\epsilon^2(c_1^2+2c_2^2+\ldots+(N-1)c_N2)/(c_1^2+c_2^2+\ldots+c_N^2) \quad (14)$$

In equation (14) $\epsilon_y^2$ represents the noise variance at the output of the filter $\sigma_y^2$ represents the signal variance at the output of the filter, and $\epsilon$ represents the average percent table error. Accordingly, the filter noise is dependent on the table lookup error, the magnitude of the filter coefficients, and the order of summation. The coefficient used first introduces an error that is multiplied by N−1. The coefficient used second introduces an error that is multiplied by N−2 and so on. Since the error is proportional to coefficient magnitude and order of summation, it is possible to minimize the overall error by ordering the smallest coefficients earliest in the calculation. Since the end tap values for symmetric filters are generally smaller than the center tap value, the error was further reduced by calculating partial sums using coefficients from the outside toward the inside.

In FIGS. 4 and 5, FIR filters F1 through F4 represent channel filters which are divided into two cascaded parts. Limiters 26 and 80 are implemented as part of the log multiply operation. $G_1$ is a gain factor that, in the log domain, is subtracted from the samples at the output of the first FIR filter. If the sum of the magnitudes is less than zero (maximum signal value), it is clipped to zero. $G_2$ represents an attenuation factor that is added (in the log domain) to the clipped samples. $G_2$ is used to set the maximum output level of the channel.

Log quantizing noise is a constant percentage of signal level except for low input levels that are near the smallest quantizing steps of the encoder. Assuming a Laplacian signal distribution, the signal to quantizing noise ratio is given by the following equation:

$$SNR(\text{dB})=10\log_{10}(12)-20\log_{10}(|\ln(B)|) \quad (15)$$

For a log base of 0.941, the SNR is 35 dB. The quantizing noise is white and, since equation (15) represents the total noise energy over a bandwidth of 8 kHz, the spectrum level is 39 dB less or 74 dB smaller than the signal level. The ear inherently masks the quantizing noise at this spectrum level. Schroeder, et al., *Optimizing Digital Speech Coders by Exploiting Masking Properties of the Human Ear*, Vol. 66(6) J. Acous. Soc. Am. pp.1647–52 (December 1979). Thus, log encoding is ideally suited for auditory signal processing. It provides a wide dynamic range that encompasses the range of levels of naturally occurring signals, provides sufficient SNR that is consistent with the limitation of the ear to resolve small signals in the presence of large signals, and provides a significant savings with regard to hardware.

The goal of the fitting system is to program the digital hearing aid to achieve a target real-ear gain. The real-ear gain is the difference between the real-ear-aided-response (REAR) and the real-ear-unaided-response (REUR) as measured with and without the hearing aid on the patient. It is assumed that the target gain is specified by the audiologist or calculated from one of a variety of prescriptive formulae chosen by the audiologist that is based on audiometric measures. There is not a general consensus about which prescription is best. However, prescriptive formulae are generally quite simple and easy to implement on a small host computer. Various prescriptive fitting methods are discussed in Chapter 6 of Skinner, M. W., *Hearing Aid Evaluation*, Prentice Hall (1988).

Assuming that a target real-ear gain has been specified, the following strategy is used to automatically fit the four channel digital hearing aid where each channel is programmed as a band pass filter which is contiguous with adjacent channels. The real-ear measurement system disclosed in U.S. Pat. No. 4,548,082 (hereinafter "the '082 patent") and incorporated herein by reference is used. First, the patient's REUR is measured to determine the patient's normal, unoccluded ear canal resonance. Then the hearing aid is placed on the patient. Second, the receiver and earmold are calibrated. This is done by setting G2 of each channel to maximum attenuation (−134 dB) and turning on the noise generator of the adaptive feedback equalization circuit shown in the '082 patent. This drives the output of the hearing aid with a flat-spectrum-level, pseudorandom noise sequence. The noise in the ear canal is then deconvolved with the pseudorandom sequence to obtain a measure of the output transfer characteristic ($H_r$) of the hearing aid. Third, the microphone is calibrated. This is done by setting the channels to a flat nominal gain of 20 dB. The cross-correlation of the sound in the ear canal with the reference sound then represents the overall transfer characteristic of the hearing aid and includes the occlusion of sound by the earmold. The microphone calibration (Hm) is computed by subtracting $H_r$ from this measurement. Last, the channel gain functions are specified and filter coefficients are computed using a window design method. See Rabiner and Schafer, *Digital Processing of Speech Signals*, Prentice Hall (1978). The coefficients are then downloaded in bit-serial order to the coefficient registers of the processor. The coefficient registers are connected together as a single serial shift register for the purpose of downloading and uploading values.

The channel gains are derived as follows. The acoustic gain for each channel of the hearing aid is given by:

$$\text{Gain}=H_m+H_r+H_n+G_{1n}+G_{2n} \quad (16)$$

The filter shape for each channel is determined by setting the Gain in equation (16) to the desired real-ear gain plus the open-ear resonance. Since $G_{1n}$ and $G_{2n}$ are gain constants for the channel and independent of frequency, they do not enter into the calculation at this point. The normalized filter characteristics is determined from the following equation.

$$Hn=0.5\ (\text{Desired Real-ear gain+open ear cal}-H_m-H_r+G_n) \quad (17)$$

$H_m$ and $H_r$ represent the microphone and receiver calibration measures, respectively, that were determined for the patient with the real ear measurement system and $G_n$ represents a normalization gain factor for the filter that is included in the computation of $G_{1n}$ and $G_{2n}$. $H_m$ and $H_r$ include the transducer transfer characteristics in addition to the frequency response of the amplifier and any signal conditioning filters.

Once $H_n$ is determined, the maximum output of each channels which is limited by L, are represented by $G_{2n}$ as follows:

$$G_{2n}=MPO_n-L-\text{avg}(H_n+H_r)-G_n \quad (18)$$

In equation (18), the "avg" operator gives the average of filter gain and receiver sensitivity at filter design frequencies within the channel. L represents a fixed level for all channels such that signals falling outside the range ±L are peak-clipped at ±L. $G_n$ represents the filter normalization gain, and $MPO_n$ represents the target maximum power output. Overall gain is then established by setting $G_{1n}$ as follows:

$$G_{1n}=2G_n-G_{2n} \quad (19)$$

$G_n$ represents the gain normalization factor of the filters that were designed to provide the desired linear gain for the channel.

By using the above approach, target gains typically are realized to within 3 dB over a frequency range of from 100 Hz to 6000 Hz. The error between the step-wise approximation to the MPO function and the target MPO function is also small and is minimized by choosing appropriate cross-over frequencies for the four channels.

Because the channel filters are arbitrarily specified, an alternative fitting strategy is to prescribe different frequency-gain shapes for signals of different levels. By choosing appropriate limit levels in each channel, a transition from the characteristics of one channel to the characteristics of the next channel will occur automatically as a function of signal level. For example, a transparent or low-gain function is used for high-level signals and a higher-gain function is used for low-level signals. The adaptive gain feature in each channel provides a means for controlling the transition from one channel characteristic to the next. Because of recruitment and the way the impaired ear works, the gain functions are generally ordered from highest gain for soft sounds to the lowest gain for loud sounds. With respect to circuit 100 of FIG. 4, this is accomplished by setting G1 in gain register 22 very high for the channel with the highest gain for the soft sounds. The settings for G1 in gain registers 22 of the next succeeding channels are sequentially decreased, with the G1 setting being unity in the last channel which channel has the lowest gain for loud sounds. A similar strategy is used for circuit 110 of FIG. 5, except that G1 must be set in both gain registers 22 and 74. In this way, the channel gain settings in circuits 100 and 110 of FIGS. 4 and 5 are sequentially modified from first to last as a function of the level of input 12.

The fitting method is similar to that described above for the four-channel fitting strategy. Real-ear measurements are used to calibrate the ear, receivers and microphone. However, the filters are designed differently. One of the channels is set to the lowest gain function and highest ACG threshold. Another channel is set to a higher-gain function, which adds to the lower-gain function and dominates the spectral shaping at signal levels below a lower ACG threshold setting for that channel. The remaining two channels are set to provide further gain contributions at successively lower signal levels. Since the channel filters are symmetric and equal length, the gains will add in the linear sense. Two channels set to the same gain function will provide 6 dB more gain than either channel alone. Therefore, the channels filters are designed as follows:

$$H_1=\tfrac{1}{2}D_1 \quad (20)$$

$$H_2=\tfrac{1}{2}\log_{10}(10^{D2}-10^{D1}) \quad (21)$$

$$H_3=\tfrac{1}{2}\log_{10}(10^{D3}-10^{D2}-10^{D1}) \quad (22)$$

$$H_4=\tfrac{1}{2}\log_{10}(10^{D4}-10^{D3}-10^{D2}-10^{D1}) \quad (23)$$

where: $D_1<D_2<D_3<D_4$. $D_n$ represents the filter design target in decibels that gives the desired insertion gain for the hearing aid and is derived from the desired gains specified by the audiologist and corrected for ear canal resonance and receiver and microphone calibrations as described previously for the four-channel fit. The factor, ½, in the above expressions takes into account that each channel has two filters in cascade.

The processor described above has been implemented in custom VLSI form. When operated at 5 volts and at a 16-kHz sampling rate, it consumes 4.6 mA. When operated at 3 volts and at the same sampling rate, it consumes 2.8 mA. When the circuit is implemented in a low-voltage form, it is expected to consume less than 1 mA when operated from a hearing aid battery. The processor has been incorporated into a bench-top prototype version of the digital hearing aid. Results of fitting hearing-impaired subjects with this system suggest that prescriptive frequency gain functions are achieved within 3 dB accuracy at the same time that the desired MPO frequency function is achieved within 5 dB or so of accuracy.

Figure 6:
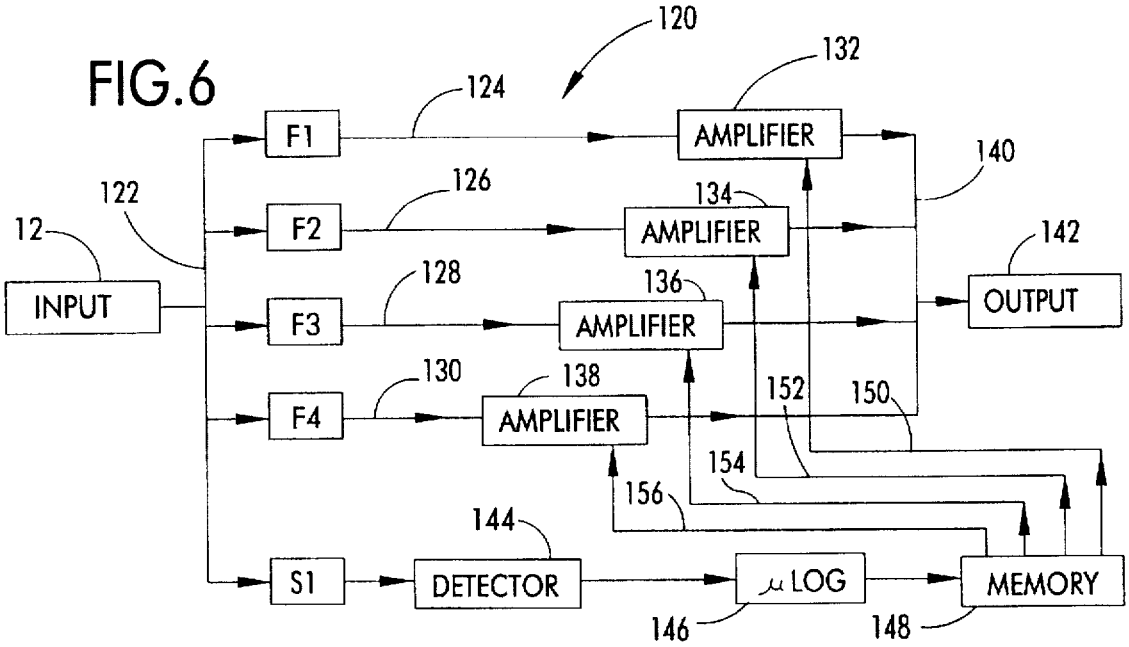
FIG. 6 shows a four channel level dependant spectral shaping circuit wherein the gain in each channel is adaptively varied with a level detector and a memory.

For those applications that do not afford the computational resources required to implement the circuitry of FIGS. 1 through 5, the simplified circuitry of FIGS. 6 through 9 is used. In FIG. 6, a circuit 120 includes an input 12 which represents any conventional source of an input signal such as a microphone, signal processor, or the like. Input 12 also includes an analog to digital converter (not shown) for analog input signals if circuit 120 is implemented with digital components. Likewise, input 12 includes a digital to analog converter (not shown) for digital input signals if circuit 120 is implemented with analog components.

Input 12 is connected to a group of filters F1 through F4 and a filter S1 over a line 122. Filters F1 through F4 provide separate channels with filter parameters preset as described above for the multichannel circuits of FIGS. 4 and 5. Each of filters F1, F2, F3 and F4 outputs an adaptively filtered signal via a line 124, 126, 128 and 130 which is amplified by a respective amplifier 132, 134, 136 and 138. Amplifiers 132 through 138 each provide a channel output signal which is combined by a line 140 to provide an adaptively filtered signal at an output 142 of circuit 120.

Filter S1 has parameters which are set to extract relevant signal characteristics present in the input signal. The output of filter S1 is received by an envelope detector 144 which detects said characteristics. Detector 144 preferably has a programmable time constant for varying the relevant period of detection. When detector 144 is implemented in analog form, it includes a full wave rectifier and a resistor/capacitor circuit (not shown). The resistor, the capacitor, or both, are variable for programming the time constant of detector 144. When detector 144 is implemented in digital form, it includes an exponentially shaped filter with a programmable time constant. In either event, the "on" time constant is shorter than the relatively long "off" time constant to prevent excessively loud sounds from existing in the output signal for extended periods.

The output of detector 144 is a control signal which is transformed to log encoded data by a log transformer 146 using standard techniques and as more fully described above. The log encoded data represents the extracted signal characteristics present in the signal at input 12. A memory 148 stores a table of signal characteristic values and related amplifier gain values in log form. Memory 148 receives the log encoded data from log transformer 146 and, in response thereto, recalls a gain value for each of amplifiers 132, 134, 136 and 138 as a function of the log value produced by log transformer 146. Memory 148 outputs the gain values via a set of lines 150, 152,154 and 156 to amplifiers 132, 134, 136 and 138 for setting the gains of the amplifiers as a function of the gain values. Arbitrary overall gain control functions and blending of signals from each signal processing channel are implemented by changing the entries in memory 148.

In use, circuit 120 of FIG. 6 may include a greater or lesser number of filtered channels than the four shown in FIG. 6. Further, circuit 120 may include additional filters, detectors and log transformers corresponding to filter S1, detector 144 and log transformer 146 for providing additional input signal characteristics to memory 148o Still further, any or all of the filtered signals in lines 124, 126, 128 or 130 could be used by a detector(s), such as detector 144, for detecting an input signal characteristic for use by memory 148.

Figure 7:
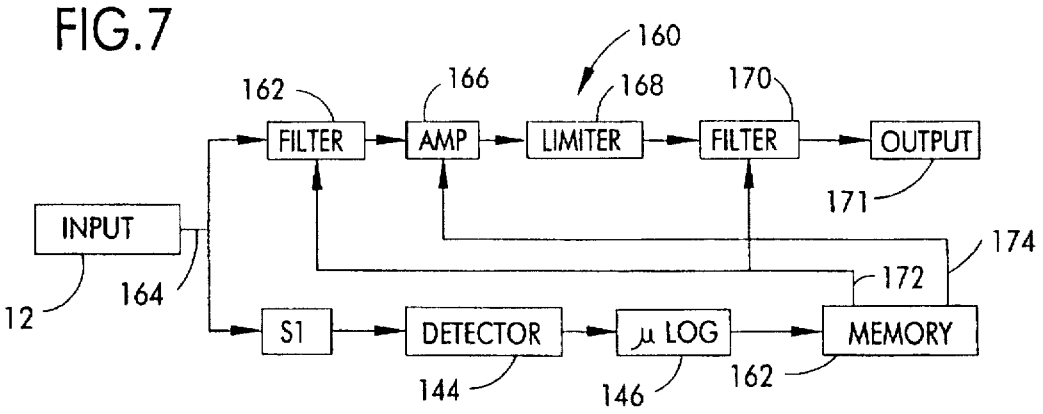
FIG. 7 shows a level dependant spectral shaping circuit wherein the gain of the amplifier and the parameters of the filters are adaptively varied with a level detector and a memory.

FIG. 7 includes input 12 for supplying an input signal to a circuit 160. Input 12 is connected to a variable filter 162 and to a filter S1 via a line 164. Variable filter 162 provides an adaptively filtered signal which is amplified by an amplifier 166. A limiter 168 peak clips the adaptively filtered output signal of amplifier 166 to produce a limited output signal which is filtered by a variable filter 170. The adaptively filtered and clipped output signal of variable filter 170 is provided at output 171 of circuit 160.

Filter S1, a detector 144 and a log transformer 146 in FIG. 7 perform similar functions to the like numbered components found in FIG. 6. A memory 162 stores a table of signal characteristic values, related filter parameters, and related amplifier gain values in log form. Memory 162 responds to the output from log transformer 146 by recalling filter parameters and an amplifier gain value as functions of the log value produced by log transformer 146. Memory 162 outputs the recalled filter parameters via a line 172 and the recalled gain value via a line 174. Filters 162 and 170 receive said filter parameters via line 172 for setting the parameters of filters 162 and 170. Amplifier 166 receives said gain value via line 174 for setting the gain of amplifier 166. The filter coefficients are stored in memory 162 in sequential order of input signal level to control the selection of filter coefficients as a function of input level. Filters 162 and 170 are preferably FIR filters of the same construction and length and are set to the same parameters by memory 162. In operation, the circuit 160 is also used by taking the output signal from the output of amplifier 166 to achieve desirable results. Limiter 168 and variable filter 170 are shown, however, to illustrate the filter/limit/filter structure disclosed in the '419 patent in combination with the pair of variable filters 162 and 170.

With a suitable choice of filter coefficients, a variety of level dependent filtering is achieved. When memory 162 is a random-access memory, the filter coefficients are tailored to the patient's hearing impairment and stored in the memory from a host computer during the fitting session. The use of the host computer is more fully explained in the '082 patent.

Figure 8:
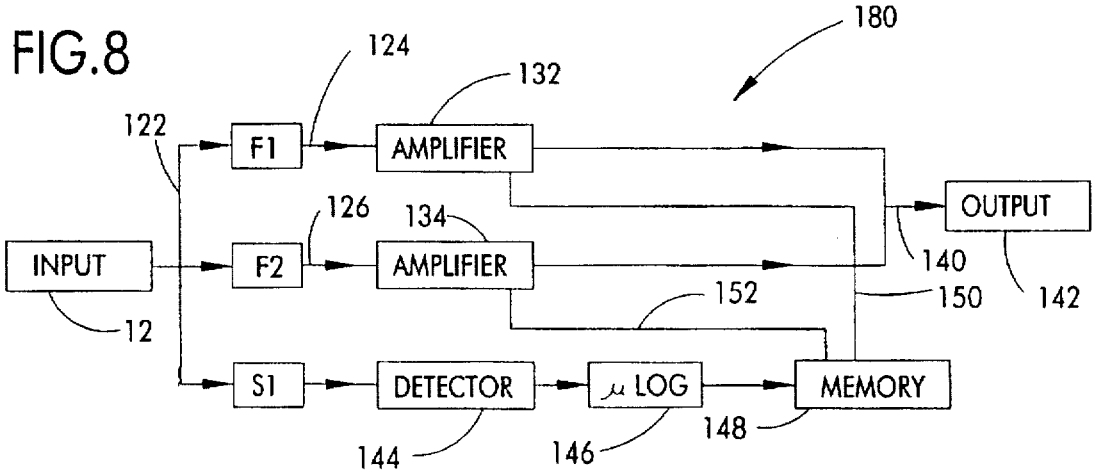
FIG. 8 shows a two channel version of the four channel circuit shown in FIG. 6.

A two channel version of circuit 120 in FIG. 6 is shown in FIG. 8 as circuit 180. Like components of the circuits in FIGS. 6 and 8 are identified with the same reference numerals. A host computer (such as the host computer disclosed in the '082 patent) is used for calculating the F1 and F2 filter coefficients for various spectral shaping, for calculating entries in memory 148 for various gain functions and blending functions, and for down-loading the values to the hearing aid.

Figure 9:
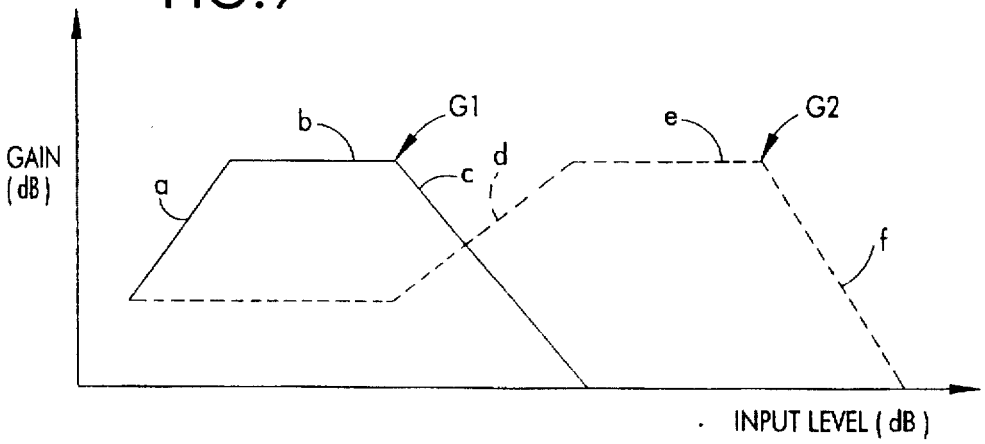
FIG. 9 shows the output curves for the control lines leading from the memory of FIG. 8 for controlling the amplifiers of FIG. 8.

The gain function for each channel is shown in FIG. 9. A segment "a" of a curve G1 provides a "voice switch" characteristic at low signal levels. A segment "b" provides a linear gain characteristic with a spectral characteristic determined by filter F1 in FIG. 8. A segment "c" and "d" provide a transition between the characteristics of filters F1 and F2. A segment "e" represents a linear gain characteristic with a spectral characteristic determined by filter F2. Lastly, segment "f" corresponds to a region over which the level of output 142 is constant and independent of the level of input 12.

The G1 and G2 functions are stored in a random access memory such as memory 148 in FIG. 8. The data stored in memory 148 is based on the specific hearing impairment of the patient. The data is derived from an appropriate algorithm in the host computer and down-loaded to the hearing aid model during the fitting session. The coefficients for filters F1 and F2 are derived from the patients residual hearing characteristic as follows: Filter F2, which determines the spectral shaping for loud sounds, is designed to match the patients UCL function. Filter F1, which determines the spectral shaping for softer sounds, is designed to match the patients MCL or threshold functions. One of a number of suitable filter design methods are used to compute the filter coefficient values that correspond to the desired spectral characteristic.

A Kaiser window filter design method is preferable for this application. Once the desired spectral shape is established, the filter coefficients are determined from the following equation:

$$Cn=\Sigma A_k(\cos(2\pi nf_k/f_s))W_n \tag{24}$$

In equation (24), $C_n$ represents the n'th filter coefficient, $A_k$ represents samples of the desired spectral shape at frequencies $f_k$, $f_s$ represents the sampling frequency and $W_n$ represents samples of the Kaiser Window. The spectral sample points, $A_k$, are spaced at frequencies, $f_k$, which are separated by the 6 dB bandwidth of the window, $W_n$, so that a relatively smooth filter characteristic results that passes through each of the sample values. The frequency resolution and maximum slope of the frequency response of the resulting filter is determined by the number of coefficients or length of the filter. In the implementation shown in FIG. 8, filters F1 and F2 have a length of 30 taps which, at a sampling rate of 12.5 kHz, gives a frequency resolution of about 700 Hz and a maximum spectral slope of 0.04 dB/Hz.

Circuit 180 of FIG. 8 simplifies the fitting process. Through a suitable interactive display on a host computer (not shown), each spectral sample value $A_k$ is independently selected. While wearing a hearing aid which includes circuit 180 in a sound field, such as speech weighted noise at a given level, the patient adjusts each sample value $A_k$ to a preferred setting for listening. The patient also adjusts filter F2 to a preferred shape that is comfortable only for loud sounds.

Appendix A contains a program written for a Macintosh host computer for setting channel gain and limit values in a four channel contiguous band hearing aid. The filter coefficients for the bands are read from a file stored on the disk in the Macintosh computer. An interactive graphics display is used to adjust the filter and gain values.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

Program WDHA

Wearable Digital Hearing Aid Control Program V. 1.0

Central Institute For The Deaf
818 South Euclid Ave.
St. Louis Mo. 63110
Phone: 314-652-3200

Supported in part by:
The Rehabilitation Research And Development Service
Dept. of Medicine and Surgery: Veterans Administration

General Overview

A program entitled "WDHA" has been written for the Macintosh personal computer. When a wearable digital hearing aid is attached to the Macintosh's SCSI bus peripheral interface, the user of the WDHA program can alter the operation of the hearing aid via an easy to use Macintosh style user interface.

Using the WDHA Program

Starting The Program

Upon starting the program, the Macintosh interrogates the hearing aid to determine which program it is running. If the hearing aid responds appropriately, a menu containing the options which apply to that particular program appears in the menu bar. If no response is received from the hearing aid, the menu entitled "WDHA Disconnected" appears in the menu bar, as follows:

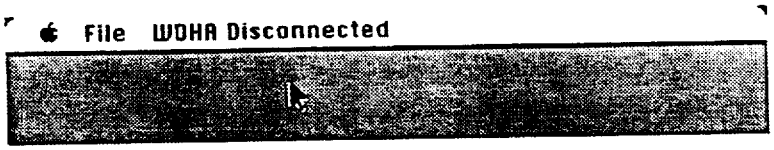

Should this menu appear, this indicates that there is some problem with the hearing aid. The source of this problem could be that the hearing aid is truly disconnected, that it is simply turned off, or that the hearing aid battery is dead. Upon correcting the problem, choose the "New WDHA Program" menu entry to activate the proper menu for the hearing aid.

The Aid Parameters Window

The four channel hearing aid programs have the titles Aid12 through Aid14. Choosing the "Aid Parameters" menu entry will cause the aid parameters window to be displayed, as follows:

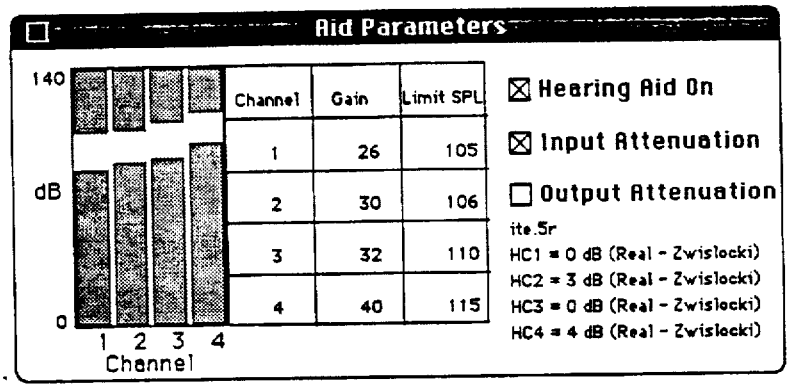

The bar graph and chart depict the current settings of the gains and limits for each channel of the hearing aid. A gain or limit setting can be changed by dragging the appropriate bar up or down with the mouse. The selected bar will blink when it is activated, and can be moved until the mouse is released, at which point the hearing aid is updated with the new values.

The control buttons indicate whether the hearing aid is on or off (i.e. whether the hearing aid program is running), and whether the input or output attenuators are switched on or off. Any of these settings can be changed simply by clicking on the appropriate buttons.

Ear Module Calibration

The File menu has an option called "Calibrate Ear Module" which should be used whenever the program is started or an ear module is inserted (or re-inserted) in a patient's ear. Proper use of this option insures that the gains actually generated by the hearing aid are as close to the gains indicated by the program as possible.

The lower right hand corner of the Aid Parameters window displays the results of the most recent ear module calibration, including the name of the calibration file and the four Hc values, where Hc is the difference between the real ear pressure measured in the ear canal and the standard pressure measured on a Zwislocki at the center frequency of each channel. After choosing this option the user must open the file containing the ear module coefficients, by double clicking on the file's name, via a standard Macintosh dialog box:

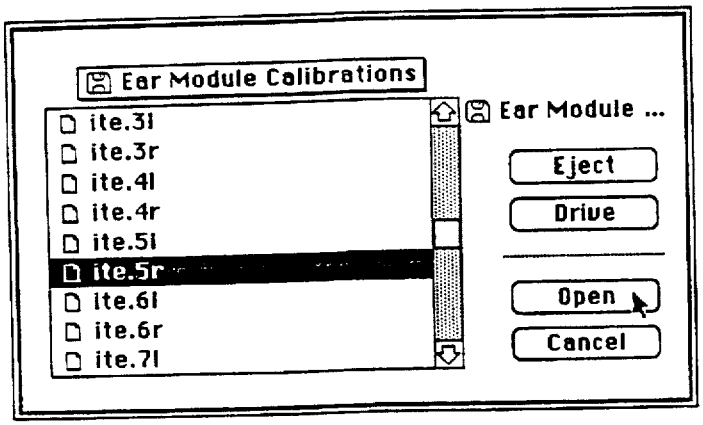

The program will then play a series of four tones in the patient's ear, using the power measurement to determine the real pressure in the ear canal.

The file containing the ear module coefficients should be created with a text editor and saved as a text-only file. The file contains all the H values for a given ear module, seperated by tabs, spaces, or carriage returns. It should begin with the four He values, followed by the Hr values, then Hc, and then Hp. The values entered for the Hc values can be arbitrary, since the program calculates them and stores them into the file. An ear module file as you would enter it might look as follows:

-100 -85 -90 -84 121 116 127 120
0
0

0
0
-124 -121 -134 -143

Here the first row contains both the four He values and the four Hr values. Following this are four zeros (since the Hc values are unknown). The sixth row contains the Hp values. Note that values are arbitrarily seperated by tabs, spaces, or carriage returns.

After doing an ear module calibration with the program, the new Hc values are displayed in the Aid Settings window, and also written to the same file, with the data re-formatted into a seperate row for each H value, as follows:

-100 -85 -90 -84
121 116 127 120
-5 -4 -10 0
-124 -121 -134 -143

The Tone Parameters Window

The four channel programs also have the ability to play pure tones for audiometric purposes. The Tone Parameters window is available to activate these functions. Choosing the "Tone Parameters" menu entry will cause the Tone Parameters window to be displayed, as follows:

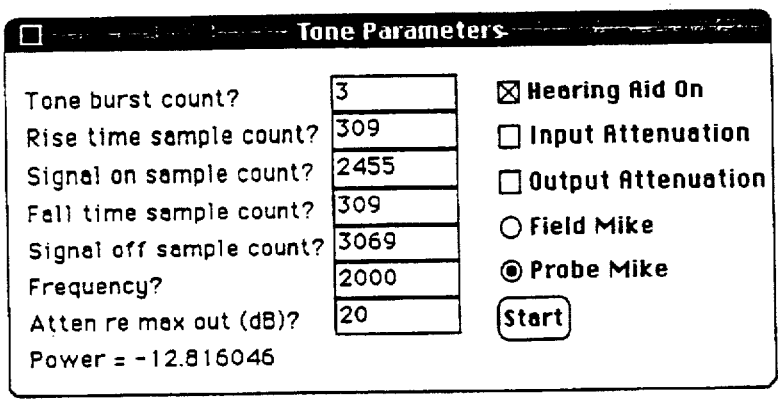

The text boxes specify the number of tone bursts to generate and the envelope of the tone bursts generated, as follows:

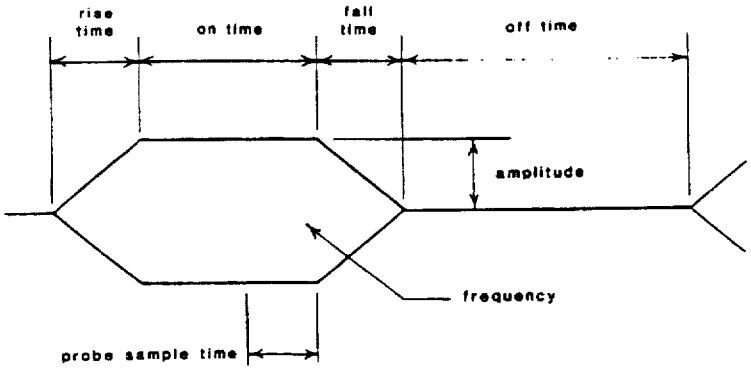

All times are specified in number of sample periods, and cannot exceed 32767 sample periods. The test is initiated by clicking on the start button. The control buttons act just as in the aid parameters window.

. Loading Filter Taps

The programs titled Aid13 and Aid14 have the capability to download filter tap coefficients to the hearing aid. The coefficients are read into memory from a text file which the user creates with any standard text editor. The coefficients in these files are signed integers such as "797" or "-174" (optionally be followed by a divisor, such as in "-12028/2") and must be seperated by spaces, tabs, or carriage returns.

The Aid13 program has 32 taps per filter, and the Aid14 program has 31 taps per filter, but since the filters are symmetric about the center tap you only provide half this number of taps, or16 taps per filter. Thus the files contain 64 coefficients for the 4 channels. For example, the file titled TapsFour has the following format:

-535/4 -431/4 -254/4 0 333/4 743/4 1220/4 1750/4
2315/4 2892/4 3545/4 3977/4 4432/4 4797/4 5052/4 5183/4
-34/2 -231/2 -223/2 0 292/2 398/2 77/2 -745/2
-1873/2 -2869/2 -3212/2 -2535/2 -831/2 1483/2 3683/2 5021/2
-83/2 502/2 859/2 0 -1128/2 -866/2 189/2 128/2
-442/2 890/2 3076/2 1605/2 -3814/2 -6280/2 -922/2 6543/2

528/2 -167/2 -446/2 0 585/2 288/2 -1203/2 242/2
442/2 1525/2 -2946/2 797/2 -174/2 6280/2 -12028/2 6482/2

The option to download coefficients is enabled by choosing the "Tap Filter Load" menu entries. The Macintosh will then present the standard open file dialog box, which you use to specify the name of the appropriate text file.

Program Design

The program is written in 68000 Assembly Language using the Macintosh Development System assembler, from Apple.

The program has been structured into seperate managers for each of the program's functions. A seperate file contains the functions associated with each manager. For example, the Parameter Settings (or "PS") manager is contained in the file WDHAPS.Asm, and includes all routines associated with the Aid Parameters window.

Below is a description of each manager, it's function, and the routines contained in each.

WDHA.Asm

The overall program structure is typical of a Macintosh application in that it has an event loop which dequeues events from the event queue, and then branches to code which processes each particular type of event. WDHA.Asm contains the WDHA program's event loop.

WDHAPS.Asm

The Parameter Settings ("PS") manager contains all routines associated with the Aid Parameters window, which allows the user to control the gains and limits of each of the channels in the four channel programs. Specifically, these routines are as follows:

WDHAPSOpen - Create and display the Aid Parameters window.
WDHAPSClose - Close the Aid Parameters window and dispose the memory associated with it.
WDHAPSShow - Make the Aid Parameters window visible.
WDHAPSHide - Make the Aid Parameters window invisible.
WDHAPSDraw - Update the contents of the Aid Parameters window.

WDHAPSControl - Cause the appropriate modification of the Aid Parameters window when a mousedown event occurs within it's content region.

WDHAPSIS - Given a window pointer, this routine determines if it is the Aid Parameters window or not.

WDHAPSSetParam - Update the hearing aid to contain the settings specified in the Aid Parameters window.

WDHATC.Asm

The TC manager contains all routines associated with the Tone Parameters window, which allows the user to specify the parameters for the test/calibrate function of the four channel program, and initiate the test. Specifically, these routines are as follows:

WDHATCOpen - Create and display the Tone Parameters window.

WDHATCClose - Close the Tone Parameters window and dispose the memory associated with it.

WDHATCShow - Make the Tone Parameters window visible.

WDHATCHide - Make the Tone Parameters window invisible.

WDHATCDraw - Update the contents of the Tone Parameters window.

WDHATCControl - Cause the appropriate modification of the Tone Parameters window when a mousedown event occurs within it's content region.

WDHATCIS - Given a window pointer, this routine determines if it is the Tone Parameters window or not.

WDHATCIdle - Blink the text caret of the Tone Parameters window.

WDHATCKey - Insert a key press into the active text box of the Tone Parameters window.

WDHATCDoTest - Initiate a test by the hearing aid program, using the parameters specified by the Tone Parameters window.

EarModuleCalibrate - Compute the Hc values for each of the four channels (this routine uses the test/calibrate function of the hearing aid to figure the real ear pressure at the center frequency of each channel).

WDHASCSI.Asm

The SCSI manager contains all routines which send record structures to the hearing aid via the SCSI bus.

SetParam - Send the four channel parameter record (containing the gains and limits) to the four channel hearing aid program.

SetCoefficients - Send out the filter tap coefficients to the four channel hearing aid program.

SetFileParams - Send the parameters required by the spectral shaping program.

wdhatest - Initiate a pure tone test by sending the test/calibrate record to the hearing aid.

WDHAFC.Asm

The WDHA program accesses some numerical values it needs by reading them in from text files. The File Coefficients (FC) manager contains routines which access these text files.

WDHAFCSet - This routine is called when the user selects the "Load Filter Taps" menu option. It uses the SFGetFile dialog to get the name of a text file containing filter coefficients, convert the contents to integer form, and then downloads them to the hearing aid.

WDHASetFileParams - This routine is used to download parameters to the Spectral Shaping hearing aid program. It uses the SFGetFile dialog to get the name of a text file containing the spectral shaping parameters, converts the contents to integer form, then downloads them to the hearing aid.

WDHACalEarModFile - This routine is called when the user calibrates the ear module. It uses the SFGetFile dialog to get the name of a text file containing ear module H Tables, and converts it's contents to integer form in memory. Then it calibrates the ear module using the TC manager function EarModuleCalibrate. Finally, it writes the new H Tables over the same file.

WDHAMenu.Asm

The Menu manager contains all routines associated with the WDHA program's menu bar.

MakeMenus - Create the Menu bar containing the accessory, file, and hearing aid menus, and display it on the screen.

MenuBar - When the main event loop gets a mouseDown event located in the menu Bar, this routine calls the appropriate code to handle the selection.

SetProgMenu - This routine interrogates the hearing aid to determine which program it is currently running, then places the appropriate menu in the menu bar.

Programmer's Note -

As explained earlier, the WDHA program has seperate pulldown menus defined for each program which runs on the hearing aid, giving the options available for that particular program. It is not difficult to add a new menu to the hearing aid program. The following example shows the steps one would follow to add a new aid menu (in this case 'Aid17') to the menu bar.

First of all, the constants needed for the menu must be defined with equate statements. You must define the code returned by the aid program when it is interrogated by the Macintosh, the identifier for the menu itself (as required by the NewMenu toolbox function), and the offset within the menu handles declarations where this handle will reside (the handles are defined in a sequential block of memory near the end of the Menu.Asm file).

```
Aid17ID     equu  -17   ; aid program id returned by interrogating the
aid.
Aid17Menu   equ   17    ; Unique menu identifier
menuaid17 equ 40        ; 10*4=menuhandle offset (this is the tenth
handle)
```

Next you would declare the location to store the menu's handle at the end of the menu handles declarations:

```
dc.l  0          ; Aid17 menu handle
```

Next one would add code to the MakeMenus routine to create the new menu (simply cut and paste the code which creates one of the current menus and modify it accordingly).

You would also modify the SetProgMenu routine to handle the new menu (once again simply replicate the code sections which handle one of the old menus, and change the menu names appropriately).

Finally, you would modify the MenuBar routine to handle your new menu. If all the options contained in your menu are also in the other hearing aid menus, you can call the InAidMenu procedure (as the other menus do), otherwise you must define your own procedure to call.

WDHADisk.Asm

The disk manager contains routines used to access disk files on the Macintosh.

DiskCreate - Create a new file.
DiskRead - Read sectors from a file.
DiskWrite - Write sectors to a file.
DiskEject - Eject a disk.
DiskOpen - Open a file.
DiskClose - Close a file
DiskSetFPos - Set the position of a file's read/write mark.
DiskSetEOF - Set the location of the end of file marker for a file.
DiskSetFInfo - Set the finder information for a file.

```
Include MacTraps.D
Include ToolEquX.D
Include SysEquX.D
Include QuickEquX.D
Include MDS2:WDHAPS.hdr
Include MDS2:WDHATC.hdr
Include MDS2:WDHAMenu.hdr

;-----------------------------------------------------------------------
; WDHA program
;       This program controls several Macintosh windows which allow the user to
; manipulate the digital hearing aid.  The Macintosh communicates with the aid
; by sending records via the SCSI port.
;       This particular file is a "standard" Macintosh style event loop
; which dequeues each event and calls the appropriate routine to handle the event.
;       Additional files contain routines associated with each control window.
; Executing the program should provide an overall understanding of the function
; of these windows.  Specifically, the packages used are:
;
;       The WDHA Paramater Settings Window Manager - in WDHAPS.Asm
;       The WDHA Test/Calibrate Window Manager - in WDHATC.Asm
;
;       In addition, the following files contain various utility routines:
;
;       WDHAMenu.Asm - sets up the menus
;       WDHASCSI.Asm - low level routines for communicating through the SCSI bus.
;       WDHAFC.Asm - contains high-level routines for downloading coefficient
;               files to the hearing aid.
;       WDHADisk.Asm - routines for doing disk access.
;
;   --------------------External   Definitions-----------------------------------

        XDEF    Start
        XDEF    EventLoop
        XDEF    Update
        XDEF    What
        XDEF    When
        XDEF    EventRecord
        XDEF    WWindow
        XDEF    Message
        XDEF    Where
        XDEF    Modify

;   --------------------  Constant   Definitions  ---------------------------------

ActiveBit       equ     0               ;Bit position of de/activate in modify

;---------------------  Code   Starts   Here  -------------------------------------
Start:
        bsr     InitManagers            ; Initialize ToolBox
        bsr     WDHAPSOpen              ; Create the parameter settings window.
        bsr     WDHAPSHide              ; Don't leave it open though.
        bsr     WDHATCOpen              ; Create the test/calibrate window.
        bsr     WDHATCHide              ; Don't leave it open though.
```

```
        bsr     MakeMenus               ; Set up the menus
EventLoop:
        _SystemTask                     ; Give System some time
        bsr     WDHATCIdle              ; Blink the test window's caret
; FUNCTION      GetNextEvent(eventMask: INTEGER;
;               VAR theEvent: EventRecord) : BOOLEAN
        CLR             -(SP)           ; Clear space for result
        MOVE            #$0FFF,-(SP)    ; Allow 12 low events
        PEA             EventRecord     ; Place to return results
        _GetNextEvent                   ; Look for an event
        MOVE            (SP)+,D0        ; Get result code
        BEQ             EventLoop       ; No event... Keep waiting
        BSR             HandleEvent     ; Go handle event
        bra             EventLoop       ; return to eventloop call

HandleEvent:
; Use the event number as an index into the Event table. These 12 events
; are all the things that could spontaneously happen while the program is
; in the main loop.

        MOVE            What,D0                 ; Get event number
        ADD             D0,D0           ; *2 for table index
        MOVE            EventTable(D0),D0       ; Point to routine offset
        JMP             EventTable(D0)          ; and jump to it

EventTable:
        DC.W            OtherEvent-EventTable ; Null Event (Not used)
        DC.W            MouseDown-EventTable ; Mouse Down
        DC.W            OtherEvent-EventTable ; Mouse Up (Not used)
        DC.W            KeyEvent-EventTable   ; Key Down
        DC.W            OtherEvent-EventTable ; Key Up (Not used)
        DC.W            KeyEvent-EventTable   ; Auto Key
        DC.W            UpDate-EventTable     ; Update
        DC.W            OtherEvent-EventTable ; Disk (Not used)
        DC.W            Activate-EventTable   ; Activate
        DC.W            OtherEvent-EventTable ; Abort (Not used)
        DC.W            OtherEvent-EventTable ; Network (Not used)
        DC.W            OtherEvent-EventTable ; I/O Driver (Not used)

;------------------------- Event Actions -------------------------

OtherEvent:
        rts


Activate:
; An activate event is posted by the system when a window needs to be
; activated or deactivated. The information that indicates which window
; needs to be updated was returned by the NextEvent call.

        btst            #ActiveBit,Modify       ; Activate?
        beq             Deactivate              ; No, go do Deactivate
; Bring it to the front
        move.l          Message,-(sp)
```

```
        _BringToFront
; Show it
        move.l          Message,-(sp)
        _ShowWindow
; Select it
        move.l          Message,-(sp)
        _SelectWindow
        rts

Deactivate:
        rts


Update:
; The window needs to be redrawn.

;PROCEDURE   BeginUpdate (theWindow: WindowPtr);
        MOVE.L          message,-(SP)           ; Get pointer to window
        _BeginUpDate                            ; Begin the update
        move.l          message,-(sp)
        bsr             WDHATCIS                ; Was it our TC window?
        tst.w           (sp)+
        BEQ             DontTCDraw
        bsr             WDHATCDraw              ; Draw the TC window.
        bra             DoneDraw
DontTCDraw:
        move.l          message,-(sp)
        bsr             WDHAPSIS                ; Was it our PS window?
        tst.w           (sp)+
        BEQ             DontPSDraw
        bsr             WDHAPSDraw              ; Draw the PS window.
        bra             DoneDraw
DontPSDraw:
DoneDraw:
;PROCEDURE   EndUpdate (theWindow: WindowPtr);
        MOVE.L          message,-(SP)           ; Get pointer to window
        _EndUpdate                              ; and end the update
        rts


MouseDown:
; If the mouse button was pressed, we must determine where the click
; occurred before we can do anything.  Call FindWindow to determine
; where the click was; dispatch the event according to the result.

        ;FUNCTION       FindWindow (thePt: Point;
        ;                       VAR whichWindow: WindowPtr): INTEGER;
        CLR             -(SP)                   ; Space for result
        MOVE.L          Where,-(SP)             ; Get mouse coordinates
        PEA             WWindow                         ; Event Window
        _FindWindow                             ; Who's got the click?
        MOVE            (SP)+,D0                ; Get region number
        ADD             D0,D0                   ; *2 for index into table
        MOVE            WindowTable(D0),D0      ; Point to routine offset
```

```
        JMP         WindowTable(D0)             ; Jump to routine

WindowTable:
        DC.W        other-WindowTable       ; In Desk (Not used)
        DC.W        MenuBar-WindowTable     ; In Menu Bar
        DC.W        SystemEvent-WindowTable     ; System Window (Not used)
        DC.W        Content-WindowTable     ; In Content
        DC.W        Drag-WindowTable        ; In Drag
        DC.W        Grow-WindowTable        ; In Grow
        DC.W        GoAway-WindowTable      ; In Go Away

Other:
        rts

SystemEvent:
; Call SystemClick to handle the desk accessory windows.
        pea     EventRecord
        move.l  wwindow,-(sp)
        _SystemClick
        rts

Content:
; Was it in the content of an active window?
        clr.l       -(sp)
        _FrontWindow
        move.l      (sp)+,d1                ; Get the FrontWindow in d1
        cmp.l       wwindow,d1              ; Are they the same?
        beq         WasActive
        move.l      wwindow,-(sp)           ; It wasn't
        _SelectWindow                       ; So select it.
        bra         DoneContent
WasActive:
        move.l      wwindow,-(sp)
        bsr         WDHAPSIS                ; Was it our PS window?
        tst.w       (sp)+
        beq         NotPSContent
        move.l      where,-(sp)
        bsr         WDHAPSControl               ; Handle the event.
        bra         DoneContent
NotPSContent:
        move.l      wwindow,-(sp)
        bsr         WDHATCIS                ; Was it our TC window?
        tst.w       (sp)+
        beq         NotTCContent
        move.l      where,-(sp)
        bsr         WDHATCControl               ; Handle the event
        bra         DoneContent
NotTCContent:
DoneContent:
        rts

Drag:
; The click was in the drag bar of the window.  Draggit.
; DragWindow (theWindow:WindowPtr; startPt: Point; boundsRect: Rect);
```

```
        MOVE.L wwindow,-(SP) ;Pass window pointer
        MOVE.L where,-(SP)   ;mouse coordinates
        PEA    bound         ;and boundaries
        _DragWindow          ;Drag Window
        rts

Grow:
; The click was in the grow box
NoGrow:     rts


GoAway:                                  ; Close the Window
        clr.b    -(sp)                   ; make room for a Boolean
        move.l  wwindow,-(sp)
        move.l  where,-(sp)
        _TrackGoAway                     ; Track It
        tst.b    (sp)+                   ; Did they stay in the box?
        beq      NoGoAway                ; If no then don't close.
JustHide:
;PROCEDURE   HideWindow (theWindow: WindowPtr)
        MOVE.L wwindow,-(SP)             ; Pass window pointer
        _HideWindow                      ; Hide the Window
NoGoAway:
        rts

KeyEvent:
        CLR.L   -(SP)                    ; Space for result
        _FrontWindow                     ; Get window pointer on stack
        bsr      WDHATCIS                ; Was it our TC window?
        tst.w    (sp)+
        beq      TCNotActive
        move.w message+2,-(sp)                   ; get the char
        bsr      WDHATCKey               ; Insert it in the active text box
TCNotActive:
        rts

; InitManagers initializes all the ToolBox managers.  You should call
; InitManagers once at the beginning of your program if you are using
; any of the ToolBox routines.
InitManagers:
        pea      -4(a5)
        _InitGraf
        _InitFonts
        move.l  #$0000FFFF,d0
        _FlushEvents
        _InitWindows
        _InitMenus
        clr.l    -(sp)
        _InitDialogs
        _TEInit
        _InitCursor
        rts
```

```
; WDHA header file
; this file must be included to access the data structures contained in
; the file WDHA.Asm
        XREF    EventLoop
        XREF    Update
        XREF    EventRecord
        XREF    What
        XREF    Message
        XREF    When
        XREF    Where
        XREF    Modify
        XREF    WWindow

TRUE    EQU     1
FALSE   EQU     0
```

```
;WDHAMac.txt
;macros for WDHA program
;12/27/86  AME


;Dialog
;Macro
        Macro  Dialog  xpos,ypos,txtstring,result  =
        move.w{xpos},-(SP)
        move.w{ypos},-(SP)
        _MoveTo
        pea     '{txtstring}'
        _DrawString
        pea     KeyBuf
        bsr     GetStr

        lea     keybuf,a0
        move.w#1,-(SP)
        _Pack7                  ;StringToNum
        move.wd0,{result}
        |

;DispString
;Macro
        Macro  DispString   xpos,ypos,txtstring  =
        move.w{xpos},-(SP)
        move.w{ypos},-(SP)
        _MoveTo
        pea     '{txtstring}'
        _DrawString
        |

;DispValue
;Macro
        Macro  DispValue  xpos,ypos,label,value  =
        movem.l         a0-a6/d0-d7,-(sp)
        move.w{xpos},-(SP)
        move.w{ypos},-(SP)
        _MoveTo
        pea     '{label}'
        _DrawString

        lea     KeyBuf,a0
        move.l  {value},d0
        move.w#0,-(SP)                  ;Select NumToString
        _Pack7

        pea     KeyBuf
        _DrawString
        movem.l         (sp)+,a0-a6/d0-d7
        |

;DispWValue
;Macro
```

```
Macro  DispWValue  xpos,ypos,label,value =
movem.l        a0-a6/d0-d7,-(sp)
move.w{xpos},-(SP)
move.w{ypos},-(SP)
_MoveTo
pea     '{label}'
_DrawString

lea     KeyBuf,a0
move.w{value},d0
ext.l   d0
move.w#0,-(SP)                  ;Select NumToString
_Pack7

pea     KeyBuf
_DrawString
movem.l        (sp)+,a0-a6/d0-d7
|
```

```
; WDHAMenu.Asm
; This file contains routines which create and manipulate the menus used in
; the WDHA program.

Include MacTraps.D
Include ToolEquX.D
Include SysEquX.D
Include QuickEquX.D
Include MDS2:WDHAMac.txt
Include MDS2:WDHA.hdr
Include MDS2:WDHAPS.hdr
Include MDS2:WDHATC.hdr
Include MDS2:WDHAFC.hdr
Include MDS2:WDHASCSI.hdr

        xdef    MakeMenus
        xdef    MenuHandles
        xdef    MenuBar

AppleMenu       EQU     1
 AboutItem      EQU     1
 menuapple      equ 0   ;menuhandle offset

FileMenu        EQU     2
 QuitItem               EQU     1
 menufile       equ 4   ;menuhandle offset

; Now the aid menus.  All have a 'new program' entry, and a blank line.
 NewProgItem    EQU     1
 AidBlank       EQU     2

Aid12ID                 EQU     -12     ; program version id
Aid12Menu       EQU     5
 SetItem        EQU     3
 TestItem       EQU     4
 menuaid12      equ 8   ;menuhandle offset

Aid13ID                 EQU     -13     ; program version id
Aid13Menu       EQU     6
 FCItem EQU     5
 menuaid13      equ 12  ;menuhandle offset

Aid14ID                 EQU     -14     ; program version id
Aid14Menu       EQU     7
 menuaid14      equ 16  ;menuhandle offset

 SS15ID                 EQU     -100
 SS15Menu       EQU     8
  LoadItem      EQU     3
  menuss15      equ     20

 NoneMenu       EQU     9
  menunone      equ     24
```

```
; Name: MakeMenus
; Function: MakeMenus creates and displays the menu bar.
; Input: None
; Output: None
MakeMenus:
;Clear menu bar
        _ClearMenuBar

        lea     MenuHandles,a4
;First add Apple Menu
;Make it.
        clr.l   -(sp)                   ;space for function result
        move.w#AppleMenu,-(sp)          ;first menu
        pea     AppleName               ;apple character
        _NewMenu
        move.l  (sp)+,menuapple(a4)     ;store handle
;Add entries
        move.l  menuapple(a4),-(sp)     ;push handle again
        pea     'About WDHA;(-'                         ;push menu item
        _AppendMenu
        move.l  menuapple(a4),-(sp)     ;push handle again
        move.l  #'DRVR',-(sp)           ;load all drivers
        _AddResMenu
;Insert it in the menu bar.
        move.l  menuapple(a4),-(sp)     ;push handle again
        move.w#0,-(sp)                  ;insert at end
        _InsertMenu

; Now add File Menu
;Make it.
        clr.l   -(sp)                   ;space for function result
        move.w#FileMenu,-(sp)                   ;second menu
        pea     'File'                  ;menu title
        _NewMenu
        move.l  (sp)+,menufile(a4)      ;store handle
;Add entries
        move.l  menufile(a4),-(sp)      ;push handle again
        pea     'Quit'          ;push menu item
        _AppendMenu
;Insert it in the menu bar.
        move.l  menufile(a4),-(sp)      ;push handle again
        move.w#0,-(sp)                  ;insert at end
        _InsertMenu

;Now create the WDHA program menus.
; none
        clr.l   -(sp)                   ;space for function result
        move.w#NoneMenu,-(sp)
        pea 'WDHA Disconnected'                         ;menu title
        _NewMenu
        move.l  (sp)+,menunone(a4)      ;store handle
;Add entries.
        move.l  menunone(a4),-(sp)      ;push handle
        pea 'New WDHA Program;(-' ;menu items.
```

```
        _AppendMenu

; aid12
        clr.l   -(sp)                   ;space for function result
        move.w#Aid12Menu,-(sp)
        pea 'Aid12'                     ;menu title
        _NewMenu
        move.l (sp)+,menuaid12(a4)      ;store handle
;Add entries.
        move.l menuaid12(a4),-(sp)      ;push handle
        pea 'New WDHA Program;(-;4 Channel Parameters;Test Calibrate' ;menu items.
        _AppendMenu

; aid13
        clr.l   -(sp)                   ;space for function result
        move.w#Aid13Menu,-(sp)
        pea 'Aid13'                     ;menu title
        _NewMenu
        move.l (sp)+,menuaid13(a4)      ;store handle
;Add entries.
        move.l menuaid13(a4),-(sp)      ;push handle
        pea 'New WDHA Program;(-;4 Channel Parameters;Test Calibrate;32 Tap Filter Load'
;menu items.
        _AppendMenu

; aid14
        clr.l   -(sp)                   ;space for function result
        move.w#Aid14Menu,-(sp)
        pea 'Aid14'                     ;menu title
        _NewMenu
        move.l (sp)+,menuaid14(a4)      ;store handle
;Add entries.
        move.l menuaid14(a4),-(sp)      ;push handle
        pea 'New WDHA Program;(-;4 Channel Parameters;Test Calibrate;31 Tap Filter Load'
;menu items.
        _AppendMenu

; SS15
        clr.l   -(sp)                   ;space for function result
        move.w#SS15Menu,-(sp)
        pea 'SS15'                      ;menu title
        _NewMenu
        move.l (sp)+,menuss15(a4)       ;store handle
;Add entries.
        move.l menuss15(a4),-(sp)       ;push handle
        pea 'New WDHA Program;(-;Parameter Load' ;menu items.
        _AppendMenu

;Insert one in the menu bar since SetProgMenu deletes one.
        move.l menunone(a4),-(sp)       ;push handle again
        move.w#0,-(sp)                  ;insert at end
        _InsertMenu

; Set the proper WDHA program menu
```

```
        bsr     SetProgMenu
        rts

; Name: SetProgMenu
; Function: This routine interrogates the hearing aid to determine which
;         program it is currently running, then places the appropriate menu
;         in the menu bar.
; Input: None
; Output: None
SetProgMenu:
; Close windows so that no inappropriate windows remain.
        bsr             WDHAPSHide
        bsr             WDHATCHide
; Delete the old menu (whichever it is)
        move.w#Aid12Menu,-(sp)
        _DeleteMenu
        move.w#Aid13Menu,-(sp)
        _DeleteMenu
        move.w#Aid14Menu,-(sp)
        _DeleteMenu
        move.w#SS15Menu,-(sp)
        _DeleteMenu
        move.w#NoneMenu,-(sp)
        _DeleteMenu
; Default to NoneMenu
        lea             MenuHandles,a4
        move.l  menunone(a4),-(sp)
        move.w#0,-(sp)
        _InsertMenu
;redraw the bar
        _DrawMenuBar
        move.w#0,-(sp)                  ;clear any highlighting.
        _HiLiteMenu
; Now check what it is
        clr.w   -(sp)
        bsr     SCSIInterrogate
        move.w(sp)+,d0
        lea     MenuHandles,a4
        cmp.w   #Aid12ID,d0
        bne     NotAid12
        move.l  menuaid12(a4),a3        ;get handle
        bra     AddProgMenu
NotAid12:
        cmp.w   #Aid13ID,d0
        bne     NotAid13
        move.l  menuaid13(a4),a3        ;get handle
        bra     AddProgMenu
NotAid13:
        cmp.w   #Aid14ID,d0
        bne     NotAid14
        move.l  menuaid14(a4),a3        ;get handle
        bra     AddProgMenu
NotAid14:
        cmp.w   #SS15ID,d0
```

```
        bne     NotSS15
        move.l  menuss15(a4),a3         ;get handle
        bra     AddProgMenu
NotSS15:
        move.l  menunone(a4),a3
        move.w#20,-(sp)
        _SysBeep

AddProgMenu:
        move.w#NoneMenu,-(sp)
        _DeleteMenu
        move.l  a3,-(sp)
        move.w#0,-(sp)
        _InsertMenu
;redraw the bar
        _DrawMenuBar
ClearReturn:
        move.w#0,-(sp)                  ;clear any highlighting.
        _HiLiteMenu
        rts

; Name: MenuBar
; Function: This routine should be called when the mouse is clicked in the
;         menu bar.
; Input: None
; Output: None
MenuBar:
        clr.l   -(sp)           ;space for result
        move.l  where,-(sp)     ;location of mouse
        _MenuSelect
        move.l  (sp)+,d0        ;get result (menu id, item #)
        swap    d0              ;get menu id in low word

Choices:
        cmp.w   #0,d0           ;Was it in any menu?
        beq     @1              ;no menu id
        cmp.w   #AppleMenu,d0 ;Was it in the apple menu?
        beq     InAppleMenu
        cmp.w   #FileMenu,d0    ;Was it in the file menu?
        beq     InFileMenu
        cmp.w   #NoneMenu,d0
        beq     InSSMenu
        cmp.w   #Aid12Menu,d0
        beq     InAidMenu
        cmp.w   #Aid13Menu,d0
        beq     InAidMenu
        cmp.w   #Aid14Menu,d0
        beq     InAidMenu
        cmp.w   #SS15Menu,d0
        beq     InSSMenu
@1      bra     ClearReturn

InAppleMenu:
; GetItem
```

```
        swap    d0                              ; get item # in low word
        cmp.w   #AboutItem,d0
        bne             NotAbout
; Open About dialog window.
; FUNCTION      NewWindow (wStorage: Ptr; boundsRect: Rect;
;                                 title: Str255; visible: BOOLEAN;
;                                procID: INTEGER; behind: WindowPtr;
;                               goAwayFlag: BOOLEAN;
;                                 refCon: LongInt) : WindowPtr;
        SUBQ            #4,SP                   ; Space for function result
        CLR.L           -(SP)                   ; Storage for window (Heap)
        PEA                     AboutBounds             ; Window position
        PEA                     'About WDHA'    ; Window title
        MOVE.B          #255,-(SP)              ; Make window visible
        MOVE            #dBoxProc,-(SP)         ; Standard document window
        MOVE.L          #-1,-(SP)                       ;Make it the front window
        move.B          #-1,-(SP)                       ; Window has goAway button
        CLR.L           -(SP)                   ; Window refCon
        _NewWindow                                      ; Create and draw window
        lea                     AboutPtr,a4
        MOVE.L          (SP)+,(a4)              ; Save handle for later
        MOVE.L          (a4),-(SP)              ; Make sure the new window is the port
;PROCEDURE   SetPort (gp: GrafPort)
        _SetPort                        ; Make it the current port
        move.w          #0,-(sp)
        _TextFont               ; Make sure it's the system font
        move.w#1,-(sp)          ; Bold
        _TextFace
        DispString      #20,#16,Wearable Digital Hearing Aid Fitting Procedure V. 1.0
        move.w#0,-(sp)          ; Plain Text
        _TextFace
        DispString      #200,#32,Central Institute For The Deaf
        DispString      #200,#48,818 South Euclid Ave.
        DispString      #200,#64,St. Louis Mo. 63110
        DispString      #200,#80,Phone:  314-652-3200
        move.w#1,-(sp)          ; Bold
        _TextFace
        DispString      #20,#96,Supported in part by:
        move.w#0,-(sp)          ; Plain Text
        _TextFace
        DispString      #40,#112,The Rehabilitation Research And Development Service
        DispString      #40,#128,Dept. of Medicine and Surgery: Veterans Administration
; Print the big "CID"
        move.w#36,-(sp)
        _TextSize
        move.w#17,-(sp)         ; Bold+Shadow
        _TextFace
        DispString      #44,#64,CID
; Set text characteristics back to normal
        move.w#12,-(sp)
        _TextSize
        move.w#0,-(sp)          ; Plain Text
        _TextFace
; Wait for an event
```

```
        move.l  #$0000FFFF,d0
        _FlushEvents
EvtWait:
; FUNCTION      GetNextEvent(eventMask: INTEGER;
;               VAR theEvent: EventRecord) : BOOLEAN
        CLR             -(SP)                   ; Clear space for result
        MOVE    #$000F,-(SP)            ; Allow 12 low events
        PEA             EventRecord             ; Place to return results
        _GetNextEvent                           ; Look for an event
        MOVE    (SP)+,D0                        ; Get result code
        BEQ     EvtWait                 ; No event... Keep waiting
; Dispose Window
        move.l  AboutPtr,-(sp)
        _DisposWindow
        bra             ClearReturn
NotAbout:
        lea             MenuHandles,a4
        move.l  menuapple(a4),-(sp)     ; Look in Apple Menu
        move.w d0,-(sp)         ; what item #
        pea     DeskName        ; get item name
        _GetItem
; OpenDeskAcc
        clr.w   -(sp)           ; space for result
        pea     DeskName        ; open DeskName acc
        _OpenDeskAcc
        move.w(sp)+,d0          ; pop result
        bra     ClearReturn

InFileMenu:
        swap    d0                      ; get item # in low word
        cmp.w   #QuitItem,d0    ; Is it quit?
        bne     DoneFile                        ; If not forget it
        bsr     WDHAPSClose             ; dispose of the parameter settings window
        bsr     WDHATCClose             ; dispose of the test/calibrate window
        _ExitToShell                    ; leave application
DoneFile:
        bra     ClearReturn

InAidMenu:
        swap    d0              ; get item # in low word
        cmp.w   #NewProgItem,d0
        bne     @9
        bsr     SetProgMenu
        bra     WMDone
@9
        cmp.w   #SetItem,d0
        bne     @1
        bsr     WDHAPSShow
        bra     WMDone
@1      cmp.w   #TestItem,d0
        bne     @2
        bsr     WDHATCShow
        bra     WMDone
@2      cmp.w   #FCItem,d0
```

```
        bne     @4
        bsr     WDHAFCSet
        bra     WMDone
@4
WMDone          bra     ClearReturn


InSSMenu:
        swap    d0              ; get item # in low word
        cmp.w   #NewProgItem,d0
        bne     @1
        bsr     SetProgMenu
        bra     SSDone
@1      cmp.w   #LoadItem,d0
        bne     @2
        bsr     WDHASetFileParams
        bra     SSDone
@2
SSDone bra      ClearReturn

;--------------------Data    starts    here-------------------------------
MenuHandles:
                dc.l    0               ;handle to apple menu
                dc.l    0               ;handle to file menu
                dc.l    0               ;handle to aid12 menu
                dc.l    0               ;handle to aid13 menu
                dc.l    0               ;handle to aid14 menu
                dc.l    0               ;handle to ss15 menu
                dc.l    0               ;handle to none menu

AppleName:      dc.b    1,$14           ; A string containing the apple symbol
DeskName:       dcb.w   16,0            ;desk accessories name

AboutPtr        dc.l    0               ; the About dialog window pointer
AboutBounds:
                dc.w    100             ; upper
                dc.w    50              ; left
                dc.w    232             ; lower
                dc.w    472             ; right
```

```
;WDHAMenu header file
; This file must be included if any routines in WDHAMenu are used.
        xref    MakeMenus
        xref    MenuHandles
        xref    MenuBar
```

```
; file WDHAPS.Asm

Include MacTraps.D
Include ToolEqu.D
Include SysEquX.D
Include QuickEquX.D
Include SANEMacs.txt
Include MDS2:WDHA.hdr
Include MDS2:WDHASCSI.hdr

;-----------------------------------------------------------------
; WDHA Paramater Settings Window Manager
;       This package contains routines to manipulate the WDHA Parameter
; Settings window.  This window contains an interface which controls the
; gain and limit of each channel of the WDHA by allowing the user to move
; bars on a graph of Frequency versus dB SPL (execute the program for a better
; understanding), this control is referred to as the "PSGraph" in the program
; documentation.  Next to this graph is a chart (the "PSChart") containing the
; numeric values of each channel's gain and limit.
;       It also contains control buttons to specify if the WDHA should be in
; Hearing aid mode, if the input attenuation should be off or on, and whether
; the aid should use the probe mike or the field mike.  The output attenuation
; is automatically turned on or off by the program, it's control being used
; as an indicator of this status.
;       Wherever the documentation refers to the term "theta", it is refering
; to the height of the lower bar of the bar graph, and wherever the documentation
; uses "phi", it refers to the height of the upper bar.

;   --------------------External   Definitions----------------------------

        XDEF    WDHAPSOpen
        XDEF    WDHAPSClose
        XDEF    WDHAPSShow
        XDEF    WDHAPSHide
        XDEF    WDHAPSDraw
        XDEF    WDHAPSControl
        XDEF    WDHAPSIS
        XDEF    WDHAPSSetParam

;   --------------------  Constant   Definitions  -------------------------
CHANNELS        EQU     4       ; There are four channels

; PSG = The Parameter Settings Graph
PSGHeight       EQU     120                     ; Graph height in pixels
PSGChanWidth    EQU     20      ; each bar is PSGChanWidth pixels wide.
PSGWidth        EQU     CHANNELS*PSGChanWidth       ; Graph width in pixels
PSGInitX        EQU     30      ; initial X coord (local) of ul corner of graph
PSGInitY        EQU     20      ; initial Y coord (local) of ul corner of graph

; PSC = The Parameter Settings Chart
PSCFWidth       EQU     46      ; channel, gain and limit field width
PSCFHeight      EQU     PSGHeight/(CHANNELS+1)      ; height of box in chart
PSCWidth        EQU     3*PSCFWidth
PSCInitX        EQU     PSGInitX+PSGWidth       ; X coord (local) of ul corner of chart
```

```
PSCInitY        EQU     PSGInitY        ; Y coord (local) of ul corner of chart

; PS = The Parameter Settings Window
PSInitX EQU     60      ; initial X coord (global) of upper left corner
PSInitY EQU     80      ; initial Y coord (global) of upper left corner
PSRightEQU      PSInitX+PSGWidth+PSCWidth+2*PSGInitX+140
PSTxtSize       EQU     12

; PSCtl = The Control Buttons
PSCtlInitX      EQU     PSGInitX+PSGWidth+PSCWidth+10
PSCtlInitY      EQU     PSGInitY+5
PSCtlFHeight    EQU     PSCFHeight

;--------------------Subroutine    Declarations-----------------------
; Name: WDHAPSOpen
; Function: Call this routine to create and display the PS Window.
; Input: None
; Output: None
WDHAPSOpen:
        movem.l         d0-d2/a0-a6,-(sp)               ; save registers
; Set up document window.
        ;FUNCTION        NewWindow (wStorage: Ptr; boundsRect: Rect;
        ;                                  title: Str255; visible: BOOLEAN;
        ;                                 procID: INTEGER; behind: WindowPtr;
        ;                                 goAwayFlag: BOOLEAN;
        ;                                  refCon: LongInt) : WindowPtr;
        SUBQ            #4,SP                   ; Space for function result
        CLR.L           -(SP)                   ; Storage for window (Heap)
        PEA             WDHAPSBounds            ; Window position
        PEA             'WDHA Parameter Settings'       ; Window title
        MOVE.B          #255,-(SP)              ; Make window visible
        MOVE            #rDocProc,-(SP)         ; Standard document window
        MOVE.L          #-1,-(SP)               ;Make it the front window
        move.B          #-1,-(SP)               ; Window has goAway button
        CLR.L           -(SP)                   ; Window refCon
        _NewWindow                              ; Create and draw window
        lea             WDHAPSPtr,a4
        MOVE.L          (SP)+,(a4)              ; Save handle for later
        MOVE.L          (a4),-(SP)              ; Make sure the new window is the port
;PROCEDURE   SetPort (gp: GrafPort)
        _SetPort                        ; Make it the current port
; Add the control buttons
        bsr             PSAddControls
        bsr             WDHAPSDraw
        movem.l                 (sp)+,d0-d2/a0-a6       ; Restore registers
        RTS

; Name: WDHAPSClose
; Function: Call this routine to destroy the PS Window and remove it from
; the screen.
; Input: None
; Output: None
WDHAPSClose:
        movem.l         d0-d7/a0-a6,-(sp)       ; save registers
```

```
        move.l  WDHAPSPtr,-(sp)
        _KillControls
; Dispose Window
        move.l  WDHAPSPtr,-(sp)
        _DisposWindow
        movem.l         (sp)+,d0-d7/a0-a6       ; restore registers
        rts

; Name: WDHAPSShow
; Function: This routine makes the PS window visible and frontmost.
; Input: None
; Output: None
WDHAPSShow:
        movem.l         d0-d7/a0-a6,-(sp)       ; save registers
; Bring it to the front
        move.l  WDHAPSPtr,-(sp)
        _BringToFront
; Show Window
        move.l  WDHAPSPtr,-(sp)
        _ShowWindow
        move.l  WDHAPSPtr,-(sp)
        _SelectWindow                   ; So select it.
        movem.l         (sp)+,d0-d7/a0-a6       ; restore registers
        rts

; Name: WDHAPSHide
; Function: This routine makes the PS window invisible, removing it from the
; screen (but not destroying it).
; Input: None
; Output: None
WDHAPSHide:
        movem.l         d0-d7/a0-a6,-(sp)       ; save registers
; Hide Window
        move.l  WDHAPSPtr,-(sp)
        _HideWindow
        movem.l         (sp)+,d0-d7/a0-a6       ; restore registers
        rts

; Name: WDHAPSDraw
; Function: This routine draws the PS window's contents.
; Input: None
; Output: None
WDHAPSDraw:
        movem.l         d0-d7/a0-a6,-(sp)       ; save registers
        lea     WDHAPSPtr,a4            ; Pointer on stack
        MOVE.L (a4),-(SP)
;PROCEDURE   SetPort (gp: GrafPort)
        _SetPort                        ; Make it the current port
; First draw the graph
        pea     WDHAPSGraph
        _EraseRect                      ; clear it
        pea     WDHAPSGraph
        _FrameRect                      ; Frame it
        move.w#patOr,-(sp)
```

```
        _PenMode                        ; change to Or pen mode.

        move.w#0,d4                     ; count thru channels
DrawChans:                              ; draw each channel
        cmp.w  #CHANNELS,d4             ; done yet?
        beq    DoneDC
; Draw Theta Bar
        pea    ThetaPat
        _PenPat                                 ; set pen pattern to ThetaPat
        move.wd4,-(sp)
        bsr    CalThetaRect             ; Calculate theta rectangle
        pea    TRect
        _PaintRect                      ; Fill with pattern
; Draw Phi Bar
        pea    PhiPat
        _PenPat                                 ; set pen pattern to PhiPat
        move.wd4,-(sp)
        bsr    CalPhiRect
        pea    TRect
        _PaintRect                      ; Fill with pattern
        add.w  #1,d4
        bra    DrawChans
DoneDC:
        _PenNormal                      ; Reset Pen to original settings
        move.w#PSTxtSize,-(sp)
        _TextSize
        move.w#PSGInitX+0*PSGChanWidth+PSGChanWidth/2,-(sp)
        move.w#PSGInitY+PSGHeight+PSTxtSize,-(sp)
        _MoveTo
        move.w#'1',-(sp)
        _DrawChar
        move.w#PSGInitX+1*PSGChanWidth+PSGChanWidth/2,-(sp)
        move.w#PSGInitY+PSGHeight+PSTxtSize,-(sp)
        _MoveTo
        move.w#'2',-(sp)
        _DrawChar
        move.w#PSGInitX+2*PSGChanWidth+PSGChanWidth/2,-(sp)
        move.w#PSGInitY+PSGHeight+PSTxtSize,-(sp)
        _MoveTo
        move.w#'3',-(sp)
        _DrawChar
        move.w#PSGInitX+3*PSGChanWidth+PSGChanWidth/2,-(sp)
        move.w#PSGInitY+PSGHeight+PSTxtSize,-(sp)
        _MoveTo
        move.w#'4',-(sp)
        _DrawChar
        move.w#PSGInitX+(CHANNELS/2)*PSGChanWidth-25,-(sp)
        move.w#PSGInitY+PSGHeight+2*PSTxtSize,-(sp)
        _MoveTo
        pea    'Channel'
        _DrawString
        move.w#PSGInitX-20,-(sp)
        move.w#PSGInitY+PSGHeight/2-PSTxtSize,-(sp)
        _MoveTo
```

```
        pea     'dB'
        _DrawString
        move.w#PSGInitX-24,-(sp)
        move.w#PSGInitY+PSGHeight/2,-(sp)
        _MoveTo
        pea     'SPL'
        _DrawString
        move.w#9,-(sp)
        _TextSize
        move.w#PSGInitX-9,-(sp)
        move.w#PSGInitY+PSGHeight,-(sp)
        _MoveTo
        move.w#'0',-(sp)
        _DrawChar
        move.w#PSGInitX-20,-(sp)
        move.w#PSGInitY+9,-(sp)
        _MoveTo
        pea             '120'
        _DrawString
; Now draw the chart.
        _PenNormal
        pea     WDHAPSChart
        _FrameRect
        move.w#PSCInitX,-(sp)
        move.w#PSCInitY+1*PSCFHeight,-(sp)
        _MoveTo
        move.w#PSCInitX+PSCWidth,-(sp)
        move.w#PSCInitY+1*PSCFHeight,-(sp)
        _LineTo
        move.w#PSCInitX,-(sp)
        move.w#PSCInitY+2*PSCFHeight,-(sp)
        _MoveTo
        move.w#PSCInitX+PSCWidth,-(sp)
        move.w#PSCInitY+2*PSCFHeight,-(sp)
        _LineTo
        move.w#PSCInitX,-(sp)
        move.w#PSCInitY+3*PSCFHeight,-(sp)
        _MoveTo
        move.w#PSCInitX+PSCWidth,-(sp)
        move.w#PSCInitY+3*PSCFHeight,-(sp)
        _LineTo
        move.w#PSCInitX,-(sp)
        move.w#PSCInitY+4*PSCFHeight,-(sp)
        _MoveTo
        move.w#PSCInitX+PSCWidth,-(sp)
        move.w#PSCInitY+4*PSCFHeight,-(sp)
        _LineTo
        move.w#PSCInitX+PSCFWidth,-(sp)
        move.w#PSCInitY,-(sp)
        _MoveTo
        move.w#PSCInitX+PSCFWidth,-(sp)
        move.w#PSCInitY+PSGHeight,-(sp)
        _LineTo
        move.w#PSCInitX+2*PSCFWidth,-(sp)
```

```
        move.w#PSCInitY,-(sp)
        _MoveTo
        move.w#PSCInitX+2*PSCFWidth,-(sp)
        move.w#PSCInitY+PSGHeight,-(sp)
        _LineTo
        move.w#PSCInitX+6,-(sp)
        move.w#PSCInitY+PSCFHeight-6,-(sp)
        _MoveTo
        pea     'Channel'
        _DrawString
        move.w#PSCInitX+PSCFWidth+11,-(sp)
        move.w#PSCInitY+PSCFHeight-6,-(sp)
        _MoveTo
        pea     'Gain'
        _DrawString
        move.w#PSCInitX+2*PSCFWidth+10,-(sp)
        move.w#PSCInitY+PSCFHeight-6,-(sp)
        _MoveTo
        pea     'Limit'
        _DrawString
        move.w#CHANNELS,d4 ; Now draw the chart data with PrintVal
        lea             Theta3,a0               ; will draw the gains and limits too
DrChartNums:
; Draw channel #
        move.w#0,-(sp)                  ; Column 0
        move.wd4,-(sp)                  ; Row is same as channel
        move.wd4,-(sp)                  ; value is channel
        bsr     PrintVal
; Draw gain
        move.w#1,-(sp)                  ; now do gain
        move.wd4,-(sp)                  ; Row is same as channel
        move.w(a0),-(sp)        ; Show the theta value as gain
        bsr     PrintVal
; Draw limit
        move.w#2,-(sp)                  ; now do limit
        move.wd4,-(sp)                  ; Row is same as channel
        move.w2(a0),-(sp)       ; Show the Phi value as limit
        bsr     PrintVal
        lea             -4(a0),a0
        sub.w   #1,d4
        bne             DrChartNums
; Draw the control buttons.
        move.l  WDHAPSPtr,-(sp)         ; the window ptr
        _DrawControls
        bsr             WDHAPSSetParam          ; update the WDHA.
        movem.l         (sp)+,d0-d7/a0-a6       ; restore registers
        rts

; Name: PSAddControls
; Function: This routine adds the  PS window's controls.
; Input: None
; Output: None
PSAddControls:
        movem.l         d0-d7/a0-a6,-(sp)       ; save registers
```

```
; Set up the controls bounding rectangle.
        lea             TRect,a4
        move.w#PSCtlInitY+0*PSCtlFHeight,(a4)       ; store y coord
        move.w#PSCtlInitX,2(a4)       ; store x coord
        move.w#PSCtlInitY+0*PSCtlFHeight+20,4(a4)         ; store y coord
        move.w#PSRight,6(a4)                  ; store x coord
; Push parameters for NewControl
        clr.l           -(sp)                 ; NewControl returns a handle
        move.l WDHAPSPtr,-(sp)        ; the window ptr
        pea             TRect                 ; the rectangle bounding the control
        pea             'Hearing Aid On'      ; title
        move.b #TRUE,-(sp)            ; visible
        move.w#0,-(sp)                        ; value
        move.w#0,-(sp)                        ; min
        move.w#1,-(sp)                        ; max
        move.w#1,-(sp)                        ; check box proc id
        move.l #0,-(sp)                       ; refcon not used
; Call NewControl
        _NewControl
        lea             AidControl,a3
        move.l (sp)+,(a3)                     ; store the result
; Set up the controls bounding rectangle.
        lea             TRect,a4
        move.w#PSCtlInitY+1*PSCtlFHeight,(a4)       ; store y coord
        move.w#PSCtlInitX,2(a4)       ; store x coord
        move.w#PSCtlInitY+1*PSCtlFHeight+20,4(a4)         ; store y coord
        move.w#PSRight,6(a4)                  ; store x coord
; Push parameters for NewControl
        clr.l           -(sp)                 ; NewControl returns a handle
        move.l WDHAPSPtr,-(sp)        ; the window ptr
        pea             TRect                 ; the rectangle bounding the control
        pea             'Input Attenuation'   ; title
        move.b #TRUE,-(sp)            ; visible
        move.w#0,-(sp)                        ; value
        move.w#0,-(sp)                        ; min
        move.w#1,-(sp)                        ; max
        move.w#1,-(sp)                        ; check box proc id
        move.l #0,-(sp)                       ; refcon not used
; Call NewControl
        _NewControl
        lea             IAControl,a3
        move.l (sp)+,(a3)                     ; store the result
; Set up the controls bounding rectangle.
        lea             TRect,a4
        move.w#PSCtlInitY+2*PSCtlFHeight,(a4)       ; store y coord
        move.w#PSCtlInitX,2(a4)       ; store x coord
        move.w#PSCtlInitY+2*PSCtlFHeight+20,4(a4)         ; store y coord
        move.w#PSRight,6(a4)                  ; store x coord
; Push parameters for NewControl
        clr.l           -(sp)                 ; NewControl returns a handle
        move.l WDHAPSPtr,-(sp)        ; the window ptr
        pea             TRect                 ; the rectangle bounding the control
        pea             'Output Attenuation'  ; title
        move.b #TRUE,-(sp)            ; visible
```

```
        move.w#0,-(sp)                          ; value
        move.w#0,-(sp)                          ; min
        move.w#1,-(sp)                          ; max
        move.w#1,-(sp)                          ; check box proc id
        move.l #0,-(sp)                         ; refcon not used
; Call NewControl
        _NewControl
        lea             OAControl,a3
        move.l (sp)+,(a3)                       ; store the result
; Set up the controls bounding rectangle.
        lea             TRect,a4
        move.w#PSCtlInitY+3*PSCtlFHeight,(a4)       ; store y coord
        move.w#PSCtlInitX,2(a4)         ; store x coord
        move.w#PSCtlInitY+3*PSCtlFHeight+20,4(a4)           ; store y coord
        move.w#PSRight,6(a4)                    ; store x coord
; Push parameters for NewControl
        clr.l           -(sp)                   ; NewControl returns a handle
        move.l WDHAPSPtr,-(sp)          ; the window ptr
        pea             TRect                   ; the rectangle bounding the control
        pea             'Field Mike'            ; title
        move.b #TRUE,-(sp)              ; visible
        move.w#1,-(sp)                          ; make Field mike on as the default
        move.w#0,-(sp)                          ; min
        move.w#1,-(sp)                          ; max
        move.w#2,-(sp)                          ; radio button proc id
        move.l #0,-(sp)                         ; refcon not used
; Call NewControl
        _NewControl
        lea             FieldControl,a3
        move.l (sp)+,(a3)                       ; store the result
; Set up the controls bounding rectangle.
        lea             TRect,a4
        move.w#PSCtlInitY+4*PSCtlFHeight,(a4)       ; store y coord
        move.w#PSCtlInitX,2(a4)         ; store x coord
        move.w#PSCtlInitY+4*PSCtlFHeight+20,4(a4)           ; store y coord
        move.w#PSRight,6(a4)                    ; store x coord
; Push parameters for NewControl
        clr.l           -(sp)                   ; NewControl returns a handle
        move.l WDHAPSPtr,-(sp)          ; the window ptr
        pea             TRect                   ; the rectangle bounding the control
        pea             'Probe Mike'            ; title
        move.b #TRUE,-(sp)              ; visible
        move.w#0,-(sp)                          ; value
        move.w#0,-(sp)                          ; min
        move.w#1,-(sp)                          ; max
        move.w#2,-(sp)                          ; radio button proc id
        move.l #0,-(sp)                         ; refcon not used
; Call NewControl
        _NewControl
        lea             ProbeControl,a3
        move.l (sp)+,(a3)                       ; store the result
        movem.l         (sp)+,d0-d7/a0-a6
        rts
```

```
; CalThetaRect clculates the rectangle surrounding the control bar for the
; given channel.
; Input: the channel # (a word) is passed on the stack.
; Output: the rect TRect is filled.
CalThetaRect:
        movem.l         d0-d7/a0-a6,-(sp)
        lea     TRect,a4        ; get address of TRect
        move.w#PSGInitY+PSGHeight,d4        ; bottom of graph
        move.wd4,4(a4)          ; store it in TRect
        lea     Theta0,a3       ; Get theta
        move.w64(sp),d3         ; Get channel number
        asl.w   #2,d3           ; *4
        sub.w   (a3,d3.w),d4    ; compute top of bar y coord
        move.wd4,(a4)           ; store it in TRect
        move.w64(sp),d3         ; Get channel number
        mulu    #PSGChanWidth,d3        ; channel # * ChanWidth
        add.w   #PSGInitX,d3    ; move over
        move.wd3,2(a4)          ; store left side
        add.w   #PSGChanWidth,d3        ; add width
        move.wd3,6(a4)          ; store right side
        pea     TRect
        move.w#1,-(sp)
        move.w#1,-(sp)
        _InsetRect                      ; make it a tad smaller
        sub.w   #1,(a4)                 ; not the top level though
        movem.l         (sp)+,d0-d7/a0-a6
        move.l  (sp),2(sp)      ; move return address over param
        tst.w   (sp)+           ; get rid of parameter
        rts                     ; and return

; CalPhiRect clculates the rectangle surrounding the control bar for the
; given channel.
; Input: the channel # (a word) is passed on the stack.
; Output: the rect TRect is filled.
CalPhiRect:
        movem.l         d0-d7/a0-a6,-(sp)
        lea     TRect,a4        ; get address of TRect
        move.w#PSGInitY,d4      ; top of graph
        move.wd4,(a4) ; store it in TRect
        lea     Phi0,a3         ; Get Phi
        move.w64(sp),d3         ; Get channel number
        asl.w   #2,d3           ; *4
        move.w#120,d5
        sub.w   (a3,d3.w),d5    ; compute bottom of bar y coord
        add.w   d5,d4
        move.wd4,4(a4)                  ; store it in TRect
        move.w64(sp),d3         ; Get channel number
        mulu    #PSGChanWidth,d3        ; channel # * ChanWidth
        add.w   #PSGInitX,d3    ; move over
        move.wd3,2(a4)          ; store left side
        add.w   #PSGChanWidth,d3        ; add width
        move.wd3,6(a4)          ; store right side
        pea     TRect
        move.w#1,-(sp)
```

```
        move.w#1,-(sp)
        _InsetRect                      ; make it a tad smaller
        add.w   #1,4(a4)                ; not the bottom though
        movem.l         (sp)+,d0-d7/a0-a6
        move.l  (sp),2(sp)      ; move return address over param
        tst.w   (sp)+           ; get rid of parameter
        rts                     ; and return

; Name: PrintVal
; Function: This routine prints the given value at the specified row and
; column of the PSChart.
; Input: d3 (word) = value, d4 = row, d5 = column
; Output: None
PrintVal:
        movem.l         d0-d7/a0-a6,-(sp)       ; save registers
        move.w64(sp),d3                         ; d3 = value to be printed
        move.w66(sp),d4                         ; d4 = Row in chart
        move.w68(sp),d5                         ; d5 = column in chart
; compute x coord
        mulu            #PSCFWidth,d5 ; column * width of each field
        add.w   #PSCInitX+24,d5         ; shift over
; compute y coord
        add.w   #1,d4                   ; add 1 to row
        mulu            #PSCFHeight,d4          ; * height of each field
        add.w   #PSCInitY-6,d4          ; shift down and then up a little
; erase whatever is there already.
        lea             TRect,a2                        ; we'll put it in Trect
        move.wd5,2(a2)                          ; our x is the left x
        move.wd5,6(a2)                          ; then compute the right
        add.w   #20,6(a2)                       ; as 20 over from the left
        move.wd4,4(a2)                          ; our y is the bottom y
        move.wd4,(a2)                   ; then compute the top
        sub.w   #PSTxtSize,(a2)         ; as TxtSize up from bottom
        pea             TRect                   ; now erase it
        _EraseRect
; move there
        move.wd5,-(sp)
        move.wd4,-(sp)
        _MoveTo
; convert value to string
        move.wd3,d0             ; NumToString expects val in d0
        lea             NumBuf,a0       ; address of NumBuf in a0
        move.w#0,-(SP)                  ; Select NumToString
        _Pack7
        pea             NumBuf
        _DrawString
        movem.l         (sp)+,d0-d7/a0-a6
        move.l  (sp),6(sp)              ; move return address over parameters
        add.l           #6,sp           ; get rid of parameters
        rts

; Name: WDHAPSIS
; Function: This routine returns a Boolean telling whether or not
; the given window pointer  is the PS window's pointer.
```

```
; Input: A window pointer (passed on the stack)
; Output: a word, TRUE or FALSE (defined in WDHA.hdr) returned on the stack.
; **Note: You do not have to push a word for the result of this routine.
WDHAPSIS:
        movem.l         a4/d4,-(sp)             ; save registers
        move.l          8(sp),a4                ; get return address in a4
        move.l          12(sp),d4               ; get WindowPtr in d4
        cmp.l           WDHAPSPtr,d4            ; Was it our window?
        beq             IS10                    ; It is
        move.w          #FALSE,14(sp)           ; save result
        bra             IS20
IS10:   move.w          #TRUE,14(sp)
IS20:   move.l          a4,10(sp)               ; put return address back
        movem.l         (sp)+,a4/d4             ; restore registers
        tst.w           (sp)+                   ; get rid of extra two bytes
        rts                                     ; return

; Name: WDHAPSControl
; Function: This routine should be called whenever a mousedown event occurs
; within the contents of the PS Window. It handles the hilighting of the
; proper control buttons, and sends the proper records to the WDHA.
; Input: The mouse location (on the stack), from the event's where field.
; Output: None
WDHAPSControl:
        movem.l         d0-d7/a0-a6,-(sp)
        move.l  WDHAPSPtr,-(sp)                 ; WDHAPSPtr on stack
;PROCEDURE   SetPort (gp: GrafPort)
        _SetPort                                ; Make sure it's the current
port

        pea     64(sp)                          ; push address of point
        _GlobalToLocal                          ; convert it to the window's coords
; Was it in a control button?
ButtonCheck:
; call FindControl
        clr.w   -(sp)                           ; returns a long
        move.l  66(sp),-(sp)                    ; push point in local coords
        move.l  WDHAPSPtr,-(sp)                 ; WDHAPSPtr on stack
        pea             WhichControl            ; which one?
        _FindControl
        tst.w   (sp)+                           ; pop result
        lea             WhichControl,a4
        tst.l           (a4)                    ; Was it in any of them?
        beq     ChanCheck                       ; if not try the graph
; if it was in a control, call TrackControl
        clr.w   -(sp)                           ; returns a word
        move.l  WhichControl,-(sp)              ; WhichControl now has the handle
        move.l  70(sp),-(sp)                    ; starting point
        move.l  #0,-(sp)                        ; no action proc
        _TrackControl
        tst.w   (sp)+                           ; did they change the button?
        beq             NoChan                  ; if not then leave
; Was it the output Attenuation button?
        lea             WhichControl,a4
```

```
        move.l  OAControl,d4
        cmp.l   (a4),d4
        bne             NotOA                           ; if not then was it the IA button?

; It was the output attenuation button so adjust the bar heights.
        clr.w   d3                                      ; use d3 as a channel counter
        lea             Theta0,a3
CGLoop11:
        cmp.w   #CHANNELS,d3
        beq             InvBut
        clr.w   -(sp)
        bsr             GOUT
        move.w(a3),d0                           ; get Theta in d0
        sub.w   (sp),d0                         ; subtract the old GOUT from Theta
        move.wd0,(a3)                           ; store Theta
        move.w2(a3),d1                                  ; get phi in d1
        sub.w   (sp)+,d1                                ; subtract the old GOUT from Phi
        move.wd1,2(a3)                                  ; store phi
        lea             4(a3),a3
        add.w   #1,d3
        bra             CGLoop11

InvBut:
        clr.w   -(sp)                           ; GetCtlValue returns a word
        move.l  OAControl,-(sp)
        _GetCtlValue
        move.w(sp)+,d3                                  ; now value is in d3
        not.w   d3
        and.w   #1,d3                           ; invert the status.
        move.l  WhichControl,-(sp)
        move.wd3,-(sp)                                  ; set it to the new value.
        _SetCtlValue

        clr.w   d3                                      ; use d3 as a channel counter
        lea             Theta0,a3
CGLoop12:
        cmp.w   #CHANNELS,d3
        beq             UDScreen
        clr.w   -(sp)
        bsr             GOUT
        move.w(a3),d0                   ; get Theta in d0
        add.w   (sp),d0                 ; add the new GOUT
        move.wd3,-(sp)                          ; now clip the gain as necessary
        move.wd0,-(sp)                          ; the new gain
        bsr             ValidGain
        move.w(sp)+,(a3)                        ; store it
        move.w2(a3),d1                          ; get phi in d1
        add.w   (sp)+,d1                        ; add the new GOUT to Phi
        move.wd3,-(sp)                          ; now clip the limit as necessary
        move.wd1,-(sp)                          ; the new limit
        bsr             ValidLimit
        move.w(sp)+,2(a3)               ; store phi
        lea             4(a3),a3
        add.w   #1,d3
```

```
        bra             CGLoop12
NotOA:
        move.l  IAControl,d4
        lea             WhichControl,a4
        cmp.l   (a4),d4
        bne             OtherBut                        ; if not then forget it.
; It was the input attenuation button so adjust the bar heights.
        clr.w   d3                                      ; use d3 as a channel counter
        lea             Theta0,a3
CGLoop21:
        cmp.w   #CHANNELS,d3
        beq             InvBut2
        clr.w   -(sp)
        bsr             GIN
; the gain (the limit is not affected)
        move.w(a3),d0                           ; get theta
        sub.w   (sp)+,d0                                ; subtract the old GIN
        move.wd0,(a3)                           ; store it back
; go to the next channel
        lea             4(a3),a3
        add.w   #1,d3
        bra             CGLoop21

InvBut2:
        clr.w   -(sp)                           ; GetCtlValue returns a word
        move.l  IAControl,-(sp)
        _GetCtlValue
        move.w(sp)+,d3                                  ; now value is in d3
        not.w   d3
        and.w   #1,d3                           ; invert the status.
        move.l  WhichControl,-(sp)
        move.wd3,-(sp)                                  ; set it to the new value.
        _SetCtlValue

        clr.w   d3                                      ; use d3 as a channel counter
        lea             Theta0,a3
CGLoop22:
        cmp.w   #CHANNELS,d3
        beq             UDScreen
        clr.w   -(sp)
        bsr             GIN
        move.w(a3),d0                   ; get theta
        add.w   (sp)+,d0                        ; add the new GIN
        move.wd3,-(sp)                          ; now clip the gain as necessary
        move.wd0,-(sp)                          ; the new gain
        bsr             ValidGain
        move.w(sp)+,(a3)                        ; store it
; go to the next channel
        lea             4(a3),a3
        add.w   #1,d3
        bra             CGLoop22

UDScreen
        bsr             WDHAPSDraw
```

```
        bra             NoChan

; invert the control value
OtherBut:
        clr.w   -(sp)                   ; GetCtlValue returns a word
        move.l  WhichControl,-(sp)
        _GetCtlValue
        move.w(sp)+,d3                          ; now value is in d3
        not.w   d3
        and.w   #1,d3                   ; invert the status.
        move.l  WhichControl,-(sp)
        move.wd3,-(sp)                          ; set it to the new value.
        _SetCtlValue
; Was it the Field button?
        move.l  FieldControl,d4
        lea             WhichControl,a4
        cmp.l   (a4),d4
        bne             NotField                        ; if not then forget it
; Otherwise invert off the Probe mike
        clr.w   -(sp)                   ; GetCtlValue returns a word
        move.l  ProbeControl,-(sp)
        _GetCtlValue
        move.w(sp)+,d3                          ; now value is in d3
        not.w   d3
        and.w   #1,d3                   ; invert the status
        move.l  ProbeControl,-(sp)
        move.wd3,-(sp)                          ; turn off Probe button
        _SetCtlValue
        bra             NoChan
; Was it the Probe button?
NotField:
        move.l  ProbeControl,d4
        lea             WhichControl,a4
        cmp.l   (a4),d4
        bne             NoChan                  ; if not then forget it
; Otherwise invert the Field mike
        clr.w   -(sp)                   ; GetCtlValue returns a word
        move.l  FieldControl,-(sp)
        _GetCtlValue
        move.w(sp)+,d3                          ; now value is in d3
        not.w   d3
        and.w   #1,d3                   ; invert the status
        move.l  FieldControl,-(sp)
        move.wd3,-(sp)                          ; turn off Probe button
        _SetCtlValue
        bra             NoChan

ChanCheck:
        move.w#0,d4             ; count thru channels
        lea     Theta0,a4
FindChan:                       ; draw each channel
        cmp.w   #CHANNELS,d4    ; done yet?
        beq     NoChan
; Is it a theta bar?
```

```
        move.wd4,-(sp)
        bsr     CalThetaRect            ; Calculate theta rectangle
        clr.w   -(sp)                   ; make room for result
        move.l  66(sp),-(sp)            ; push mouse point
        pea     TRect                   ; theta rect in TRect
        _PtInRect
        tst.w   (sp)+
        bne     FoundTheta
; Is it a phi bar?
        lea     2(a4),a4
        move.wd4,-(sp)
        bsr     CalPhiRect              ; Calculate theta rectangle
        clr.w   -(sp)                   ; make room for result
        move.l  66(sp),-(sp)            ; push mouse point
        pea     TRect
        _PtInRect
        tst.w   (sp)+
        bne     FoundPhi
        lea     2(a4),a4
        add.w   #1,d4
        bra     FindChan

; a4 points to Theta, d4 contains the channel number.
FoundTheta:
        pea     ThetaPat
        _PenPat
        move.w(a4),d3           ; hold onto original theta
; While the button is down move the bar around, changing theta
FTLoop:
        clr.w   -(sp)           ; Make room for result
        _StillDown              ; Is the button still down?
        tst.w   (sp)+
        beq     NoChan          ; If not then exit otherwise...
; Get the point
        pea     TPoint
        _GetMouse                       ; Get mouse location
; First Erase Old Bar
        move.w#patBic,-(sp)
        _PenMode
        move.wd4,-(sp)
        bsr     CalThetaRect
        pea     TRect
        _PaintRect
; Now change the theta parameter
        move.w64(sp),d5                 ; the vertical coordinate of start point
        sub.w   TPoint,d5               ; original y - current y
; this will be a negative value if they move down
        move.wd3,(a4)           ; restore original theta
        add.w   d5,(a4)         ; change theta
; Is it OK?
        move.wd4,-(sp)                          ; channel #
        move.w(a4),-(sp)                        ; gain
        bsr             ValidGain                       ; make sure gain is in range
        move.w(sp)+,(a4)
```

```
; Now draw the new bar
ThDrBar:
        move.w#patOr,-(sp)
        _PenMode
        move.wd4,-(sp)
        bsr     CalThetaRect
        pea     TRect
        _PaintRect
; Now update the chart value.
        cmp.w  (a4),d3 ; is there any difference?
        beq     FTLoop          ; If not then don't bother
        move.w#1,-(sp)          ; gain column in chart
        move.wd4,-(sp)          ; row is channel #
        add.w  #1,(sp); + 1
        move.w(a4),-(sp)        ; value
        bsr     PrintVal
        bra     FTLoop

; a4 points to Phi, d4 contains the channel number.
FoundPhi:
        pea     PhiPat
        _PenPat
        move.w(a4),d3           ; store old Phi
; While the button is down move the bar around, changing theta
FPLoop:
        clr.w   -(sp)           ; Make room for result
        _StillDown              ; Is the button still down?
        tst.w   (sp)+
        beq     NoChan          ; If not then exit otherwise...
; Get the point
        pea     TPoint
        _GetMouse                       ; Get mouse location
; First Erase Old Bar
        move.w#patBic,-(sp)
        _PenMode
        move.wd4,-(sp)
        bsr     CalPhiRect
        pea     TRect
        _PaintRect
; Now change the Phi parameter
        move.w64(sp),d5                 ; the vertical coordinate of start point
        sub.w   TPoint,d5               ; original y - current y
; this will be a negative value if they move down
        move.wd3,(a4)                   ; restore original Phi
        add.w   d5,(a4)                 ; change Phi
; is it OK?
        move.wd4,-(sp)                          ; channel #
        move.w(a4),-(sp)                        ; limit
        bsr             ValidLimit              ; make sure limit in range
        move.w(sp)+,(a4)
; Now draw the new bar
PhiDrBar:
; Now draw the new bar
        move.w#patOr,-(sp)
```

```
        _PenMode
        move.wd4,-(sp)
        bsr     CalPhiRect
        pea     TRect
        _PaintRect
; Now update the chart value.
        cmp.w  (a4),d3 ; is there any difference?
        beq     FPLoop          ; If not then don't bother
        move.w#2,-(sp)          ; limit column in chart
        move.wd4,-(sp)          ; row is channel #
        add.w  #1,(sp); + 1
        move.w(a4),-(sp)        ; value
        bsr     PrintVal
        bra     FPLoop
NoChan:
        _PenNormal
        bsr             WDHAPSSetParam      ; update any changes made to the WDHA.
        movem.l         (sp)+,d0-d7/a0-a6
        move.l  (sp)+,(sp)              ; get rid of param
        rts

; Name: WDHAPSSetParam
; Function: This routine sets the WDHA to the parameters set in the WDHA
; window.
; Input: None
; Output: None
WDHAPSSetParam:
        movem.l         d0-d7/a0-a6,-(sp)     ; save registers
; Fill all fields of the paramrec except the gain/input select word.
        bsr             CalcGainsLimits; calculate the gains and limits.
; Now calculate the select word by looking at the control buttons.
        lea             paramrec,a4           ; get the gain/input select word
        move.w16(a4),d4                       ; get the gain input select word
SPIA:                                         ; set input attenuation bit
        clr.w   -(sp)                   ; GetCtlValue returns a word
        move.l  IAControl,-(sp) ; the handle
        _GetCtlValue
        tst.w   (sp)+
        beq             SPNoIA
SPDoIA:
        bset.l  #INPUT,d4
        bra             SPOA
SPNoIA:
        bclr.l  #INPUT,d4
SPOA:                                         ; set output attenuation bit
        clr.w   -(sp)                   ; GetCtlValue returns a word
        move.l  OAControl,-(sp)         ; the handle
        _GetCtlValue
        tst.w   (sp)+
        beq             SPNoOA
SPDoOA:
        bset.l  #OUTPUT,d4
        bra             SPField
SPNoOA:
```

```
        bclr.l   #OUTPUT,d4
SPField:                                                ; set the field mike bit
        clr.w    -(sp)                  ; GetCtlValue returns a word
        move.l   FieldControl,-(sp)     ; the handle
        _GetCtlValue
        tst.w    (sp)+
        beq              SPNoField
SPDoField:
        bset.l   #FIELD,d4
        bra              SPProbe
SPNoField:
        bclr.l   #FIELD,d4
SPProbe:                                                ; set the probe mike bit
        clr.w    -(sp)                  ; GetCtlValue returns a word
        move.l   ProbeControl,-(sp)     ; the handle
        _GetCtlValue
        tst.w    (sp)+
        beq              SPNoProbe
SPDoProbe:
        bset.l   #PROBE,d4
        bra              SPSendParams
SPNoProbe:
        bclr.l   #PROBE,d4
SPSendParams:
        move.wd4,16(a4)                         ; store the modified select word.

; Now send the parameters to the WDHA
        lea              paramrec,a0
        bsr              SetParam
; now wait a little while the WDHA does it's thing.
        move.l   #10000,d1
SPWait:
        sub.l            #1,d1
        bne              SPWait
; Now put the WDHA in either hearing aid state or idle state depending on
; the status of the "Hearing Aid On" button.
        clr.w    -(sp)                  ; GetCtlValue returns a word
        move.l   AidControl,-(sp)       ; the handle
        _GetCtlValue
        tst.w    (sp)+
        beq              SPAidOff
        move.w#-1,d0                    ; go to hearing aid mode
        bra              SPSetMode
SPAidOff:
        move.w#-100,d0                          ; go to idle mode
SPSetMode:
        jsr      scsiwr                         ;send mode code to WDHA

SPDone:
        movem.l          (sp)+,d0-d7/a0-a6      ; restore registers
        rts

; Name: CalcGainsLimits
; Function: Compute the gains and limits fields of the paramrec from
```

```
; the heights of the theta and phi bars of the bar graph, and the status of
; the attenuation control buttons.
; Input: None
; Output: None
;           If any of the gains or limits produce an out of range value the
;           variable called 'Clipped' will have a non-zero value upon return.
CalcGainsLimits:
        movem.l         a0-a6/d0-d7,-(sp)
        lea             Clipped,a1
        clr.w   (a1)
        lea             Theta0,a4                       ; theta0 here
        lea             paramrec,a2             ; gain0 here
        lea             He,a3
        move.w#CHANNELS,d6          ; loop through four channels
DCLoop:
        move.w(a4),d4               ; get theta0 (= So)
        sub.w   (a3),d4             ; subtract He
        sub.w   8(a3),d4                    ; subtract Hr
        sub.w   #60,d4
        clr.w   -(sp)               ; subtract GIN
        bsr             GIN
        sub.w   (sp)+,d4
        clr.w   -(sp)               ; subtract GOUT
        bsr             GOUT
        sub.w   (sp)+,d4
; Now calculate the limit
DoLimit:
        move.w2(a4),d5                      ; Get height (=So lim) in d5
        sub.w   d4,d5               ; Subtract Gd
        sub.w   8(a3),d5                    ; subtract Hr
        clr.w   -(sp)               ; subtract GOUT
        bsr             GOUT
        sub.w   (sp)+,d5
; Now convert both to linear.
; First the gain
ToLinear:
; but first store Gd and Ld
        move.w          d4,(a6)         ; store Gd
        move.w          d5,2(a6)                ; store Ld
        lea                     arg1,a0
        move.w          d4,(a0)         ; store gain (dB) in arg1
        pea     arg1            ;dB gain
        pea     arg4            ;fpdB gain
        FI2X                    ;convert from integer to extended fp
        pea     fp20dBe         ;20 * log base 10 of e = 8.685889638
        pea     arg4            ;fpdB gain
        fdivx           ;db/fp20dbe (result in arg4)
        pea     arg4
        fexpx           ;base e exponential (db ratio in arg4)
        pea     twoex14         ;scale it *2E16 to convert it to fixed point
        pea     arg4
        fmulx
        pea     arg4
        pea     arg1
```

```
        fx2i                    ;convert extended to integer
        move.warg1,(a2)         ; store the gain
        move.warg1,d1           ; get the gain
        cmp.w  #16384,d1
        bls             DCDoLimit
        move.w#16384,(a2)       ; store the gain
        lea             Clipped,a1
        add.w  #1,(a1)
; Now the limit
DCDoLimit:
        lea                     arg1,a0
        move.w          d5,(a0)         ; store limit (dB) in arg1
        pea     arg1            ;dB limit
        pea     arg4            ;fpdB limit
        FI2X                    ;convert from integer to extended fp
        pea     fp20dBe         ;20 * log base 10 of e = 8.685889638
        pea     arg4            ;fpdB limit
        fdivx           ;db/fp20dbe (result in arg4)
        pea     arg4
        fexpx           ;base e exponential (db ratio in arg4)
        pea     arg4
        pea     arg1
        pea     twoex14         ;scale it *2E16 to convert it to fixed point
        pea     arg4
        fmulx
        fx2i                    ;convert extended to integer
        move.warg1,2(a2)        ; store the limit
        bpl             DCFinLoop
        move.w#32767,2(a2)
; Store them in the paramrec
DCFinLoop:
        lea             4(a4),a4                        ; go to next theta/phi pair.
        lea             4(a2),a2                        ; go to next gain/limit pair
        lea             2(a3),a3                        ; go to next He and Hr
        subq.b  #1,d6
        bne             DCLoop
        movem.l         (sp)+,a0-a6/d0-d7
        rts

; Name: GIN
; Function: This routine returns the input gain as determined by the
;  input attenuation control button, either +0 (on), or +18 (off).
; Input: None
; Output: A word on the stack is filled with the result (the user pushes this)
GIN:    movem.l         a0-a6/d0-d7,-(sp)
; if input attenuation is on then return 0 otherwise 18
        clr.w   -(sp)                   ; make room for result
        move.l  IAControl,-(sp)
        _GetCtlValue
        tst.w   (sp)+
        bne             GinOn
        move.w#18,64(sp)
        bra             GinDone
GinOn
```

```
        move.w#0,64(sp)
GinDone
        movem.l                 (sp)+,a0-a6/d0-d7
        rts

; Name: GOUT
; Function: This routine returns the output gain as determined by the
;  output attenuation control button, either -34 (on), or -9 (off).
; Input: None
; Output: A word on the stack is filled with the result (the user pushes this)
GOUT:  movem.l          a0-a6/d0-d7,-(sp)
; if output gain is on then return -34 otherwise -9
        clr.w   -(sp)                   ; make room for result
        move.l OAControl,-(sp)
        _GetCtlValue
        tst.w   (sp)+
        bne             GoutOn
        move.w#-9,64(sp)
        bra             GoutDone
GoutOn
        move.w#-34,64(sp)
GoutDone
        movem.l                 (sp)+,a0-a6/d0-d7
        rts

; Name: GMAX
; Function: This routine returns the maximum gain for the given channel.
; Input: The channel number is passed on the stack as a word (0-3).
; Output: The result is on the stack upon return.
; ***Note: You do not have to make room for the result on the stack.
GMAX:
        movem.l         a0-a6/d0-d7,-(sp)
        move.w#60,d0 ; hold result in d0
        clr.w   -(sp)
        bsr             GIN
        add.w   (sp)+,d0        ; add GIN
        clr.w   -(sp)
        bsr             GOUT
        add.w   (sp)+,d0        ; add GOUT
        lea             He,a0
        move.w64(sp),d1         ; get channel #
        asl.w   #1,d1   ; *2 for words
        add.w   (a0,d1.w),d0    ; add He
        add.w   8(a0,d1.w),d0   ; add Hr
        move.wd0,64(sp)         ; write the result over the parameter
        movem.l         (sp)+,a0-a6/d0-d7
        rts

; Name: ValidGain
; Function: This routine clips the given gain (bar height) as needed for the
;    given channel.
; Input: The channel number and gain passed on the stack as words.
; Output: The result is on top of the stack upon return.
; ***Note: You do not have to make room for the result on the stack.
```

```
ValidGain:
        movem.l         a0-a6/d0-d7,-(sp)
        move.w66(sp),d0                 ; get the channel #
        move.w64(sp),d1                 ; get the unclipped gain
        cmp.w  #2,d1            ; IS it bigger than the minimum height?
        bge             GainOK1
        move.w#2,d1             ; make it bigger
        bra             VGDone
GainOK1:
        move.wd0,-(sp)                  ; get GMAX
        bsr             GMAX
        cmp.w  (sp)+,d1
        ble             VGDone
        move.w-2(sp),d1                 ; make it GMAX
VGDone:
        move.wd1,66(sp)
        movem.l         (sp)+,a0-a6/d0-d7
        move.l (sp),2(sp)               ; move return address
        tst.w   (sp)+           ; get rid of extra word
        rts

; Name: LMAX
; Function: This routine returns the maximum limit for the given channel.
; Input: The channel number is passed on the stack as a word (0-3).
; Output: The result is on the stack upon return.
; ***Note: You do not have to make room for the result on the stack.
LMAX:
        movem.l         a0-a6/d0-d7,-(sp)
        clr.w   -(sp)
        bsr             GOUT
        move.w(sp)+,d0          ; add GOUT
        lea             Hr,a0
        move.w64(sp),d1         ; get channel #
        asl.w   #1,d1  ; *2 for words
        add.w   (a0,d1.w),d0    ; add Hr
        move.wd0,64(sp)         ; write the result over the parameter
        movem.l         (sp)+,a0-a6/d0-d7
        rts

; Name: ValidLimit
; Function: This routine clips the given limit (bar height) as needed for the
;     given channel.
; Input: The channel number and gain passed on the stack as words.
; Output: The result is on top of the stack upon return.
; ***Note: You do not have to make room for the result on the stack.
ValidLimit:
        movem.l         a0-a6/d0-d7,-(sp)
        move.w66(sp),d0                 ; get the channel #
        move.w64(sp),d1                 ; get the unclipped limit
        cmp.w  #2,d1            ; IS it bigger than the minimum height?
        bge             LimitOK1
        move.w#2,d1             ; make it bigger
        bra             VLDone
LimitOK1:
```

```
        move.wd0,-(sp)                  ; get LMAX
        bsr             LMAX
        cmp.w  (sp)+,d1
        ble             VLDone
        move.w-2(sp),d1                 ; make it LMAX
VLDone:
        move.wd1,66(sp)
        movem.l         (sp)+,a0-a6/d0-d7
        move.l  (sp),2(sp)              ; move return address
        tst.w   (sp)+           ; get rid of extra word
        rts


;  -------------WDHAPS   data   declarations----------------------------
.align   4        ; align to long word boundary
WDHAPSPtr:   DC.L   0        ; WDHAPS WindowPtr
AidControl:  DC.L   0        ; Hearing Aid On Control
IAControl:   DC.L   0        ; Input Attenuation Control
OAControl:   DC.L   0        ; Output Attenuation
FieldControl:  DC.L   0      ; Field Mike Control
ProbeControl:  DC.L   0      ; Probe Mike Control

.align   2        ; align to word boundary
Theta0: DC.W   50
Phi0:   DC.W   70
Theta1: DC.W   50
Phi1:   DC.W   70
Theta2: DC.W   50
Phi2:   DC.W   70
Theta3: DC.W   50
Phi3:   DC.W   70

paramrec:                       ;WDHA parameter record
                dc.w    16384  ;channel 0 gain
                dc.w    32767  ;channel 0 limit
                dc.w    16384  ;channel 1 gain
                dc.w    32767  ;channel 1 limit
                dc.w    16384  ;channel 2 gain
                dc.w    32767  ;channel 2 limit
                dc.w    16384  ;channel 3 gain
                dc.w    32767  ;channel 3 limit
                dc.w     4224  ;gain/input select word

He:
                dc.w    -100   ;channel 0
                dc.w    -95            ;channel 1
                dc.w    -90            ;channel 2
                dc.w    -84            ;channel 3

; The He table must(!) follow the He table.
Hr:
                dc.w    121    ;channel 0
                dc.w    117    ;channel 1
                dc.w    127    ;channel 2
```

```
            dc.w    120     ;channel 3

WDHAPSBounds:                       ; Bounding rect for window
            DC.W    PSInitY
            DC.W    PSInitX
            DC.W    PSInitY+PSGHeight+PSGInitY+2*PSTxtSize+4
            DC.W    PSRight

WDHAPSGraph:
                        ; bounding rectangle for graph
            DC.W    PSGInitY
            DC.W    PSGInitX
            DC.W    PSGInitY+PSGHeight
            DC.W    PSGInitX+PSGWidth

WDHAPSChart:
                        ; bounding rectangle for chart
            DC.W    PSCInitY
            DC.W    PSCInitX
            DC.W    PSCInitY+PSGHeight
            DC.W    PSCInitX+PSCWidth

TRect:
            DC.L    0
            DC.L    0       ;For calculating various rectangles.

TPoint:     DC.L    0       ;For calculating mouse change.

WhichControl:  DC.L  0      ; A control handle, for temporary storage.

ThetaPat:   DC.B    $AA,$55,$AA,$55,$AA,$55,$AA,$55
PhiPat:     DC.B    $55,$AA,$55,$AA,$55,$AA,$55,$AA

NumBuf:     DCB.B   64,0    ; Buffer for number conversion

arg1                dcb.w   8,0     ;integer buffer
arg2                dcb.w   8,0     ;extended floating point buffer
arg3                dcb.w   8,0     ;extended floating point buffer
arg4                dcb.w   8,0     ;extended floating point buffer
arg5                dcb.w   8,0     ;extended floating point buffer
twoex14             dc.w    $400d,$8000,$0000,$0000,$0000
fp20dBe             dc.w    $4002,$8af9,$db22,$d0e5,$6042

Clipped     dc.w            0
```

```
; WDHAPS.hdr
; This file must be included if your program uses the
; WDHA Parameter Settings window.
        XREF    WDHAPSOpen
        XREF    WDHAPSClose
        XREF    WDHAPSShow
        XREF    WDHAPSHide
        XREF    WDHAPSDraw
        XREF    WDHAPSControl
        XREF    WDHAPSIS
        XREF    WDHAPSSetParam
```

```
; file WDHATC.Asm

Include MacTraps.D
Include ToolEqu.D
Include SysEquX.D
Include QuickEquX.D
Include SANEMacs.txt
Include MDS2:WDHA.hdr
Include MDS2:WDHAMac.txt
Include MDS2:WDHASCSI.hdr

;-----------------------------------------------------------------
; WDHA Test/Calibrate Window Manager
;       This package contains routines to manipulate the WDHA Test/Calibrate
; window, which allows you to do pure tone audiometry via the WDHA.
;       The window contains text boxes which allow the user to change the
; parameters to the test procedure, as well as the control boxes (as in the
; parameter settings window) to determine the gain/select input word and
; the on/off status of the hearing aid.

;   --------------------External   Definitions----------------------------

        XDEF    WDHATCOpen
        XDEF    WDHATCClose
        XDEF    WDHATCShow
        XDEF    WDHATCHide
        XDEF    WDHATCDraw
        XDEF    WDHATCControl
        XDEF    WDHATCIdle
        XDEF    WDHATCKey
        XDEF    WDHATCIS
        XDEF    WDHATCDoTest

;   --------------------  Constant   Definitions  --------------------------

; TC = The Test/Calibrate Window
TCInitX EQU     30      ; initial X coord (global) of upper left corner
TCInitY EQU     50      ; initial Y coord (global) of upper left corner
TCRightEQU      448
TCTxtSize       EQU     12

; TCCtl = The Control Buttons
TCCtlInitX      EQU     258
TCCtlInitY      EQU     15
TCCtlFHeight    EQU     24

; Text Edit Box Constants
ToneBursts      EQU     0
RiseCount               EQU     1
OnCount                 EQU     2
FallCount               EQU     3
OffCount                EQU     4
Frequency               EQU     5
Attenuate               EQU     6
```

```
TextBoxes       EQU     7       ; There are seven boxes

;--------------------Subroutine    Declarations------------------------
; Name: WDHATCOpen
; Function: Call this routine to create and display the TC Window.
; Input: None
; Output: None
WDHATCOpen:
        movem.l         d0-d2/a0-a6,-(sp)               ; save registers
; Set up document window.
        ; FUNCTION      NewWindow (wStorage: Ptr; boundsRect: Rect;
        ;                                 title: Str255; visible: BOOLEAN;
        ;                                procID: INTEGER; behind: WindowPtr;
        ;                               goAwayFlag: BOOLEAN;
        ;                                 refCon: LongInt) : WindowPtr;
        SUBQ            #4,SP                   ; Space for function result
        CLR.L           -(SP)                   ; Storage for window (Heap)
        PEA             WDHATCBounds            ; Window position
        PEA             'WDHA  Test/Calibrate'  ; Window title
        MOVE.B          #255,-(SP)              ; Make window visible
        MOVE            #rDocProc,-(SP)         ; Standard document window
        MOVE.L          #-1,-(SP)               ;Make it the front window
        move.B          #-1,-(SP)               ; Window has goAway button
        CLR.L           -(SP)                   ; Window refCon
        _NewWindow                              ; Create and draw window
        lea                     WDHATCPtr,a4
        MOVE.L          (SP)+,(a4)              ; Save handle for later
        MOVE.L          (a4),-(SP)              ; Make sure the new window is the port
;PROCEDURE   SetPort (gp: GrafPort)
        _SetPort                        ; Make it the current port
; Add the text boxes.
        bsr             TCAddBoxes
; Add the control buttons.
        bsr             TCAddControls
; Draw the content region
        bsr             WDHATCDraw
        movem.l                 (sp)+,d0-d2/a0-a6       ; Restore registers
        RTS

; Name: WDHATCClose
; Function: Call this routine to destroy the TC Window and remove it from
; the screen.
; Input: None
; Output: None
WDHATCClose:
        movem.l         d0-d7/a0-a6,-(sp)       ; save registers
        move.l  WDHATCPtr,-(sp)
        _KillControls
; Dispose Window
        move.l  WDHATCPtr,-(sp)
        _DisposWindow
        movem.l         (sp)+,d0-d7/a0-a6       ; restore registers
        rts
```

```
; Name: WDHATCShow
; Function: This routine makes the TC window visible and frontmost.
; Input: None
; Output: None
WDHATCShow:
        movem.l         d0-d7/a0-a6,-(sp)       ; save registers
; Bring it to the front
        move.l  WDHATCPtr,-(sp)
        _BringToFront
; Show Window
        move.l  WDHATCPtr,-(sp)
        _ShowWindow
        move.l  WDHATCPtr,-(sp)
        _SelectWindow
        movem.l         (sp)+,d0-d7/a0-a6       ; restore registers
        rts

; Name: WDHATCHide
; Function: This routine makes the TC window invisible, removing it from the
; screen (but not destroying it).
; Input: None
; Output: None
WDHATCHide:
        movem.l         d0-d7/a0-a6,-(sp)       ; save registers
; Hide Window
        move.l  WDHATCPtr,-(sp)
        _HideWindow
        movem.l         (sp)+,d0-d7/a0-a6       ; restore registers
        rts

; Name: WDHATCDraw
; Function: This routine draws the TC window's contents.
; Input: None
; Output: None
WDHATCDraw:
        movem.l         d0-d7/a0-a6,-(sp)       ; save registers
        lea     WDHATCPtr,a4            ; Pointer on stack
        MOVE.L (a4),-(SP)
;PROCEDURE   SetPort (gp: GrafPort)
        _SetPort                        ; Make it the current port
; Draw the text buttons.
        bsr             TCDrawBoxes
; Draw the control buttons.
        move.l  WDHATCPtr,-(sp)         ; the window ptr
        _DrawControls
        movem.l         (sp)+,d0-d7/a0-a6       ; restore registers
        rts

; Name: TCAddControls
; Function: This routine adds the  TC window's controls.
; Input: None
; Output: None
TCAddControls:
        movem.l         d0-d7/a0-a6,-(sp)       ; save registers
```

```
; Set up the controls bounding rectangle.
        lea             TRect,a4
        move.w#TCCtlInitY+0*TCCtlFHeight,(a4)       ; store y coord
        move.w#TCCtlInitX,2(a4)       ; store x coord
        move.w#TCCtlInitY+0*TCCtlFHeight+20,4(a4)          ; store y coord
        move.w#TCRight,6(a4)                  ; store x coord
; Push parameters for NewControl
        clr.l           -(sp)                 ; NewControl returns a handle
        move.l WDHATCPtr,-(sp)        ; the window ptr
        pea             TRect                 ; the rectangle bounding the control
        pea             'Hearing Aid On'      ; title
        move.b #TRUE,-(sp)            ; visible
        move.w#0,-(sp)                        ; value
        move.w#0,-(sp)                        ; min
        move.w#1,-(sp)                        ; max
        move.w#1,-(sp)                        ; check box proc id
        move.l #0,-(sp)                       ; refcon not used
; Call NewControl
        _NewControl
        lea             AidControl,a3
        move.l (sp)+,(a3)                     ; store the result
; Set up the controls bounding rectangle.
        lea             TRect,a4
        move.w#TCCtlInitY+1*TCCtlFHeight,(a4)       ; store y coord
        move.w#TCCtlInitX,2(a4)       ; store x coord
        move.w#TCCtlInitY+1*TCCtlFHeight+20,4(a4)          ; store y coord
        move.w#TCRight,6(a4)                  ; store x coord
; Push parameters for NewControl
        clr.l           -(sp)                 ; NewControl returns a handle
        move.l WDHATCPtr,-(sp)        ; the window ptr
        pea             TRect                 ; the rectangle bounding the control
        pea             'Input Attenuation'   ; title
        move.b #TRUE,-(sp)            ; visible
        move.w#0,-(sp)                        ; value
        move.w#0,-(sp)                        ; min
        move.w#1,-(sp)                        ; max
        move.w#1,-(sp)                        ; check box proc id
        move.l #0,-(sp)                       ; refcon not used
; Call NewControl
        _NewControl
        lea             IAControl,a3
        move.l (sp)+,(a3)                     ; store the result
; Set up the controls bounding rectangle.
        lea             TRect,a4
        move.w#TCCtlInitY+2*TCCtlFHeight,(a4)       ; store y coord
        move.w#TCCtlInitX,2(a4)       ; store x coord
        move.w#TCCtlInitY+2*TCCtlFHeight+20,4(a4)          ; store y coord
        move.w#TCRight,6(a4)                  ; store x coord
; Push parameters for NewControl
        clr.l           -(sp)                 ; NewControl returns a handle
        move.l WDHATCPtr,-(sp)        ; the window ptr
        pea             TRect                 ; the rectangle bounding the control
        pea             'Output Attenuation'  ; title
        move.b #TRUE,-(sp)            ; visible
```

```
        move.w#0,-(sp)                          ; value
        move.w#0,-(sp)                          ; min
        move.w#1,-(sp)                          ; max
        move.w#1,-(sp)                          ; check box proc id
        move.l  #0,-(sp)                        ; refcon not used
; Call NewControl
        _NewControl
        lea             OAControl,a3
        move.l  (sp)+,(a3)                      ; store the result
; Set up the controls bounding rectangle.
        lea             TRect,a4
        move.w#TCCtlInitY+3*TCCtlFHeight,(a4)       ; store y coord
        move.w#TCCtlInitX,2(a4)         ; store x coord
        move.w#TCCtlInitY+3*TCCtlFHeight+20,4(a4)         ; store y coord
        move.w#TCRight,6(a4)                    ; store x coord
; Push parameters for NewControl
        clr.l           -(sp)                   ; NewControl returns a handle
        move.l  WDHATCPtr,-(sp)         ; the window ptr
        pea             TRect                   ; the rectangle bounding the control
        pea             'Field Mike'            ; title
        move.b #TRUE,-(sp)              ; visible
        move.w#1,-(sp)                          ; make Field mike on as the default
        move.w#0,-(sp)                          ; min
        move.w#1,-(sp)                          ; max
        move.w#2,-(sp)                          ; radio button proc id
        move.l  #0,-(sp)                        ; refcon not used
; Call NewControl
        _NewControl
        lea             FieldControl,a3
        move.l  (sp)+,(a3)                      ; store the result
; Set up the controls bounding rectangle.
        lea             TRect,a4
        move.w#TCCtlInitY+4*TCCtlFHeight,(a4)       ; store y coord
        move.w#TCCtlInitX,2(a4)         ; store x coord
        move.w#TCCtlInitY+4*TCCtlFHeight+20,4(a4)         ; store y coord
        move.w#TCRight,6(a4)                    ; store x coord
; Push parameters for NewControl
        clr.l           -(sp)                   ; NewControl returns a handle
        move.l  WDHATCPtr,-(sp)         ; the window ptr
        pea             TRect                   ; the rectangle bounding the control
        pea             'Probe Mike'            ; title
        move.b #TRUE,-(sp)              ; visible
        move.w#0,-(sp)                          ; value
        move.w#0,-(sp)                          ; min
        move.w#1,-(sp)                          ; max
        move.w#2,-(sp)                          ; radio button proc id
        move.l  #0,-(sp)                        ; refcon not used
; Call NewControl
        _NewControl
        lea             ProbeControl,a3
        move.l  (sp)+,(a3)                      ; store the result
; Set up the controls bounding rectangle.
        lea             TRect,a4
        move.w#TCCtlInitY+5*TCCtlFHeight,(a4)       ; store y coord
```

```
        move.w#TCCtlInitX,2(a4)                          ; store x coord
        move.w#TCCtlInitY+5*TCCtlFHeight+24,4(a4) ; store y coord
        move.w#TCCtlInitX+40,6(a4)                ; store x coord
; Push parameters for NewControl
        clr.l           -(sp)                     ; NewControl returns a handle
        move.l WDHATCPtr,-(sp)        ; the window ptr
        pea             TRect                     ; the rectangle bounding the control
        pea             'Start'           ; title
        move.b #TRUE,-(sp)            ; visible
        move.w#0,-(sp)                            ; value
        move.w#0,-(sp)                            ; min
        move.w#0,-(sp)                            ; max
        move.w#0,-(sp)                            ; simple button proc id
        move.l #0,-(sp)                           ; refcon not used
; Call NewControl
        _NewControl
        lea             StartControl,a3
        move.l (sp)+,(a3)                         ; store the result
        movem.l         (sp)+,d0-d7/a0-a6
        rts

TCAddBoxes:
        movem.l         d0-d7/a0-a6,-(sp)
        lea             TextHandles,a3
        lea             TextRects,a4
        move.w#ToneBursts,d4
TCABLoop:
        cmp.w  #TextBoxes,d4
        beq             TCABDone
; TENew
; Get Destination Rect in TRect
        lea             TRect,a2
        move.l (a4),(a2)
        move.l 4(a4),4(a2)
; Make it a little smaller
        pea             TRect
        move.w#1,-(sp)
        move.w#1,-(sp)
        _InsetRect
; Call TENew
        clr.l           -(sp)                     ; make room for handle result
        pea             TRect                     ; dest rect
        pea             TRect                     ; view rect
        _TENew
        move.l (sp)+,(a3)+
        lea             8(a4),a4
        add.w  #1,d4
        bra             TCABLoop
TCABDone:
        lea             TextHandles,a4
; Default Tone Burst is 3
        pea             '3'                               ; incorporate the text
        add.l           #1,(sp)                   ; move past the length
        move.l #1,-(sp)                           ; It's 1 character long
```

```
        move.l  (a4)+,-(sp)
        _TEInsert
; Default Rise Time is 309
        pea             '309'                   ; incorporate the text
        add.l           #1,(sp)                 ; move past the length
        move.l  #3,-(sp)                        ; It's 3 characters long
        move.l  (a4)+,-(sp)
        _TEInsert
; Default Signal On is 2455
        pea             '2455'                  ; incorporate the text
        add.l           #1,(sp)                 ; move past the length
        move.l  #4,-(sp)                        ; It's 4 characters long
        move.l  (a4)+,-(sp)
        _TEInsert
; Default Fall Time is 309
        pea             '309'                   ; incorporate the text
        add.l           #1,(sp)                 ; move past the length
        move.l  #3,-(sp)                        ; It's 3 characters long
        move.l  (a4)+,-(sp)
        _TEInsert
; Default Signal Off is 3069
        pea             '3069'                  ; incorporate the text
        add.l           #1,(sp)                 ; move past the length
        move.l  #4,-(sp)                        ; It's 4 characters long
        move.l  (a4)+,-(sp)
        _TEInsert
; Default Frequency is 2000
        pea             '2000'                  ; incorporate the text
        add.l           #1,(sp)                 ; move past the length
        move.l  #4,-(sp)                        ; It's 4 characters long
        move.l  (a4)+,-(sp)
        _TEInsert
; Default Attenuation is 20
        pea             '20'                    ; incorporate the text
        add.l           #1,(sp)                 ; move past the length
        move.l  #2,-(sp)                        ; It's 2 characters long
        move.l  (a4)+,-(sp)
        _TEInsert
        movem.l         (sp)+,d0-d7/a0-a6
        rts

; Name: WDHATCIdle
; Function: This routine blinks the caret of the active text box.  It should be
; called each time through your main event loop.
; Input: None
; Output: None
WDHATCIdle:
        movem.l         a0-a6/d0-d7,-(sp)
        lea             TextHandles,a4
        move.w WActive,d4               ; which one is active?
        bmi             TCINoneActive           ; -1 means none
        asl.w   #2,d4                   ; *4 for long offset
        move.l  (a4,d4.w),-(sp)
        _TEIdle
```

```
TCINoneActive:
        movem.l         (sp)+,a0-a6/d0-d7
        rts

; Name:WDHATCKey
; Function: Call WDHATCKey when the TC window is active and a keypress
; event is active.
; Input: The char (from the event's message field) as a word.
; Output: None
WDHATCKey:
        movem.l         a0-a6/d0-d7,-(sp)
        lea             TextHandles,a4
        move.w WActive,d4               ; which one is active?
        bmi             TCKNoneActive           ; -1 means none
        asl.w   #2,d4                   ; *4 for long offset
        move.w 64(sp),-(sp)             ; push the char
        move.l  (a4,d4.w),-(sp)
        _TEKey
TCKNoneActive:
        movem.l         (sp)+,a0-a6/d0-d7
; remove parameter from stack
        move.l  (sp),2(sp)                      ; move return address
        clr.w   (sp)+                   ; remove extra space
        rts

; Name: WDHATCIS
; Function: This routine returns a Boolean telling whether or not
; the given window pointer  is the TC window's pointer.
; Input: A window pointer (passed on the stack)
; Output: a word, TRUE or FALSE (defined in WDHA.hdr) returned on the stack.
; **Note: You do not have to push a word for the result of this routine.
WDHATCIS:
        movem.l                 a4/d4,-(sp)             ; save registers
        move.l          8(sp),a4                        ; get return address in a4
        move.l          12(sp),d4                       ; get WindowPtr in d4
        cmp.l           WDHATCPtr,d4            ; Was it our window?
        beq                     IS10                            ; It is
        move.w          #FALSE,14(sp)           ; save result
        bra                     IS20
IS10:
        move.w          #TRUE,14(sp)
IS20:
        move.l          a4,10(sp)                       ; put return address back
        movem.l                 (sp)+,a4/d4             ; restore registers
        tst.w           (sp)+                   ; get rid of extra two bytes
        rts                                                     ; return

; Name: WDHATCControl
; Function: This routine should be called whenever a mousedown event occurs
; within the contents of the TC Window.  It handles the hilighting of the
; proper control buttons, and sends the proper records to the WDHA.
; Input: The mouse location (on the stack), from the event's where field.
; Output: None
WDHATCControl:
```

```
        movem.l         d0-d7/a0-a6,-(sp)
        move.l  WDHATCPtr,-(sp)                 ; WDHATCPtr on stack
;PROCEDURE   SetPort (gp: GrafPort)
        _SetPort                                        ; Make sure it's the current
port

        pea     64(sp)                                  ; push address of point
        _GlobalToLocal                          ; convert it to the window's coords
; Was it in a control button?
ButtonCheck:
; call FindControl
        clr.w   -(sp)                           ; returns a long
        move.l  66(sp),-(sp)                    ; push point in local coords
        move.l  WDHATCPtr,-(sp)                 ; WDHATCPtr on stack
        pea             WhichControl                    ; which one?
        _FindControl
        tst.w   (sp)+                           ; pop result
        lea             WhichControl,a4
        tst.l           (a4)                            ; Was it in any of them?
        beq     TBCheck                                 ; if not try the text boxes
; if it was in a control, call TrackControl
        clr.w   -(sp)                           ; returns a word
        move.l  WhichControl,-(sp)                      ; WhichControl now has the handle
        move.l  70(sp),-(sp)                    ; starting point
        move.l  #0,-(sp)                                ; no action proc
        _TrackControl
        tst.w   (sp)+                           ; did they change the button?
        beq             NoChan                          ; if not then leave
; Was it the Start Button?
        move.l  StartControl,d4
        lea             WhichControl,a4
        cmp.l   (a4),d4
        bne             InvControl                      ; if not then forget it
        bsr             WDHATCDoTest            ; otherwise do the test
        bra             NoChan                          ; and leave
; invert the control value
InvControl:
        clr.w   -(sp)                           ; GetCtlValue returns a word
        move.l  WhichControl,-(sp)
        _GetCtlValue
        move.w(sp)+,d3                                  ; now value is in d3
        not.w   d3
        and.w   #1,d3                           ; invert the status
        move.l  WhichControl,-(sp)
        move.wd3,-(sp)                                  ; set button
        _SetCtlValue
; Was it the Field button?
        move.l  FieldControl,d4
        lea             WhichControl,a4
        cmp.l   (a4),d4
        bne             NotField                        ; if not then forget it
; Otherwise invert the Probe mike
        clr.w   -(sp)                           ; GetCtlValue returns a word
        move.l  ProbeControl,-(sp)
```

```
        _GetCtlValue
        move.w(sp)+,d3                          ; now value is in d3
        not.w   d3
        and.w   #1,d3                           ; invert the status
        move.l  ProbeControl,-(sp)
        move.wd3,-(sp)                          ; turn off Probe button
        _SetCtlValue
        bra             NoChan
; Was it the Probe button?
NotField:
        move.l  ProbeControl,d4
        lea             WhichControl,a4
        cmp.l   (a4),d4
        bne             NoChan                  ; if not then forget it
; Otherwise invert the Field mike
        clr.w   -(sp)                           ; GetCtlValue returns a word
        move.l  FieldControl,-(sp)
        _GetCtlValue
        move.w(sp)+,d3                          ; now value is in d3
        not.w   d3
        and.w   #1,d3                           ; invert the status
        move.l  FieldControl,-(sp)
        move.wd3,-(sp)                          ; turn off Probe button
        _SetCtlValue
        bra             NoChan
TBCheck:
        lea             TextRects,a4
        move.w#ToneBursts,d4
TBCLoop:
        cmp.w   #TextBoxes,d4
        beq             NoChan
        clr.w   -(sp)                           ; make room for result.
        move.l  66(sp),-(sp)                    ; push the mouse point.
        move.l  a4,-(sp)                        ; the text boxes rectangle.
        _PtInRect                               ; is the point inside.
        tst.w   (sp)+                           ; If so we've found the right one.
        bne             TBFound
        lea             8(a4),a4                ; Otherwise move to next rect.
        add.w   #1,d4                           ; increment the counter
        bra             TBCLoop
TBFound:
; Deactivate old active box
        lea             TextHandles,a3
        lea             WActive,a4
        move.w(a4),d3                           ; Get old active one
        bmi             TBNoneActive
        asl.w   #2,d3                           ; * 4 for long words
        move.l  (a3,d3.w),-(sp)
        _TEDeactivate
TBNoneActive
        move.wd4,(a4)                           ; store new active one
        asl.w   #2,d4                           ; counter * 4 since long words.
        move.l  (a3,d4.w),-(sp)                 ; push the TEHandle
        _TEActivate
```

```
        move.l  64(sp),-(sp)                    ; push the point
        clr.w   -(sp)                           ; don't extend
        move.l  (a3,d4.w),-(sp)                         ; push the TEHandle
        _TEClick
NoChan:
        _PenNormal
        movem.l         (sp)+,d0-d7/a0-a6
        move.l  (sp)+,(sp)              ; get rid of param
        rts

; Name: TCDrawBoxes
; Function: TCDrawBoxes draws the text box portion of the TC window,
; including the headings and the text boxes themselves.
; Input: None
; Output: None
TCDrawBoxes:
        movem.l         d0-d7/a0-a6,-(sp)
        pea             ERect           ; erase the input portion of the window
        _EraseRect
        lea             TextRects,a4
        lea             TextHandles,a3
        move.w#TCCtlInitY+16,d3                 ; initial y coord
        DispString      #10,d3,Tone burst count?
        pea             0(a4)
        _FrameRect
        pea             ERect
        move.l  0(a3),-(sp)
        _TEUpdate
        add.w   #20,d3          ; move down
        DispString      #10,d3,Rise time sample count?
        pea             8(a4)
        _FrameRect
        pea             ERect
        move.l  4(a3),-(sp)
        _TEUpdate
        add.w   #20,d3          ; move down
        DispString      #10,d3,Signal on sample count?
        pea             16(a4)
        _FrameRect
        pea             ERect
        move.l  8(a3),-(sp)
        _TEUpdate
        add.w   #20,d3          ; move down
        DispString      #10,d3,Fall time sample count?
        pea             24(a4)
        _FrameRect
        pea             ERect
        move.l  12(a3),-(sp)
        _TEUpdate
        add.w   #20,d3          ; move down
        DispString      #10,d3,Signal off sample count?
        pea             32(a4)
        _FrameRect
        pea             ERect
```

```
        move.l  16(a3),-(sp)
        _TEUpdate
        add.w   #20,d3          ; move down
        DispString      #10,d3,Frequency?
        pea             40(a4)
        _FrameRect
        pea             ERect
        move.l  20(a3),-(sp)
        _TEUpdate
        add.w   #20,d3          ; move down
        DispString      #10,d3,Atten re max out (dB)?
        pea             48(a4)
        _FrameRect
        pea             ERect
        move.l  24(a3),-(sp)
        _TEUpdate
        add.w   #20,d3          ; move down
        DispValue       #10,d3,Power = ,PDecimal
        pea             '.'
        _DrawString
        lea             KeyBuf,a0
        move.l  PFract,d0
        move.w#0,-(SP)                  ;Select NumToString
        _Pack7
        pea     KeyBuf
        _DrawString
        movem.l         (sp)+,d0-d7/a0-a6
        rts

; Name: WDHATCDoTest
; Function: WDHATCDoTest fills the paramrec with the proper values
; initiates the WDHA test by sending the paramrec out via the routine
; wdhatest.
; Input: None
; Output: None
WDHATCDoTest
        movem.l         d0-d7/a0-a6,-(sp)       ; save registers
        lea             paramrec,a4             ; get the gain/input select word
; generate the gain/input select word
        move.w14(a4),d4                         ; get the gain input select word in d0
TCIA:                                           ; set input attenuation bit
        clr.w   -(sp)                   ; GetCtlValue returns a word
        move.l  IAControl,-(sp) ; the handle
        _GetCtlValue
        tst.w   (sp)+
        beq             TCNoIA
TCDoIA:
        bset.l  #INPUT,d4
        bra             TCOA
TCNoIA:
        bclr.l  #INPUT,d4
TCOA:                                           ; set output attenuation bit
        clr.w   -(sp)                   ; GetCtlValue returns a word
        move.l  OAControl,-(sp)         ; the handle
```

```
        _GetCtlValue
        tst.w   (sp)+
        beq             TCNoOA
TCDoOA:
        bset.l  #OUTPUT,d4
        bra             TCField
TCNoOA:
        bclr.l  #OUTPUT,d4
TCField:                                        ; set the field mike bit
        clr.w   -(sp)                   ; GetCtlValue returns a word
        move.l  FieldControl,-(sp)      ; the handle
        _GetCtlValue
        tst.w   (sp)+
        beq             TCNoField
TCDoField:
        bset.l  #FIELD,d4
        bra             TCProbe
TCNoField:
        bclr.l  #FIELD,d4
TCProbe:                                        ; set the probe mike bit
        clr.w   -(sp)                   ; GetCtlValue returns a word
        move.l  ProbeControl,-(sp)      ; the handle
        _GetCtlValue
        tst.w   (sp)+
        beq             TCNoProbe
TCDoProbe:
        bset.l  #PROBE,d4
        bra             TCSendParams
TCNoProbe:
        bclr.l  #PROBE,d4

TCSendParams:
        move.wd4,14(a4)                 ; store the modified gain/input select word.
        lea             paramrec,a0
        bsr             TCCvtBoxes
        bsr             wdhatest
        lea             arg1,a4
        move.l  d6,(a4)                 ; put MS in arg1
        pea             arg1
        pea             arg2
        fL2X            ; convert MS to extended in arg2
        move.l  d7,(a4)                 ; put SMS in arg1
        pea             arg1
        pea             arg3
        fL2X            ; convert SMS to extended in arg3
        move.l  #8388608,(a4)           ; 2^23
        pea             arg1
        pea             arg4
        fL2X            ; convert 2^23 to extended in arg4
        pea             arg4
        pea             arg2
        fdivx   ; divide MS by 2^23 to move decimal point
        pea             arg4
        pea             arg3
```

```
fdivx          ; divide SMS by 2^23 to move decimal point
pea            two
pea            arg3
fdivx   ; SMS/2
pea            arg2
pea            arg2
fmulx   ; MS^2
pea            arg2
pea            arg3
fsubx   ; E in arg3
lea            arg1,a0
move.l #4342944,(a0)
pea            arg1
pea            arg2
fL2X           ; get 1000000*10/log base e of 10 in arg2
pea            thousand
pea            arg2
fdivx   ; get three decimal places
pea            thousand
pea            arg2
fdivx   ; now six decimal places
pea            arg3
flnx           ; take log base e of E
pea            arg2
pea            arg3
fmulx   ; now Power = (10 * log base e of E)/(log base e of 10) in arg3
pea     arg3
pea     arg2
fx2x                   ; copy arg3 (Power) to arg2
pea     arg2
ftintx         ; Truncate result
pea     arg2
pea     arg3
fsubx          ; Now integer part in arg2, fractional part in arg3
pea     thousand
pea     arg3
fmulx          ; get three decimal places
pea     thousand
pea     arg3
fmulx          ; now six decimal places
pea     arg2
pea     arg1
fx2l                   ; convert decimal part to long integer
lea     PDecimal,a0
move.l arg1,(a0)
pea     arg3
pea     arg1
fx2l                   ; convert fractional part to long integer
lea     PFract,a1
move.l arg1,(a1)
bpl            PResult
tst.l          (a0)
beq            PResult
neg.l          (a1)
```

```
; Print Result
PResult:
        bsr             WDHATCDraw
; Now put the WDHA in either hearing aid state or idle state
        clr.w   -(sp)                   ; GetCtlValue returns a word
        move.l  AidControl,-(sp)        ; the handle
        _GetCtlValue
        tst.w   (sp)+
        beq             TCAidOff
        move.w#-1,d0                    ; go to hearing aid mode
        bra             TCSetMode
TCAidOff:
        move.w#-100,d0                          ; go to idle mode
TCSetMode:
        jsr     scsiwr                          ;send mode code to WDHA
        movem.l         (sp)+,d0-d7/a0-a6       ; restore registers
        rts

; Name: TCCvtBoxes
; Function: TCCvtBoxes actually does the work of filling the paramrec by
; converting the text of the text boxes to their appropriate values, and by
; calculating the sine and cosine factors from the specified frequency.
; Input: None
; Output: None
TCCvtBoxes:
        movem.l         d0-d7/a0-a6,-(sp)
        lea             TextHandles,a4
        move.w#ToneBursts,d4
TCCBLoop:
        cmp.w  #TextBoxes,d4
        beq             TCCBDone
        move.wd4,d5
        asl.w   #2,d5           ; *4 for longs
        move.l  (a4,d5.w),a0    ; get the text handle
        _HLock                          ; Lock the handle
        move.l  (a0),a2         ; Dereference the handle
        move.w60(a2),d6                 ; get teLength
        lea             NumBuf,a6
        move.b d6,(a6)          ; store the length of the string
        clr.l           -(sp)           ; make room for the result.
        move.l  a0,-(sp)                ; get the text
        _TEGetText
        move.l  (sp)+,a3                ; get it in a3
        move.l  a3,a0
        _HLock                          ; lock the handle
        move.l  (a0),a0         ; Dereference the handle, move src in a0
        lea             NumBufT,a1      ; Destination is NumBufT
        move.wd6,d0             ; BlockMove expects length in d0
        ext.l           d0                      ; expects a long
        _BlockMove
        lea             NumBuf,a0
        move.w#1,-(SP)
        _Pack7                          ; StringToNum puts result in d0
        lea             offsets,a1
```

```
        move.b (a1,d4.w),d1     ; get offset in paramrec of this entry
        ext.w  d1                       ; make it a word.
        lea             paramrec,a0     ; get paramrec base address
        move.wd0,(a0,d1.w)      ; store the value.
        move.l  a3,a0           ; Unlock the text handle
        _HUnlock
        move.l  (a4,d5.w),a0    ; Unlock the TEHandle
        _HUnlock
        add.w   #1,d4           ; go to next box.
        bra             TCCBLoop
TCCBDone:
; Now compute the slope delta values which are 16384/sample count
        lea             paramrec,a4
        move.l  #16384,d0
        move.w2(a4),d1                  ; first do the rise time slope delta
        beq             RTSZero
        divu            d1,d0
        move.wd0,4(a4)
        bra             FTSDelta
RTSZero:
        move.w#$7FFF,4(a4)
FTSDelta:
        move.l  #16384,d0
        move.w8(a4),d1                  ; now do the fall time slope delta
        beq             FTSZero
        divu            d1,d0
        move.wd0,10(a4)
        bra             TCCalcTrig
FTSZero:
        move.w#$7FFF,10(a4)
TCCalcTrig:
; Now send the parameters to the WDHA
        move.wFreq,d0
        lea             arg1,a1
        move.wd0,(a1)
        pea             arg1
        pea             arg3                    ; arg3 will hold fp frequency
        FI2X                                    ;convert from integer to extended fp
; Compute burst amplitude
        move.w          Atten,d0
        bpl                     AttenOK
        clr.w           d0
AttenOK:
        neg.w           d0
        lea                     arg1,a0
        move.w          d0,(a0)         ; store Atten from max output (dB) in arg1
        pea     arg1            ;dB gain
        pea     arg4            ;fpdB gain
        FI2X                    ;convert from integer to extended fp
        pea     fp20dBe         ;20 * log base 10 of e = 8.685889638
        pea     arg4            ;fpdB gain
        fdivx           ;db/fp20dbe (result in arg4)
        pea     arg4
        fexpx           ;base e exponential (db ratio in arg4)
```

```
        pea     twoex14         ;scale it *2E14 to convert it to fixed point
        pea     arg4
        fmulx
        pea     arg4
        pea     arg1
        fx2i                    ;convert extended to integer
        lea             paramrec,a4
        move.warg1,20(a4)    ; store the burst factor
; compute sine and cosine factors
; first get 2*pi*f/fs in arg5
        pea     arg3                            ;frequency
        pea     arg5
        fx2x                                    ;move arg3 to arg5 (frequency)
        pea     twopi                   ;2 pi
        pea     arg5
        fmulx                           ;multiply 2 pi times f (result in arg5)
        pea     fp12277                         ;sampling frequency is 12277 Hz
        pea     arg5
        fdivx                           ;divide by fs (result in arg5)
; Now get cos factor
        pea     arg5
        pea     cosreg
        fx2x                                    ;move arg5 to cosreg
        pea     cosreg
        fcosx                           ;take cosine of cosreg
        pea     twoex15                         ;2^15
        pea     cosreg
        fmulx                           ;multiply by 2^15
        pea     cosreg
        pea     arg1
        fx2i                                    ;convert extended to integer
        lea     paramrec,a4
        move.warg1,16(a4)    ;store cosine factor
; Now do sine
        pea     arg5
        pea     sinreg
        fx2x                                    ;move arg5 to sinreg
        pea     sinreg
        fsinx                           ;take sine of sinreg
        pea     fp1p95                  ;1.95
        pea     sinreg
        fmulx                           ;multiply by 1.95
        pea     twoex14                         ;2^14
        pea     sinreg
        fmulx                           ;multiply by 2^14
        pea     sinreg
        pea     arg2
        fx2i                                    ;convert extended to integer
        lea     paramrec,a4
        move.warg2,18(a4)    ;push sine factor
        movem.l         (sp)+,d0-d7/a0-a6
        rts

;------------WDHATC   data   declarations------------------------------
```

```
WDHATCPtr:   DC.L   0        ; WDHATC WindowPtr
AidControl:  DC.L   0        ; Hearing Aid On Control
IAControl:   DC.L   0        ; Input Attenuation Control
OAControl:   DC.L   0        ; Output Attenuation
FieldControl: DC.L  0        ; Field Mike Control
ProbeControl: DC.L  0        ; Probe Mike Control
StartControl: DC.L  0        ; Start Button Control

; Which Text Edit Record is active?
WActive:            dc.w   -1      ; -1 means none are active

TextHandles:
            dcb.l   TextBoxes,0

paramrec:                          ;WDHA parameter record for test/calibrate
            dc.w    1              ;tone burst count
            dc.w    0              ;rise time sample count
            dc.w    0              ;rise time slope delta
            dc.w    16384  ;signal on sample count
            dc.w    0              ;fall time sample count
            dc.w    0              ;fall time slope delta
            dc.w    16384  ;signal off sample count
            dc.w     4224  ;gain/input select word
            dc.w    0              ;cosine factor
            dc.w    0              ;sine factor
            dc.w    32000  ;burst amplitude
            dc.w    512            ;probe sample count (currently a constant)
            dc.w    32             ;probe sample multiplier (currently a constant)
; The following are not really a part of the paramrec, but currently must
; follow it for the routine TCCvtBoxes to work properly
Freq:       dc.w    0
Atten:  dc.w    0

; Power
PDecimal:   dc.l    0
PFract: dc.l    0

offsets:
            dc.b    0              ;tone burst count is first entry
            dc.b    2              ;rise is second
            dc.b    6              ;on count is fourth
            dc.b    8              ;fall count is next
            dc.b    12             ;off count      is seventh
            dc.b    26             ;frequency is 14th (not really a parameter)
            dc.b    28             ;atten is 15th (not really a parameter)

TextRects:
            dc.w    TCCtlInitY+ToneBursts*20
            dc.w    TCCtlInitX-88
            dc.w    TCCtlInitY+ToneBursts*20+20
            dc.w  TCCtlInitX-20

            dc.w    TCCtlInitY+RiseCount*20
```

```
        dc.w    TCCtlInitX-88
        dc.w    TCCtlInitY+RiseCount*20+20
        dc.w  TCCtlInitX-20

        dc.w    TCCtlInitY+OnCount*20
        dc.w    TCCtlInitX-88
        dc.w    TCCtlInitY+OnCount*20+20
        dc.w  TCCtlInitX-20

        dc.w    TCCtlInitY+FallCount*20
        dc.w    TCCtlInitX-88
        dc.w    TCCtlInitY+FallCount*20+20
        dc.w  TCCtlInitX-20

        dc.w    TCCtlInitY+OffCount*20
        dc.w    TCCtlInitX-88
        dc.w    TCCtlInitY+OffCount*20+20
        dc.w  TCCtlInitX-20

        dc.w    TCCtlInitY+Frequency*20
        dc.w    TCCtlInitX-88
        dc.w    TCCtlInitY+Frequency*20+20
        dc.w  TCCtlInitX-20

        dc.w    TCCtlInitY+Attenuate*20
        dc.w    TCCtlInitX-88
        dc.w    TCCtlInitY+Attenuate*20+20
        dc.w  TCCtlInitX-20

WDHATCBounds:                   ; Bounding rect for window
        DC.W    TCInitY
        DC.W    TCInitX
        DC.W    TCInitY+200
        DC.W    TCRight

ERect:          ; Bounding rectangle for part to erase
        DC.W    TCCtlInitY-8
        DC.W    0
        DC.W    TCCtlInitY+7*TCCtlFHeight
        DC.W    TCCtlInitX

TRect:
        DC.L    0
        DC.L    0       ;For calculating various rectangles.

TPoint: DC.L    0       ;For calculating mouse change.

WhichControl:   DC.L    0       ; A control handle, for temporary storage.

NumBuf:         DC.B    0       ; Buffer for number conversion (length here)
NumBufT:        DCB.B   79,0    ; Text here

KeyBuf:         DCB.B   80,0
```

```
arg1        dcb.w  8,0      ;integer buffer
arg2        dcb.w  8,0      ;extended floating point buffer
arg3        dcb.w  8,0      ;extended floating point buffer
arg4        dcb.w  8,0      ;extended floating point buffer
arg5        dcb.w  8,0      ;extended floating point buffer
cosreg      dcb.w  8,0      ;room for cosine factor
sinreg      dcb.w  8,0      ;room for sine factor
xacc        dcb.w  8,0      ;extended accumulator
txreg       dcb.w  8,0      ;temporary extended register
pi          dc.w   $4000,$c90e,$5604,$1893,$74bc
twopi       dc.w   $4001,$c90e,$5604,$1893,$74bc
zero        dc.w   $0000,$0000,$0000,$0000,$0000
one         dc.w   $3fff,$8000,$0000,$0000,$0000
fp1p95      dc.w   $3fff,$f999,$9999,$9999,$999a
two         dc.w   $4000,$8000,$0000,$0000,$0000
twoex14             dc.w   $400d,$8000,$0000,$0000,$0000
twoex15             dc.w   $400e,$8000,$0000,$0000,$0000
twoex16             dc.w   $400f,$8000,$0000,$0000,$0000
ten         dc.w   $4002,$a000,$0000,$0000,$0000
hundred     dc.w   $4005,$c800,$0000,$0000,$0000
thousand    dc.w   $4008,$fa00,$0000,$0000,$0000
fp12500             dc.w   $400c,$c350,$0000,$0000,$0000
fp12277             dc.w   $400c,$bfd4,$0000,$0000,$0000
fp20dBe             dc.w   $4002,$8af9,$db22,$d0e5,$6042
```

```
; WDHATC.hdr
; This file must be included if your program uses the
; WDHA Test/Calibrate window.
        XREF    WDHATCOpen
        XREF    WDHATCClose
        XREF    WDHATCShow
        XREF    WDHATCHide
        XREF    WDHATCDraw
        XREF    WDHATCControl
        XREF    WDHATCIdle
        XREF    WDHATCKey
        XREF    WDHATCIS
        XREF    WDHATCDoTest
```

```
; file WDGHAFC.Asm
;       This file contains two routines which read text files containing
; numeric expressions, and download the numbers to the digital hearing
; aid. The routine WDHAFCSet is used in the Aid13 program to download
; filter tap coefficients to the hearing aid. The routine WDHASetFileParams
; is used to download parameters for the SS15 spectral shaping program.
; The text files accessed by these routines must contain integer numbers
; seperated by any chracter which is nonnumeric and not '-' (generally spaces,
; tabs, or carriage returns). The text files accessed by WDHAFCSet can also
; contain simple numeric expressions of the form A/B, where A and B are
; integers.
Include MacTraps.D
Include ToolEquX.D
Include SysEquX.D
Include QuickEquX.D
Include FSEqu.D
Include MDS2:WDHADisk.hdr
Include MDS2:WDHASCSI.hdr

        XDEF    WDHAFCSet
        XDEF    WDHASetFileParams

; Constants for division
NoDiv   EQU     0       ; Haven't seen a '/'
ReadOne         EQU     1       ; Read first operand
DoDiv   EQU     2       ; Read second operand, so don't division.

; Name: WDHAFCSet
; Function: This routine uses the SFGetFile dialog to get the name of the file
;       from the user, then opens the file, converts it's contents from text form
;       to binary integer form, then downloads it to the hearing aid.
; Input: None
; Output: None
WDHAFCSet:
        movem.l         d0-d7/a0-a6,-(sp)
; Do SFGetFile
        move.l  #$00480048,-(sp)        ; where
        pea     'Which Filter Coefficient File?' ; prompt
        move.l  #0,-(sp)                        ; fileFilter procedure
        move.w#-1,-(sp)                         ; display all types of files
        pea             FTypes                  ; typeList
        move.l  #0,-(sp)                        ; dlgHook
        pea             Reply                   ; SFReply
        move.w#2,-(sp)                          ; trap to SFGetFile
        _Pack3
; Did they choose a file?
        lea             good,a3
        tst.w   (a3)
        beq             DoneFCSet
; Yes, open it.
        lea     fName,a1                ; file name pointer
        bsr     DiskOpen
        tst.w   d1              ; test ioResult
        bne             DoneFCSet
```

```
; Now d2 has ioRefNum
        move.w#1,d1  ; read one sector
        lea          myBuffer,a1
        bsr          DiskRead
        bsr          DiskClose
; Now convert text buffer to words
        move.w#64,d3 ; d3 will be a counter
        move.w#NoDiv,d6      ; d6 tells if we should divide or not
        lea          myBuffer,a1
        lea          numRec,a2
FCLoop:
        lea          numBuffer,a0
; Convert from text buffer to a string
        clr.w   d4           ; count length of string
FCSLoop:
        move.b (a1)+,d5
        cmp.b   #'/',d5
        bne          FCSNotDiv
        move.w#ReadOne,d6
        bra          FCSDone
FCSNotDiv
        cmp.b   #'-',d5
        beq          FCSGo
        cmp.b   #'0',d5
        blo          FCSDone
        cmp.b   #'9',d5
        bhi          FCSDone
FCSGo:
        add.w   #1,d4
        move.b d5,(a0)+
        bra          FCSLoop
FCSDone:
        lea          numString,a0
        move.b d4,(a0)
        move.w#1,-(SP)
        _Pack7               ;StringToNum - cvt numString to word in d0
        cmp.w  #NoDiv,d6     ; Are we dividing?
        beq          FCSDone2
        cmp.w  #ReadOne,d6   ; Have we read one?
        bne          FCSDone1
        add.w   #1,d3        ; This one won't really count
        move.w#DoDiv,d6      ; Next time we'll divide
        bra          FCSDone2
FCSDone1:
        cmp.w  #DoDiv,d6     ; Should be dividing if we reach here
        bne          FCSDone2
        move.wd0,d1          ; get the divisor in d1
        lea     -2(a2),a2                ; back up the pointer to the first operand
        move.w(a2),d0        ; get the first operand
        ext.l        d0                  ; extend dest of divs to long
        divs         d1,d0
        move.w#NoDiv,d6      ; finished this divide
        bra          FCSDone2
FCSDone2:
```

```
        move.w d0,(a2)+         ;store result
        sub.w   #1,d3
        bne             FCLoop
; Send the coefficients to the WDHA
        lea             numRec,a0
        bsr             SetCoefficients
DoneFCSet:
        movem.l         (sp)+,d0-d7/a0-a6
        rts

; Name: WDHASetFileParams
; Function: This routine uses the WDHAGetFile dialog to get the file name
;       from the user, then opens the file, converts it's contents from text form
;       to binary integer form, then downloads it to the hearing aid.
; Input: None
; Output: None
WDHASetFileParams:
        movem.l         d0-d7/a0-a6,-(sp)
; Do SFGetFile
        move.l  #$00480048,-(sp)        ; where
        pea     'Which Set Params File?'        ; prompt
        move.l  #0,-(sp)                        ; fileFilter procedure
        move.w#-1,-(sp)                         ; display all types of files
        pea             FTypes                  ; typeList
        move.l  #0,-(sp)                        ; dlgHook
        pea             Reply                   ; SFReply
        move.w#2,-(sp)                          ; trap to SFGetFile
        _Pack3
; Did they choose a file?
        lea             good,a3
        tst.w   (a3)
        beq             DoneFileSet
; Yes, open it.
        lea     fName,a1                ; file name pointer
        bsr     DiskOpen
        tst.w   d1              ; test ioResult
        bne             DoneFileSet
; Now d2 has ioRefNum
        move.w#3,d1  ; read three sectors
        lea             myBuffer,a1
        bsr             DiskRead
        bsr             DiskClose
; Now convert text buffer to words
        move.w#320,d3           ; d3 will be a counter
        lea             myBuffer,a1
        lea             numRec,a2
FileOuterLoop:
        lea             numBuffer,a0
; Convert from text buffer to a string
        clr.w   d4              ; count length of string
FileLoop:
        move.b (a1)+,d5
        cmp.b   #'-',d5
        beq             FileGo
```

```
        cmp.b   #'0',d5
        blo             FileDone
        cmp.b   #'9',d5
        bhi             FileDone
FileGo:
        add.w   #1,d4
        move.b d5,(a0)+
        bra             FileLoop
FileDone:
        lea             numString,a0
        move.b d4,(a0)
        move.w#1,-(SP)
        _Pack7                  ;StringToNum - cvt numString to word in d0
        move.wd0,(a2)+          ;store  result
        sub.w   #1,d3
        bne             FileOuterLoop
; Send the coefficients to the WDHA
        lea             numRec,a0
        bsr             SetFileParams
DoneFileSet:
        movem.l         (sp)+,d0-d7/a0-a6
        rts

Reply:
good:   dc.w    0
copy:   dc.w    0
fType:  dc.w    0
vRefNum         dc.w    0
version:        dc.w    0
fName: dcb.b    64,0

FTypes:         dc.l    'TEXT'

numString:      dc.b            0       ; length
numBuffer:      dcb.b   63,0    ; text

numRec:                 dcb.w   320,0
myBuffer:               dcb.b   1536,0
```

```
; WDHAFC.hdr
; This file must be included if your program uses the
; Set Filter Coefficients function.
        XREF    WDHAFCSet
        XREF    WDHASetFileParams
```

```
; WDHASCSI.Asm
;       This file contains routines for sending records back and forth
; between the Mac and the WDHA via the SCSI bus interface.

Include MacTraps.D
Include SysEquX.D
Include ToolEquX.D
Include MDS2:WDHA.hdr

        XDEF    SetParam
        XDEF    SetCoefficients
        XDEF    SetFileParams
        XDEF    wdhatest
        XDEF    SCSIInterrogate

        XDEF    SCSIWr
        XDEF    SCSIRd
        XDEF    SCSIBTst

;scsi bus bit assignments
        abs     equu    1               ;assert data bus
        dbs     equ     0               ;deassert data bus
        ack     equ     0               ;assert acknowledge line
        dck     equ     16              ;deassert acknowledge line
        atn     equ     0               ;assert attention line
        dtn     equ     2               ;deassert attention line

;Set WDHA parameters subroutine
;calling protocol
;       lea     paramrec,a0     ;set pointer to set parameter record
;       jsr     SetParam
SetParam:
        movem.l         a0-a6/d0-d7,-(sp)       ;save registers
        clr.w   -(sp)
        bsr     SCSIInterrogate
        move.w(sp)+,d0
        beq     @4
        cmp.w   #-100,d0        ;SS15ID
        beq     @4
        move.l  #8-1,d1                 ;set loop counter
        move.w#-2,d0            ;get -2 mode code (set aid parameters)
        jsr     scsiwr          ;send mode code to WDHA
@1      jsr     ScsiBTst        ;test for WDHA
        beq     @1              ;ready
@2      move.w(a0)+,d0          ;get parameter
        jsr     scsiwr          ;send parameter to WDHA
@3      jsr     ScsiBTst        ;test for WDHA.
        beq     @3              ;ready
        dbra    d1,@2           ;check end of loop
        move.w(a0)+,d0          ;get last parameter
        jsr     scsiwr          ;send last parameter to WDHA
@4
        movem.l         (sp)+,a0-a6/d0-d7       ;restore registers
        rts
```

```
;Set WDHA filter coefficients subroutine
;calling protocol
;       lea     corec,a0        ;set pointer to array of coefficients
;       jsr     SetCoefficients
SetCoefficients:
        movem.l         a0-a6/d0-d7,-(sp)       ;save registers
        move.w#-4,d0            ;get -4 mode code (set aid coefficients)
        jsr     scsiwr          ;send mode code to WDHA
@1      jsr     ScsiBTst        ;test for WDHA
        beq     @1              ;ready
        move.l  #63,d1          ;set loop counter
@2      move.w(a0)+,d0          ;get parameter
        jsr     scsiwr          ;send parameter to WDHA
@3      jsr     ScsiBTst        ;test for WDHA
        beq     @3              ;ready
        sub.w   #1,d1           ;check end of loop
        bne     @2
        move.w(a0)+,d0          ;get last parameter
        jsr     scsiwr          ;send last parameter to WDHA
        movem.l         (sp)+,a0-a6/d0-d7       ;restore registers
        rts

;Set file parameters subroutine
;calling protocol
;       lea     filerec,a0      ;set pointer to array of 320 coefficients
;       jsr     SetFileParams
SetFileParams:
        movem.l         a0-a6/d0-d7,-(sp)       ;save registers
        move.w#-5,d0            ;get -5 mode code (set aid coefficients)
        jsr     scsiwr          ;send mode code to WDHA
@1      jsr     ScsiBTst        ;test for WDHA
        beq     @1              ;ready
        move.l  #319,d1                 ;set loop counter
@2      move.w(a0)+,d0          ;get parameter
        jsr     scsiwr          ;send parameter to WDHA
@3      jsr     ScsiBTst        ;test for WDHA
        beq     @3              ;ready
        sub.w   #1,d1           ;check end of loop
        bne     @2
        move.w(a0)+,d0          ;get last parameter
        jsr     scsiwr          ;send last parameter to WDHA
        move.w#-1,d0            ;get -1 mode code (hearing aid mode)
        jsr     scsiwr          ;send mode code to WDHA
        movem.l         (sp)+,a0-a6/d0-d7       ;restore registers
        rts


; WDHA test subroutine
;calling protocol
;       lea     paramrec,a0     ;set pointer to set parameter record
;       jsr     wdhatest
; upon exit:
; d6 has the mean sum
```

```
; d7 has the square mean sum
wdhatest:
        movem.l         a0-a6/d0-d5,-(sp)       ;save registers
        move.w#-3,d0            ;get -3 mode code (test/calibrate)
        jsr     scsiwr          ;send mode code to WDHA
@1      jsr     ScsiBTst        ;test for WDHA
        beq     @1              ;ready
        move.l  #13,d1 ;set loop counter (do all but last)
@2      move.w(a0)+,d0          ;get parameter
        jsr     scsiwr          ;send parameter to WDHA
        subq.b  #1,d1
        bne     @2              ;check end of loop

; read probe sample
@4      jsr     ScsiBTst
        beq     @4                      ;test for WDHA bit
; read mean sum
        clr.l   d0
        jsr     scsiwr                  ;write dummy to wdha
        jsr     scsird                  ;read high 16 bits
        move.wd0,d6                     ;store in d6
        swap    d6                      ;get it in high word
        clr.l   d0
        jsr     scsiwr                  ;write dummy to wdha
        jsr     scsird                  ;read low 9 bits
        move.wd0,d6                     ;store in d6
        asl.w   #7,d6                   ;shift it left to the most sig word.
        asr.l   #7,d6                   ;shift the whole thing right.
; read the mean square sum
        clr.l   d0
        jsr     scsiwr                  ;write dummy to wdha
        jsr     scsird                  ;read high 16 bits
        move.wd0,d7                     ;store in d7
        swap    d7                      ;get it in most sig word.
        clr.l   d0
        jsr     scsiwr                  ;write dummy to wdha
        jsr     scsird                  ;read low 9 bits
        move.wd0,d7                     ;store in d7
        asl.w   #7,d7                   ;shift it left to the most sig word.
        asr.l   #7,d7                   ;shift the whole thing right.
        movem.l         (sp)+,a0-a6/d0-d5       ;restore registers

; Name: SCSIWr
; Function: Send the 16 bit integer in d0 to the hearing aid via the SCSI bus.
; Input: d0 contains the word to write.
; Output: None
SCSIWr:
        movem.l         d0-d3,-(SP)
        move.b #abs+dck+dtn,$580011             ;assert data bus
        move.w#1,d2                     ;set the
        roxr.w #1,d2                    ;extend bit
        move.w#17-1,d2                  ;set loop counter
@1:     roxl.w #1,d0                    ;move in next bit
        move.wd0,d1                     ;copy d0
```

```
        and.w   #1,d1                   ;mask is bit
        move.b d1,$580001               ;write to output data bus
        move.b #abs+ack+dtn,$580011         ;assert acknowledge (clock into wdha)
        move.b #abs+dck+dtn,$580011         ;deassert acknowledge (clock into wdha)
        dbra    d2,@1                   ;loop counter
        move.w#1000,d3                  ;write delay
@2      dbra    d3,@2
        move.b #dbs+dck+dtn,$580011         ;deassert data bus and all
        movem.l         (SP)+,d0-d3
        rts

; Name: SCSIRd
; Function: Read a word from the SCSI bus in register d0.
; Input: None
; Output: d0 contains the word red
SCSIRd:         movem.l         d1-d3,-(SP)
        move    #16-1,d2                ;set loop counter
        move.b #dbs+dck+dtn,$580011         ;deassert data bus and all
@1:     asl.w   #1,d0                   ;shift
        move.b $580000,d1               ;read data bus
        move.b #dbs+atn+dck,$580011         ;assert attention (clock out wdha)
        and.w   #2,d1                   ;mask input bit (bit 1)
        asr.w   #1,d1                   ;put in position 0
        add.w   d1,d0                   ;add bit to data
        move.b #dbs+dtn+dck,$580011         ;deassert attention (clock out wdha)
        move.w#250,d3                       ;deassert-assert delay
@2      dbra    d3,@2
        dbra    d2,@1                   ;loop counter
        movem.l         (SP)+,d1-d3
        rts

;Test SCSI read bit (Bit 1).  Returns with d0 = 0 or 2
SCSIBtst:
; If the mouse button is pressed then stop communication
        movem.l         a0-a1/d0-d2,-(sp)       ; save registers
        clr.w   -(sp)
        _Button
        tst.w   (sp)+
        bne     StopCom
        movem.l         (sp)+,a0-a1/d0-d2
        move.b #dbs+dck+dtn,$580011         ;deassert data bus and all
        move.b $580000,d0               ;read SCSI bus
        and.w   #2,d0                   ;mask position 1
        rts

; If the button is pressed during communication we set the hearing aid
; to idle and return to the main loop.  Note that extra parameters may
; be left on the stack from the routines which called SCSIBtst.
StopCom:
        move.w#-5,d0
        bsr     SCSIWr
        bsr     SCSIWr
        movem.l         (sp)+,a0-a1/d0-d2       ; Restore registers
        clr.l   (sp)+                   ; Pop SCSIBtst return address
```

```
        bra     EventLoop

; Name: SCSIInterrogate
; Function: Interrogate the hearing aid to determine which program it is running,
;       returning the program identifier code that the hearing aid sends back.
;       If the hearing aid does not respond within a certain timeout period, the
;       routine returns with zero as the result.
; Input: None
; Output: The program code (on the stack)
;***Note: The user should push a word for the result.
SCSIInterrogate:
        movem.l         d0-d7/a0-a6,-(sp)
        move.w#-10,d0                           ;interrogate WDHA for program type
        bsr     SCSIWr
        clr.w   d0
        move.w#20000,d7
@1      sub.w   #1,d7
        beq     @2
        jsr     ScsiBTst                ;test for WDHA
        beq     @1                      ;ready
@2      jsr     scsird                  ;read high 16 bits into d0
        move.wd0,64(sp)
        move.w#-1,d0                    ;set hearing aid mode
        bsr     SCSIWr
        movem.l         (sp)+,d0-d7/a0-a6
        rts
```

```
; WDHASCSI.hdr

        XREF    SetParam
        XREF    SetCoefficients
        XREF    SetFileParams
        XREF    SCSIInterrogate
        XREF    wdhatest

        XREF    SCSIWr
        XREF    SCSIRd
        XREF    SCSIBTst

PROBE   EQU     9
FIELD   EQU     12
INPUT   EQU     7
OUTPUT          EQU     10
```

```
;WDHADisk.asm file

Include         FSEqu.D
Include MacTraps.D     ; Use System and ToolBox traps
Include         ToolEquX.D      ; Use ToolBox equates
Include         SysEquX.D
Include         QuickEquX.D

        XDEF    DiskCreate
        XDEF    DiskRead
        XDEF    DiskWrite
        XDEF    DiskEject
        XDEF    DiskOpen
        XDEF    DiskClose
        XDEF    DiskSetFPos
        XDEF    DiskSetEOF
        XDEF    DiskSetFInfo

ioNamePtr       equ     18              ;not included in .d files
ioFVersNum      equ     26              ;not included in .d files
ioMisc          equ     ioRefNum+4      ;not included in .d files


DiskRead:
        ;assumes d2 contains ioRefNum
        ;assumes d1 contains number of 512 byte sectors to read
        ;assumes a1 points to the buffer to fill
        ;returns with a0 pointing to parameter block on stack
        ;and with ioResult in d0
        ;the number of bytes actually read is returned in d3 (long)

        moveq   #ioVQElSize/2 - 1,d0
@1:     clr.w   -(sp)                   ;make room on stack for
        dbra    d0,@1                   ;for parameter block
        move.l  sp,a0                   ;set A0 for file manager call

        move.wd2,ioRefNum(a0)                   ;and to access parameters in block
        mulu    #512,d1                         ;multiply number of sectors by 512
        move.l  d1,ioReqCount(a0)       ;sectors required
        divu    #512,d1                         ;restore d1
        move.l  a1,ioBuffer(a0)
        _Read
        move.l  ioActCount(a0),d3
        add     #ioVQElSize,SP
        rts


DiskWrite:
        ;assumes d2 contains ioRefNum
        ;assumes d1 contains number of 512 byte sectors to write
        ;assumes a1 points to the buffer to write
        ;returns with ioResult in d0
        ;and a0 pointing to parameter block on stack
```

```
        moveq  #ioVQElSize/2 - 1,d0
@1:     clr.w  -(sp)                ;make room on stack for
        dbra   d0,@1                ;for parameter block
        move.l sp,a0                ;set A0 for file manager call

        move.wd2,ioRefNum(a0)               ;and to access parameters in block
        mulu   #512,d1                      ;sectors to write * 512 = bytes
        move.l d1,ioReqCount(a0)    ;blocks of 512 bytes required
        divu   #512,d1                      ;restore d1
        move.l a1,ioBuffer(a0)
        _Write
        add    #ioVQElSize,SP
        rts

DiskSetFPos:
        ;assumes d2 contains ioRefNum
        ;assumes d1 contains sector number to position at.
        ;returns with ioResult in d0
        ;and a0 pointing to parameter block on stack

        moveq  #ioVQElSize/2 - 1,d0
@1:     clr.w  -(sp)                ;make room on stack for
        dbra   d0,@1                ;for parameter block
        move.l sp,a0                ;set A0 for file manager call

        move.wd2,ioRefNum(a0)               ;and to access parameters in block
        move.w#1,ioPosMode(a0)      ;0 at current position
                                    ;1 relative to beginning of media
                                    ;3 relative to current position
        mulu   #512,d1
        move.l d1,ioPosOffset(a0)   ;blocks of 512 bytes required
        divu   #512,d1
        _SetFPos
        add    #ioVQElSize,SP
        rts

DiskClose:
        ;assumes d2 contains ioRefNum
        ;returns with ioResult in d0
        ;; and a0 pointing to parameter block on stack

        moveq  #ioVQElSize/2 - 1,d0
@1:     clr.w  -(sp)                ;make room on stack for
        dbra   d0,@1                ;for parameter block
        move.l sp,a0                ;set A0 for file manager call
                                    ;and to access parameter block
        move.wd2,ioRefNum(a0)               ;ioRefNum in d2 from open routine
        _close
        add    #ioVQElSize,SP
        rts


; d3 contains the drive number to eject
DiskEject:
```

```
        moveq  # ioVQElSize/2 - 1,d0
@1:     clr.w   -(sp)
        dbra    d0,@1
        move.l  sp,a0
        move.w#-5,ioRefNum(a0)
        move.wd3,ioDrvNum(a0)
        move.w#ejectCode,csCode(a0)
        _Eject
        add     #ioVQElSize,SP
        rts


DiskCreate:
        ;assumes a1 pointing to file name buffer
        ;returns with a0 pointing to parameter block on stack
        ;d3 contains the drive number to create the file on.

        moveq  #ioVQElSize/2 - 1,d0
@1:     clr.w   -(sp)
        dbra    d0,@1
        move.l  sp,a0                   ;set A0 for file manager call
                                        ;and to access parameter block
        move.l  a1,ioNamePtr(a0)        ;put name pointer in parameter block
        move.b #0,ioFVersNum(a0)        ;version number. always use zero
                                        ;per page II-81, inside mac
        move.wd3,ioVRefNum(a0)          ;drive #
        _Create
        add     #ioVQElSize,SP
        rts


DiskOpen:
        ;assumes a1 pointed to file name buffer
        ;returns with a0 pointing to parameter block on stack
        ;ioRefNum in d2 and ioResult in d1
        ;upon return d3 contains the drive number the file was found on

        moveq  #ioVQElSize/2 - 1,d0
@1:     clr.w   -(sp)
        dbra    d0,@1
        move.l  sp,a0                   ;set A0 for file manager call
                                        ;and to access parameter block
        move.l  a1,ioNamePtr(a0)        ;put name pointer in parameter block
        move.b #0,ioFVersNum(a0)        ;version number. always use zero
                                        ;per page II-81, inside mac
        move.w#2,ioVRefNum(a0)          ;external drive
        _Open
        move.w#2,d3                     ;external drive
        move.wioRefNum(a0),d2                   ;save ioRefNum of file in d2
        move.wioResult(a0),d1           ;get io result
        beq     DOpenGood
        move.w#1,ioVRefNum(a0)          ;internal drive
        _Open
        move.w#1,d3                     ;internal drive
```

```
        move.w ioRefNum(a0),d2              ;save ioRefNum of file in d2
        move.w ioResult(a0),d1          ;get io result
DOpenGood:
        add.l   #ioVQElSize,SP
        rts

DiskSetEOF:
        ;assumes d2 contains ioRefNum
        ;assumes d1 contains position to position at (a long).
        ;returns with ioResult in d0
        ;and a0 pointing to parameter block on stack

        moveq  #ioVQElSize/2 - 1,d0
@1:     clr.w   -(sp)                   ;make room on stack for
        dbra    d0,@1                   ;for parameter block
        move.l  sp,a0                   ;set A0 for file manager call

        move.w d2,ioRefNum(a0)              ;and to access parameters in block
        move.w #1,ioPosMode(a0)         ;0 at current position
                                        ;1 relative to beginning of media
                                        ;3 relative to current position
        move.l  d1,ioMisc(a0)           ;blocks of 512 bytes required
        _SetEOF
        move.w ioResult(a0),d0          ;get io result
        add.l   #ioVQElSize,SP
        rts

DiskSetFinfo:
        ;assumes a1 pointing to file name buffer
        ;assumes d6 contains file creator
        ;assumes d7 contains file type
        ;d3 contains the drive number to create the file on.
        ;returns with a0 pointing to parameter block on stack
        movem.l         d0-d7/a0-a6,-(sp)
        moveq  #ioVQElSize/2 - 1,d0
@1:     clr.w   -(sp)
        dbra    d0,@1
        move.l  sp,a0                   ;set A0 for file manager call
                                        ;and to access parameter block
        move.l  sp,a4
        move.l  a1,ioNamePtr(a0)        ;put name pointer in parameter block
        move.b #0,ioFVersNum(a0)        ;version number. always use zero
                                        ;per page II-81, inside mac
        move.w d3,ioVRefNum(a0)         ;drive #
        _GetFileInfo                    ;get file info
        move.l  a4,a0
        move.l  d7,32(a0)
        move.l  d6,36(a0)
        _SetFileInfo
        add.l   #ioVQElSize,SP
        movem.l         (sp)+,d0-d7/a0-a6
        rts
```

```
; WDHADisk.hdr
; This file must be included if your program uses the disk commands.
        XREF    DiskCreate
        XREF    DiskRead
        XREF    DiskWrite
        XREF    DiskEject
        XREF    DiskOpen
        XREF    DiskClose
        XREF    DiskSetFPos
        XREF    DiskSetEOF
        XREF    DiskSetFInfo
```

What is claimed is:

1. An adaptive gain amplifier circuit comprising:

an amplifier for receiving an input signal in the audible frequency range and producing an output signal;

means for establishing a threshold level for the output signal;

a comparator for producing a control signal as a function of the level of the output signal being greater or less than the threshold level;

a gain register for storing a gain setting;

an adder responsive to the control signal for increasing the gain setting up to a predetermined limit when the output signal falls below the threshold level and for decreasing the gain setting when the output signal rises above the threshold level; and a preamplifier having a preset gain for amplifying the gain setting to produce a gain signal;

wherein the amplifier is responsive to the preamplifier for varying the gain of the amplifier as a function of the gain signal, wherein the output signal is adaptively compressed.

2. The circuit of claim 1 wherein the adder comprises means for increasing the gain setting in increments having a first preset magnitude and for decreasing the gain setting in decrements having a second preset magnitude.

3. The circuit of claim 1 further comprising means for producing a timing sequence wherein the gain register is enabled in response to the timing sequence for receiving the gain setting from the adder during a predetermined portion of the timing sequence.

4. The circuit of claim 1 wherein the adder further comprises a secondary register for storing a first and second preset magnitude and wherein the adder is responsive to the secondary register for increasing the gain setting in increments corresponding to the first preset magnitude and for decreasing the gain setting in decrements corresponding to the second preset magnitude.

5. The circuit of claim 1 further comprising means for clipping the adaptively compressed output signal at a predetermined level and for producing an adaptively clipped compressed output signal.

6. A programmable compressive gain amplifier circuit comprising:

a first amplifier for receiving an input signal in the audible frequency range and for producing an amplified signal;

means for establishing a threshold level for the amplified signal;

a gain register for storing a gain value;

means, responsive to the amplified signal and the threshold level, for increasing the gain value when the amplified signal falls below the threshold level and for decreasing the gain value when the amplified signal rises above the threshold level;

wherein the first amplifier is responsive to the gain register for varying the gain of the first amplifier as a function of the gain value;

a second amplifier for receiving the input signal and for producing an output signal; and means for programming the gain of the second amplifier as a function of the gain value, wherein the output signal is programmably compressed.

7. The circuit of claim 6 wherein the increasing and decreasing means comprises means for increasing the gain value in increments having a first preset magnitude and for decreasing the gain value in decrements having a second preset magnitude.

8. The circuit of claim 7 wherein the increasing and decreasing means further comprises:

a comparator for producing a control signal as a function of the level of the amplified signal being greater or less than the threshold level; and an adder responsive to the control signal for increasing the gain value by the first preset magnitude when the amplified signal falls below the threshold level and for decreasing the gain value by the second preset magnitude when the amplified signal rises above the threshold level, wherein the first amplifier is responsive to the gain register for varying the gain of the first amplifier as a function of the gain value.

9. The circuit of claim 8 wherein the increasing and decreasing means further comprises means for producing a timing sequence wherein the gain register is enabled in response to the timing sequence for receiving the gain value from the adder during a predetermined portion of the timing sequence.

10. The circuit of claim 8 wherein the increasing and decreasing means further comprises a secondary register for storing the first and second preset magnitudes and wherein the adder is responsive to the secondary register for for increasing the gain value in increments corresponding to the first preset magnitude and for decreasing the gain value in decrements corresponding to the second preset magnitude.

11. The circuit of claim 6 wherein the means for programing comprises means for varying the gain of the second amplifier as a function of a power of the gain value.

12. The circuit of claim 11 wherein the means for programing further comprises a register for storing a power value and wherein the programing means varies the gain of the second amplifier as a function of the value derived by raising the gain value to the power of the stored power value.

13. The circuit of claim 6 wherein the first and second amplifiers each comprise a two stage amplifier, the first stage having a variable gain and the second stage having a preset gain.

14. The circuit of claim 6 further comprising means for clipping the programmably compressed output signal at a predetermined level and for producing a programmably clipped and compressed output signal.

15. An adaptive gain amplifier circuit comprising:

an amplifier for receiving an input signal in the audible frequency range and producing an output signal;

a gain register for storing a gain value;

a preamplifier having a preset gain for amplifying the gain value to produce a gain signal;

wherein the amplifier is responsive to the preamplifier for varying the gain of the amplifier as a function of the gain signal;

means for establishing a threshold level for the output signal; and means, responsive to the output signal and the threshold level, for increasing the gain value up to a predetermined limit when the output signal falls below the threshold level and for decreasing the gain value when the output signal rises above the threshold level, wherein the output signal is adaptively compressed.

16. The circuit of claim 15 wherein the increasing and decreasing means comprises:

a comparator for producing a control signal as a function of the level of the output signal being greater or less than the threshold level; and an adder responsive to the control signal for increasing the gain value when the output signal falls below the threshold level and for decreasing the gain value when the output signal rises above the threshold level.

17. The circuit of claim 16 wherein the increasing and decreasing means further comprises means for producing a timing sequence, said increasing and decreasing means being enabled in response to the timing sequence for increasing or decreasing the gain value during a predetermined portion of the timing sequence.

18. The circuit of claim 16 wherein the increasing and decreasing means further comprises a secondary for storing a first and second preset magnitude and wherein the adder is responsive to said secondary register for receiving the first and second preset magnitudes for increasing and decreasing the gain value.

19. The circuit of claim 15 wherein the increasing and decreasing means further comprises means for increasing the gain value in increments having a first preset magnitude and for decreasing the gain value in decrements having a second preset magnitude.

20. The circuit of claim 15 further comprising means for clipping the output signal at a predetermined level and for producing an adaptively clipped compressed output signal.

21. An adaptive gain amplifier circuit comprising:

an amplifier for receiving an input signal in the audible frequency range and producing an output signal;

means for establishing a threshold level for the output signal;

a gain register for storing a gain value; and means, responsive to the output signal and the threshold level, for increasing the gain value in increments having a first preset magnitude when the output signal falls below the threshold level and for decreasing the gain value in decrements having a second preset magnitude when the output signal rises above the threshold level;

wherein the gain register stores the gain value as a first plurality of least significant bits and as a second plurality of most significant bits;

wherein the first preset magnitude comprises a number of bits less than or equal to a total number of bits comprising the least significant bits;

wherein the gain register outputs the most significant bits of the gain value to the amplifier for controlling the gain of the amplifier; and wherein the output signal is compressed as a function of the ratio of the second preset magnitude over the first preset magnitude to produce an adaptively compressed output signal.

22. The circuit of claim 21 further comprising a register for storing the first and second preset magnitudes, the register having six bits of memory for storing the first preset magnitude and six bits of memory for storing the second preset magnitude.

23. The circuit of claim 21 further comprising a register for storing the first and second preset magnitudes; wherein the register stores both said magnitudes in logarithmic form.

24. The circuit of claim 23 further comprises a limiter for limiting the adaptively compressed output signal; wherein the limiter clips a constant percentage of the adaptively compressed output signal.

25. The circuit of claim 21 wherein the gain register stores the gain value in logarithmic form; and wherein the increasing and decreasing means increases and decreases the gain value in constant percentage amounts.

26. An adaptive gain amplifier circuit comprising a plurality of channels connected to a common output, each channel comprising:

a filter with preset parameters for receiving an input signal in the audible frequency range for producing a filtered signal;

a channel amplifier responsive to the filtered signal for producing a channel output signal;

a channel gain register for storing a gain value;

a channel preamplifier having a preset gain for amplifying the gain value to produce a gain signal;

wherein the channel amplifier is responsive to the channel preamplifier for varying the gain of the channel amplifier as a function of the gain signal;

means for establishing a channel threshold level for the channel output signal; and means, responsive to the channel output signal and the channel threshold level, for increasing the gain value up to a predetermined limit when the channel output signal falls below the channel threshold level and for decreasing the gain value when the channel output signal rises above the channel threshold level;

wherein the channel output signals are combined to produce an adaptively compressed and filtered output signal.

27. An adaptive gain amplifier circuit comprising:

a plurality of channels connected to a common output, each channel comprising:

a filter with preset parameters for receiving an input signal in the audible frequency range and for producing a filtered signal;

a channel amplifier responsive to the filtered signal for producing a channel output signal;

means for establishing a channel threshold level for the channel output signal;

a comparator for producing a control signal as a function of the level of the channel output signal being greater or less than the channel threshold level;

a channel gain register for storing a gain setting;

an adder responsive to the control signal for increasing the gain setting by a first preset magnitude when the channel output signal falls below the channel threshold level and for decreasing the gain setting by a second preset magnitude when the channel output signal rises above the channel threshold level; and a second channel gain register for storing a predetermined channel gain value to define an operating range for the channel as a function of a signal level of the input signal;

wherein the channel amplifier is responsive to the gain register and to the second channel gain register for varying the gain of the channel amplifier as a function of the gain setting and the predetermined channel gain value; and wherein the channel output signals are combined to produce an adaptively compressed and filtered output signal.

* * * * *

UNITED STATES PATENT AND TRADEMARK OFFICE

CERTIFICATE OF CORRECTION

PATENT NO. : 5,724,433

DATED : March 3, 1998

INVENTOR(S) : A. Maynard Engebretson et al.

It is certified that error appears in the above-identified patent and that said Letters Patent is hereby corrected as shown below:

Column 196, claim 10, line 25, "register for for" should read ---register for---.

Column 196, claim 12, line 34, "programing means" should read ---means for programming---.

Column 197, claim 18, line 12, "secondary for storing" should read ---secondary register for storing---.

Signed and Sealed this

FourthDay of August, 1998

Bruce Lehman

*Attest:*

BRUCE LEHMAN

*Attesting Officer*

*Commissioner of Patents and Trademarks*